United States Patent [19]

Salazar et al.

[11] Patent Number: 4,643,089

[45] Date of Patent: Feb. 17, 1987

[54] APPARATUS FOR CONTROLLING PRINTING MEANS

[75] Inventors: Edilberto I. Salazar, Brookfield; Wallace Kirschner, Trumbull, both of Conn.

[73] Assignee: Pitney Bowes Inc., Stamford, Conn.

[21] Appl. No.: 692,754

[22] Filed: Jan. 18, 1985

[51] Int. Cl.[4] ..... B41K 3/48; B41K 3/64

[52] U.S. Cl. ..... 101/91; 101/234; 377/49; 271/259

[58] Field of Search ..... 101/91, 92, 110, 111, 101/365, 232–235; 271/258, 259; 364/464; 377/49; 400/485

[56] References Cited

U.S. PATENT DOCUMENTS

| | | | |
|---|---|---|---|
| 3,335,661 | 8/1967 | Moschetti et al. | 101/235 |
| 3,394,249 | 7/1968 | Abernathy et al. | 377/49 |
| 3,867,615 | 2/1975 | Sioufi | 377/49 |
| 4,181,848 | 1/1980 | Iwasz | 377/49 |
| 4,220,084 | 9/1980 | MacLean et al. | 101/235 |
| 4,232,975 | 11/1980 | Kane | 400/144.2 |
| 4,329,923 | 5/1982 | Iida | 101/365 |
| 4,334,471 | 6/1982 | Noyes et al. | 101/235 |
| 4,335,434 | 6/1982 | Banmann et al. | 364/464 |
| 4,508,034 | 4/1985 | Schunemann | 101/365 |
| 4,552,065 | 11/1985 | Billington et al. | 101/233 |

FOREIGN PATENT DOCUMENTS

| | | | |
|---|---|---|---|
| 2026392 | 2/1980 | United Kingdom | 400/642 |

*Primary Examiner*—William Pieprz

*Attorney, Agent, or Firm*—Donald P. Walker; David E. Pitchenik; Melvin J. Scolnick

[57] ABSTRACT

In combination with apparatus for printing indicia on a sheet, and a microcomputer for controlling the indicia printing apparatus to cause the indicia to be printed a predetermined marginal distance from an edge of the sheet, there is provided an improvement for changing the marginal distance. The improvement comprises: operator-controlled apparatus for providing at least one signal representative of at least one increment of distance; and programming the microcomputer for processing the at least one signal to provide a changed marginal distance, wherein the changed marginal distance includes the predetermined distance changed by the at least one increment of distance.

16 Claims, 29 Drawing Figures

3a
d5
38
73b
F
E
G
d4
73a
d3
d6
A
B
C
D
G
D
d
d1
d2
2xd3
d5
d6
t
16
MARGIN
d4
tv
tbd
Tn
Tn
td
Ta
Tc
Td
Ts
Tct
3b
t
16
MARGIN
VI
d4=d in
tv
tbd
t
td-t1
Ta
Tc
Td
Ts
Tct
3c
16
VI
MARGIN
d in
d4
t
td+t1
Ta
Tc
Td
Ts
tpd
Tct
tbd

| MOTOR ROTATION | Q1 | Q2 | Q3 | Q4 | T1 | T2 | T3 | T4 | A | B | C | D | 302 | 304 |
|---|---|---|---|---|---|---|---|---|---|---|---|---|---|---|
| CW | ON | OFF | OFF | ON | ON | OFF | OFF | ON | HIGH | LOW | LOW | HIGH | + | − |
| CCW | OFF | ON | ON | OFF | OFF | ON | ON | OFF | LOW | HIGH | HIGH | LOW | − | + |

FIG. 12

(a) $$H_1(S) = ZOH\,(K_v)\,(K_a)\,\frac{K_m}{S\left(\frac{S}{f_1}+1\right)\left(\frac{S}{f_2}+1\right)}\,K_p$$

(b) $$H_2(S) = ZOH\,(K_v)\,(K_a)\,\frac{K_m}{S\left(\frac{S}{f_1}+1\right)\left(\frac{S}{f_2}+1\right)}\,(K_p)\,(K_c)$$

$$= \frac{e^{S\frac{T}{2}}\,(K_v)\,(K_a)\,(K_m)\,(K_p)\,(K_c)}{S\left(\frac{S}{f_1}+1\right)\left(\frac{S}{f_2}+1\right)}$$

$$= \frac{K_0\,e^{S\frac{T}{2}}}{S\left(\frac{S}{f_1}+1\right)\left(\frac{S}{f_2}+1\right)} = \frac{400\,e^{-0.001\frac{S}{2}}}{S\left(\frac{S}{48}+1\right)\left(\frac{S}{733}+1\right)}$$

FIG. 13

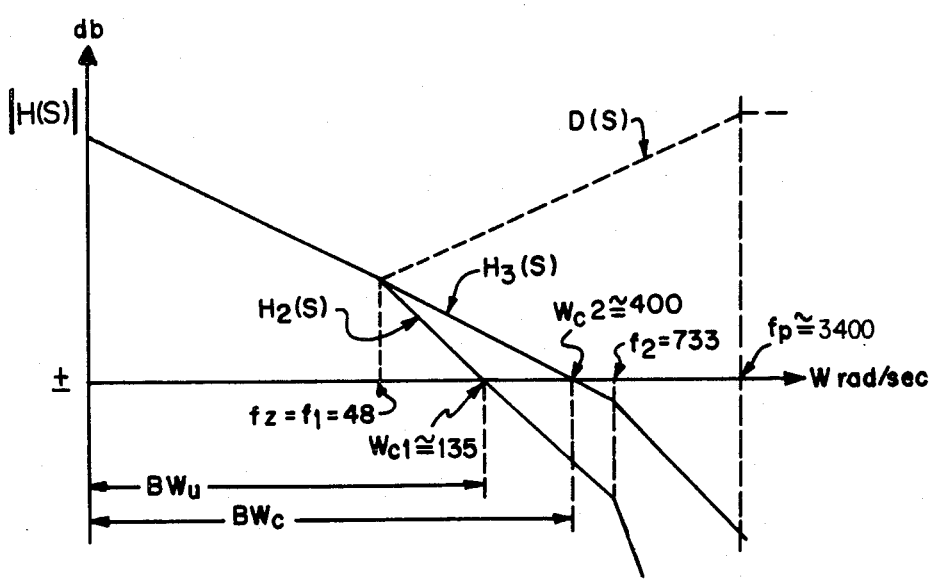

FIG. 14

$$D(S) = K_C \frac{\left(\frac{S}{f_z}+1\right)}{\left(\frac{S}{f_p}+1\right)}$$

$$= 13.64 \frac{\frac{S}{48}+1}{\frac{S}{3400}+1} = 966 \frac{(S+48)}{(S+3400)}$$

FIG. 15

(a) $d_f = \theta_m \frac{\pi}{360°}$ (b) $O_S = 100 \frac{e^{\frac{\pi}{d_f}}}{\sqrt{1-d_f^2}}$ (c) $t_x = \frac{1}{d_f}(W_n) \approx \frac{1}{d_f}(W_c)$ (d) $t_s \approx 5 t_x$

FIG. 16

$$S = \frac{2}{T} \times \frac{Z-1}{Z+1}$$

FIG. 17

$$D(Z) \approx 366 \left(\frac{Z-0.953}{Z+0.259}\right)$$

$$= 366 \left(\frac{1-0.953Z^{-1}}{1+0.259Z^{-1}}\right)$$

FIG. 18

(a) $D(Z) = \frac{G(Z)}{E(Z)} = 366 \left(\frac{1-0.953Z^{-1}}{1+0.259Z^{-1}}\right)$ (b) $G(Z) = 366E(Z) - 348E(Z)Z^{-1} - 0.259G(Z)Z^{-1}$

FIG. 19

$$G(Tn) = 366E(Tn) - 348E(Tn-1) - 0.259G(Tn-1)$$

$$= K_1E(Tn) - K_2E(Tn-1) - K_3G(Tn-1)$$

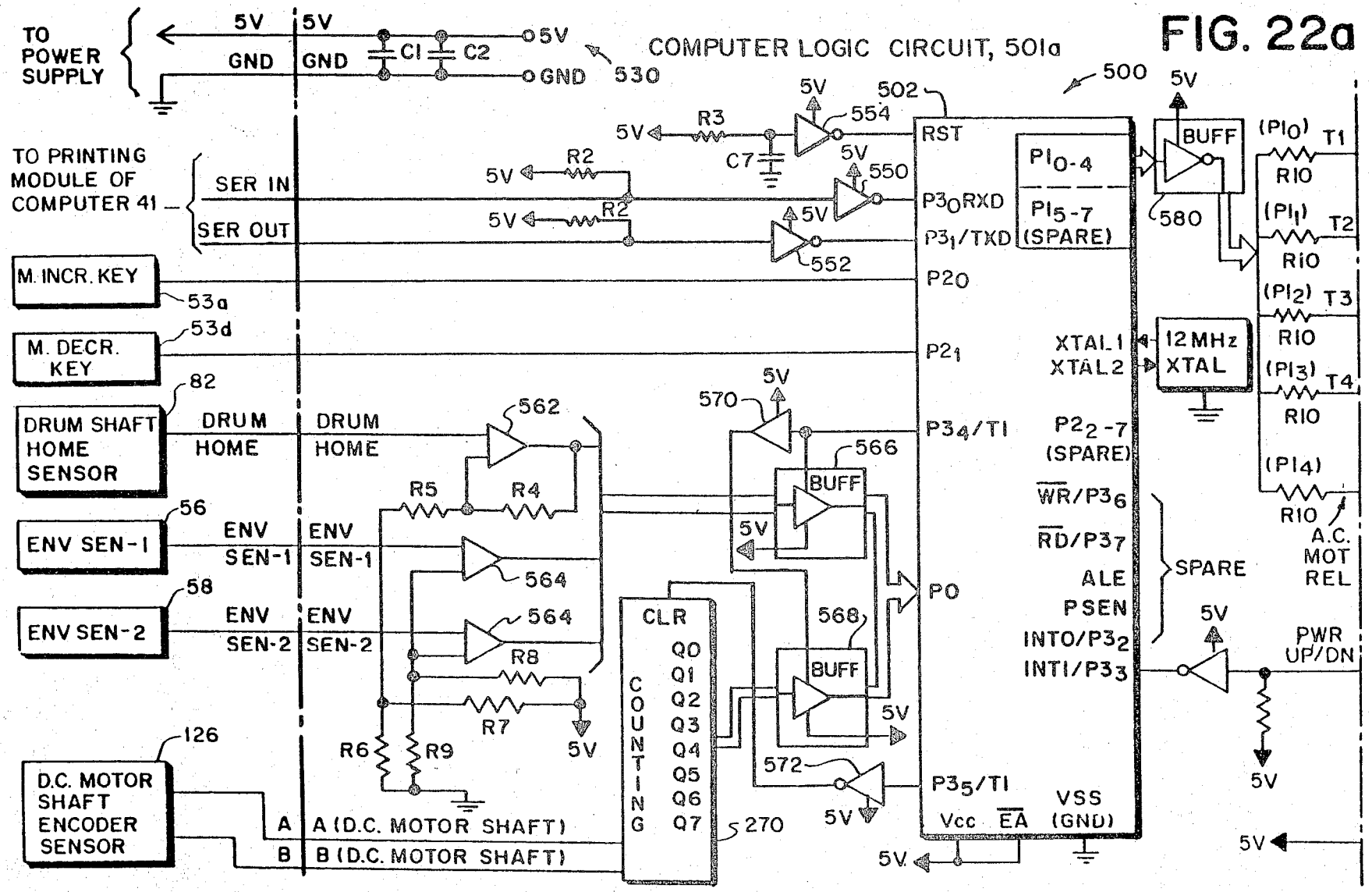
FIG. 22a
COMPUTER LOGIC CIRCUIT, 501a
500
502
530
BUFF
580
12 MHz XTAL
SPARE
PWR UP/DN
A.C. MOT REL
PI0-4
PI5-7 (SPARE)
XTAL 1
XTAL 2
P22-7 (SPARE)
WR/P36
RD/P37
ALE
PSEN
INT0/P32
INT1/P33
VSS (GND)
RST
P30RXD
P31/TXD
P20
P21
P34/T1
P0
P35/T1
Vcc
EA
CLR
Q0 Q1 Q2 Q3 Q4 Q5 Q6 Q7
COUNTING
270
5V
GND
C1
C2
C7
R1
R2
R3
R4
R5
R6
R7
R8
R9
DRUM HOME
ENV SEN-1
ENV SEN-2
A (D.C. MOTOR SHAFT)
B (D.C. MOTOR SHAFT)
SER IN
SER OUT
TO POWER SUPPLY
TO PRINTING MODULE OF COMPUTER 41
M. INCR. KEY
M. DECR. KEY
DRUM SHAFT HOME SENSOR
ENV SEN-1
ENV SEN-2
D.C. MOTOR SHAFT ENCODER SENSOR
53a
53d
82
56
58
126

COMPUTER ANALOG CIRCUIT, 501b
500
D.C. MOTOR
302
304
120
A.C. MOTOR
50
52
A.C. MOTOR SOLID STATE RELAY
30VDC
26
POWER SUPPLY
30VDC
TO LOCAL A.C. SOURCE
GND
C6
5V
30V
GND
C5
548
5V REGULATOR
C4
D1
R1
C3
30V
GND

A
B
C
D
5V
R
305
550
30V
30V DETECT CIRCUITS
542
536
544
OPTO-ISO
OPTO-ISO CIRCUITS
D1
T5
527
T1
T3
T2
T4
A.C. MOT REL
POWER UP/DN
5V

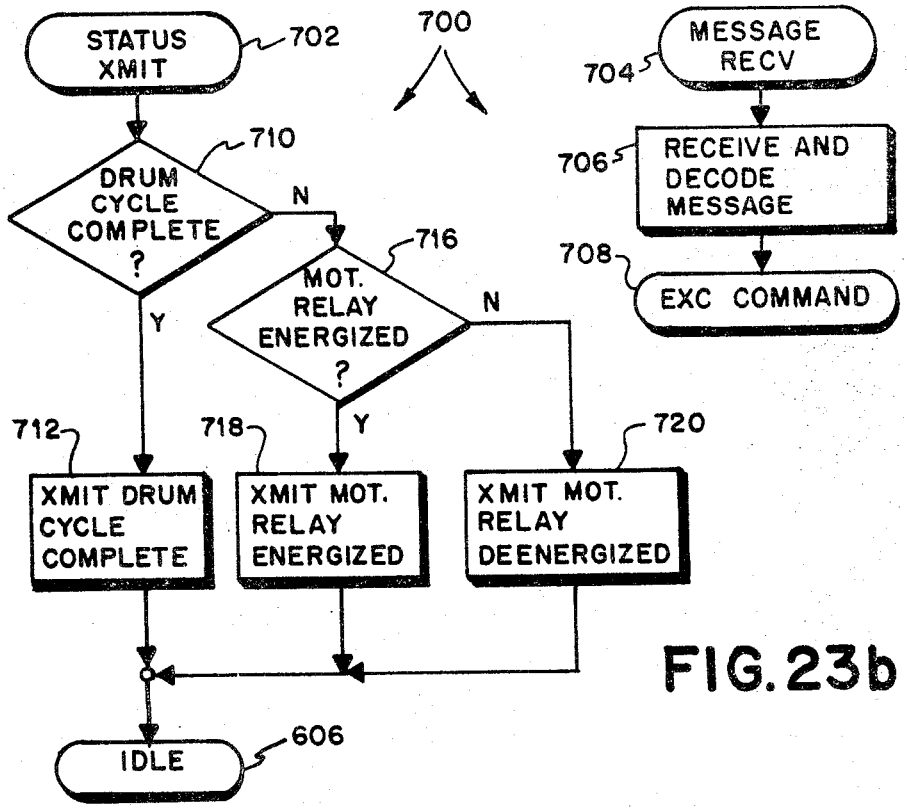
FIG. 23b
FIG. 23c
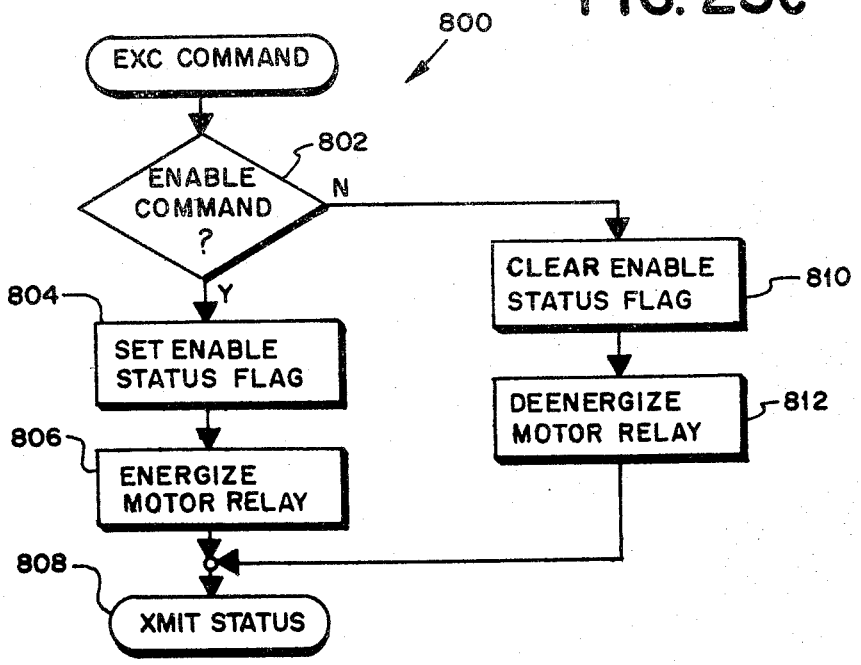

APPARATUS FOR CONTROLLING PRINTING MEANS

BACKGROUND OF THE INVENTION

The present invention is generally concerned with printing means and apparatus for controlling the printing means, for example, in the combination of sheet feeding means and a postage meter including a rotary sheet feeding and printing drum, and improvements therein.

In U.S. patent application Ser. No. 657,546 for a Microprocessor Controlled D.C. Motor For Controlling Printing Means, filed by W. Kirshner and E. Salazar, Oct. 4, 1984, and assigned to the assignee of the present invention, there is described a postage meter which includes a rotary sheet feeding and printing drum coupled to a D.C. motor which is controlled by a microprocessor programmed for causing the drum to print indicia on mailpieces fed to the drum. The indicia is printed on each mailpiece a fixed, predetermined, distance from the leading edge of each mailpiece, independently of variations in the velocity of the respective mailpieces. In particular, drum rotation from a home position is commenced after a predetermined time delay which is adjusted with the velocity of the respective mailpieces fed to the drum, in order to provide for uniform spacing of the indicia from the leading edges of the respective mailpieces, as the drum is cyclically rotated for printing the indicia on each mailpiece while feeding the same downstream beneath the drum as the drum returns to its home position.

It has been found that slight variations occur in the marginal spacing of the indicia from the leading edges of successively fed mailpieces, although the velocity of the mailpieces remains constant, primarily due to the mailpieces having different thicknesses. In order to compensate for such variations in marginal spacing, it is desirable that the customer be provided with the capability of adjusting the marginal spacing of the indicia from mailpiece to mailpiece. In addition, it is desirable to provide the customer with this capability to allow for varying the margin on bordered mailpieces or in instances when the indicia is a slogan rather than postage or some other unit value, alone or in combination with a slogan. Further, it is preferable to provide this capability while at the same time compensating for deviations in the marginal spacing which would otherwise accompany different mailpiece velocities.

Accordingly, an object of the invention is to provide apparatus for controlling printing means;

Another object is to provide, in combination with means for printing indicia on a sheet, and microcomputer means for controlling the indicia printing means to cause the indicia to be printed a predetermined distance from an edge of the sheet, an improvement for changing the marginal distance;

Another object is to provide, in combination with means for printing indicia and means for feeding sheets to the printing means, apparatus for controlling the location of printing the indicia on respective sheets fed to the printing means;

Another object is to provide, in combination with means for feeding a sheet and means for printing indicia on a sheet, operator-controlled means for controlling the marginal distance from the leading edge of the sheet that the indicia in printed on the sheet; and Another object is to provide, in combination with a mailing machine and a postage meter, wherein the mailing machine includes sheet feeding means, the postage meter includes a rotary sheet feeding and indicia printing drum, and the mailing machine includes a D.C. motor coupled to the drum and controlled by a microcomputer, an improvement for controlling the location of printing the indicia on respective sheets fed to the drum.

SUMMARY OF THE INVENTION

In combination with means for printing indicia on a sheet and microcomputer means for controlling the indicia printing means to cause the indicia to be printed a predetermined marginal distance from an edge of the sheet, there is provided an improvement for changing the marginal distance. The improvement comprises: operator-controlled means for providing at least one signal representative of at least one increment of distance; and the microcomputer means including means for processing the at least one signal to provide a changed marginal distance, wherein the changed marginal distance includes the predetermined distance changed by the at least one increment of distance.

BRIEF DESCRIPTION OF THE DRAWINGS

As shown in the drawings wherein like reference numerals designate like or corresponding parts throughout the several views:

FIG. 12 shows the equations for calculating the overall gain of the closed loop servo system of FIG. 10 before (FIG. 12*a*) and after (FIG. 12*b*) including a gain factor corresponding to the system friction at motor start up;

FIG. 13 is a bode diagram including plots for the closed loop servo system before and after compensation to provide for system stability and maximization of the system's bandwidth;

FIG. 14 shows the equation for calculating, in the frequency domain, the value of the system compensator;

FIG. 15 shows the equation for calculating the damping factor, overshoot and settling time of the servo controlled system;

FIG. 16 shows the equation for the Laplace operator expressed in terms of the Z-transform operator;

FIG. 17 shows the equation for calculating the value of the system compensator in the position domain;

FIG. 18 shows the equations for converting the system compensator of FIG. 17 to the position domain;

FIG. 19 shows the equation of the output of the system compensator in the time domain;

FIG. 22 (including FIGS. 22*a* and 22*b*) is a schematic diagram of the computer according to the invention; and FIG. 23 (including FIGS. 23*a*-1, 23*a*-2, 23*b* and 23*c*) shows the flow charts portraying the processing steps of the computer.

DESCRIPTION OF THE PREFERRED EMBODIMENTS

Figure 1:
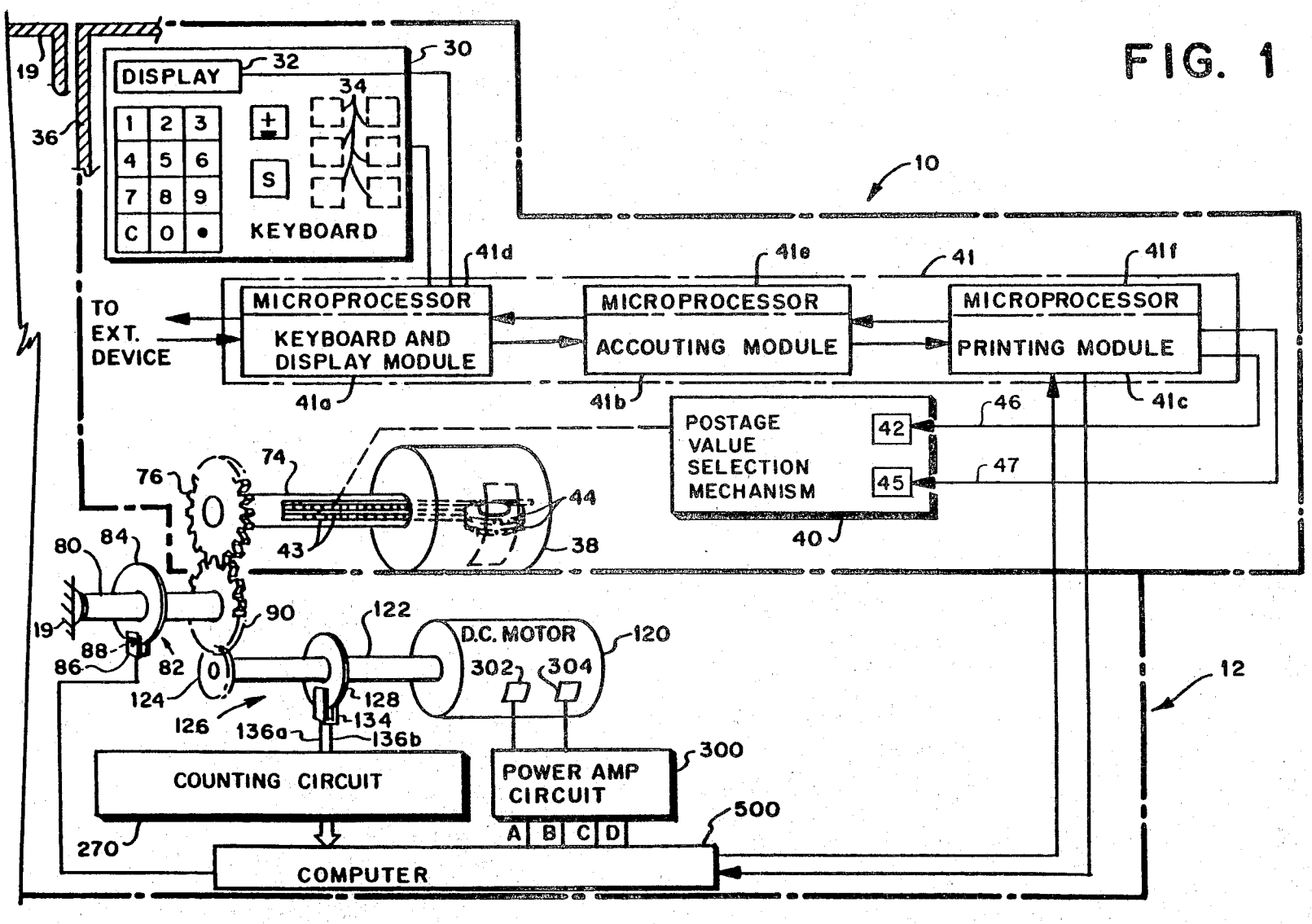
FIG. 1 is a schematic view of a postage meter mounted on mailing machine according to the invention.

As shown in FIG. 1, the apparatus in which the invention may be incorporated generally includes an electronic postage meter 10 which is suitably removably mounted on a conventional mailing machine 12, so as to form therewith a slot 14 (FIG. 2) through which sheets, including mailpieces 16, such as envelopes, cards or other sheet-like materials, may be fed in a downstream path of travel 18.

The postage meter 10 (FIG. 1) includes a keyboard 30 and display 32. The keyboard 30 includes a plurality of numeric keys, labeled 0–9 inclusive, a clear key, labeled "c" and a decimal point key, labeled ".", for selecting postage values to be entered; a set postage key, labeled "s", for entering selected postage values; and an arithmetic function key, labeled "±", for adding subsequently selected charges (such as special delivery costs) to a previously selected postage value before entry of the total value. In addition, there is provided a plurality of display keys, designated 34, each of which are provided with labels well known in the art for identifying information stored in the meter 10, and shown on the display 32 in response to depression of the particular key 34, such as the "postage used", "postage unused", "control sum", "piece count", "batch value" and "batch count" values. A more detailed description of the keys of the keyboard 30 and the display 32, and their respective functions may be found in U.S. Pat. No. 4,283,721 issued Aug. 11, 1981 to Eckert, et al. and assigned to the assignee of the present invention.

In addition, the meter 10 (FIG. 1) includes a casing 36, on which the keyboard 30 and display 32 are conventionally mounted, and which is adapted by well known means for carrying a cyclically operable, rotary, postage printing drum 38. The drum 38 (FIG. 2) is conventionally constructed and arranged for feeding the respective mailpieces 16 in the path of travel 18, which extends beneath the drum 38, and for printing entered postage on the upwardly disposed surface of each mailpiece 16. For postage value selecting purposes, the meter 10 (FIG. 1) also includes a conventional postage value selection mechanism 40, for example, of the type shown in U.S. Pat. No. 4,287,825 issued Sept. 8, 1981 to Eckert, et al. and assigned to the assignee of the present invention. The mechanism 40 which is operably electrically coupled via the postage meter's computer 41 to the keyboard 30 and display 32, includes a first stepper motor 42 for selecting any one of a plurality of racks 43, associated on a one for one basis with each of the print wheels 44, and a second stepper motor 45 for actuating each selected rack 43 for positioning the appropriate printing element of the associated print wheel 44 at the outer periphery of the drum 38 for printing purposes. The rack selection stepper motor 42, which is referred to by skilled artisans as a bank selector motor, is appropriately energized via power lines 46 from the computer 41 for selecting the appropriate rack; and the rack actuating stepper motor 45, which is referred to by skilled artisans as a digit selector motor, is appropriately energized via power lines 47 from the computer 41 to move the selected rack for selecting the appropriate digit element of the associated print wheel 44. A more detailed description of the value selection mechanism 40 may be found in the aforesaid U.S. Pat. No. 4,287,825.

The computer 41 for the postage meter 10 generally comprises a conventional, microcomputer system having a plurality of microcomputer modules including a control or keyboard and display module, 41*a*, an accounting module 41*b* and a printing module 41*c*. The control module 41*a* is both operably electrically connected to the accounting module 41*b* and adapted to be operably electrically connected to an external device via respective two-way serial communications channels, and the accounting module 41*b* is operably electrically connected to the printing module 41*c* via a corresponding two-way serial communication channel. In general, each of the modules 41*a*, 41*b* and 41*c* includes a dedicated microprocessor 41*d*, 41*e* or 41*f*, respectively, having a separately controlled clock and programs. And two-way communications are conducted via the respective serial communication channels utilizing the echoplex communication discipline, wherein communications are in the form of serially transmitted single byte header-only messages, consisting of ten bits including a start bit followed by an 8 bit byte which is in turn followed by a stop bit, or in the form of a multibyte message consisting of a header and one or more additional bytes of information. Further, all transmitted messages are followed by a no error pulse if the message was received error free. In operation, each of the modules 41*a*, 41*b* and 41*c* is capable of processing data independently and asynchronously of the other. In addition, to allow for compatibility between the postage meter 10 and any external apparatus, all operational data transmitted to, from and between each of the three modules 41*a*, 41*b* and 41*c*, and all stored operational information, is accessible to the external device via the two-way communication channel, as a result of which the external apparatus (if any) may be adapted to have complete control of the postage meter 10 as well as access to all current operational information in the postage meter 10. In addition, the flow of messages to, from and between the three internal modules 41*a*, 41*b* and 41*c* is in a predetermined, hierarchical direction. For example, any command message from the control module 41*a* is communicated to the accounting module 41b, where it is processed either for local action in the accounting module 41b and/or as a command message for the printing module 41c. On the other hand, any message from the printing module 41c is communicated to the accounting module 41b where it is either used as internal information or merged with additional data and communicated to the control module 41c. And, any message from the accounting module 41b is initially directed to the printing module 41c or to the control module 41a. A more detailed description of the various prior art modules 41a, 41b and 41c, and various modifications thereof, may be found in U.S. Pat. Nos. 4,280,180; 4,280,179; 4,283,721 and 4,301,507; each of which patents is assigned to the assignee of the present invention.

The mailing machine 12 (FIG. 2), which has a casing 19, includes a A.C. power supply 20 which is adapted by means of a power line 22 to be connected to a local source of supply of A.C. power via a normally open main power switch 24 which may be closed by the operator. Upon such closure, the mailing machine's D.C. power supply 26 is energized via the power line 28. In addition, the mailing machine 12 includes a conventional belt-type conveyor 49, driven by an A.C. motor 50, which is connected for energization from the A.C. power supply 20 via a conventional, normally open solid state, A.C. motor, relay 52, which is timely energized by a computer 500 for closing the relay 52. Upon such closure the A.C. motor 50 drives the conveyor 49 for feeding mailpieces 16 to the drum 38. To facilitate operator control of the switch 24, the mailing machine preferably includes a keyboard 53 having a "start" key 53a and a "stop" key 53b, which are conventionally coupled to the main power switch 24 to permit the operator to selectively close and open the switch 24. Assuming the computer 500 has timely energized the relay 52, the A.C. motor 50 is energized from the A.C. power supply 20. Whereupon the conveyor 49 transports the individual mailpieces 16, at a velocity corresponding to the angular velocity of the motor 50, in the path of travel 18 to the postage printing platen 54.

The mailing machine 12 additionally includes first and second sensing devices respectively designated 56 and 58, which are spaced apart from each other a predetermined distance $d_1$, i.e., the distance between points A and B in the path of travel 18. Preferably, each of the sensing devices 56 and 58, is an electro-optical device which is suitably electrically coupled to the computer 500; sensing device 56 being connected via communication line 60 and sensing device 58 being connected via communication line 62. The sensing devices 56, 58 respectively respond to the arrival of a mailpiece 16 at points A and B by providing a signal to the computer 500 on communication line 60 from sensing device 56 and on communication line 62 from sensing device 58. Thus, the rate of movement or velocity V1 of any mailpiece 16 may be calculated by counting the elapsed time $t_v$ (FIG. 3) between arrivals of the mailpiece 16 at points A and B, and dividing the distance $d_1$, by the elapsed time $t_v$. Since the distance $d_1$, is a mechanical constant of the mailing machine 12, the velocity of the mailpiece may be expressed in terms of the total number $N_t$ of time instants $T_n$ which elapse as the given mailpiece traverses the distance $d_1$. For example, assuming a maximum velocity of 61 inches per second, $d_1=2.75$ inches and $T=1$ millisecond; the total number $N_t$ of elapsed time instants $T_n$ may be found by dividing $d_1=2.75$ inches by $V1=61$ inches per second to obtain $N_t=45$, i.e., the total number of time instants $T_n$ which elapse between arrivals of the mailpiece at points A and B. Thus, the number $N_t=45$ corresponds to and is representative of a mailpiece velocity of $V1=61$ inches per second.

Assuming normal operation of the transport system and calculation of the value of V1 having been made, the time delay $t_d$ (FIG. 3a) before arrival of the mailpiece 16 at point C may be calculated by dividing the distance $d_2$ between points B and C by the mailpiece's velocity V1, provided the distance $d_2$ is known. Since the integral of the initial, triangularly-shaped, portion of the velocity versus time profile is equal to one-half of the value of the product of $T_a$ and $V_1$, and is equal to the arc $d_3$ described by point E on the drum 38, as the drum 38 is rotated counter-clockwise to point D, the distance between points C and D is equal to twice the arcuate distance $d_3$. Accordingly, $d_2$ may be conventionally calculated, as may be the time delay $t_d$ for the maximum throughput velocity. Assuming rotation of the drum 38 is commenced at the end of the time delay $t_d$ and the drum 38 is linearly accelerated to the velocity V1 to match that of the mailpiece 16 in the time interval $T_a$ during which point E on the drum 38 arcuately traverses the distance d3 to point D, Ta may be conventionally calculated. In addition, assuming commencement of rotation at the end of the time delay $t_d$ and that the drum 38 is linearly accelerated to the velocity V1 during the time interval Ta, the mailpiece 16 will arrive at point D coincident with the rotation of point E of the outer periphery 73 the drum 38 to point D, with the result that the leading edge 73a of the drum's outer periphery 73, which edge 73a extends transverse to the path of travel 18 of the mailpiece 16, will engage substantially the leading edge of the mailpiece 16 for feeding purposes and the indicia printing portion 73b of the periphery 73 will be marginally spaced from the leading edge of the mailpiece 16 by a distance $d_4$ which is equal to the circumferential distance between points E and F on the drum 38. Since the circumferential distance $d_5$ on the drum 38 between points E and G is fixed, the time interval Tc during which the drum 38 is rotated at the constant velocity V1 may also be calculated. When point G on the drum 38 is rotated out of engagement with the mailpiece 16, the drum 38 commences deceleration and continues to decelerate to rest during the time interval Td. The distance $d_6$ which is traversed by point G, as the drum 38 is rotated to return point E to its original position of being spaced a distance $d_3$ from point D, is fixed, and, Td may be chosen to provide a suitable deceleration rate for the drum, preferably less than Ta. In addition, a reasonable settling time interval Ts is preferably added to obtain the overall cycling time Tct of the drum 38 to allow for damping any overshoot of the drum 38 before commencing the next drum cycle. For a typical maximum drum cycle time period Tct of 234 milliseconds and a maximum mailpiece transport rate of 61 inches per second, typical values for the acceleration, constant velocity, deceleration and settling time intervals are $Ta=37$ milliseconds, $T_c=124$ milliseconds, $Td=24$ milliseconds and $Ts=234-185=49$ milliseconds. Utilizing these values, the required acceleration and deceleration values for the drum 38 during the time intervals Ta and Td may be conventionally calculated. In addition, since the integral of the velocity versus time profile is equal to the distance traversed by the circumference of the drum 38 during a single revolution of the drum 38, the desired position of the drum 38 at the end of any sampling time period of $T=1$ millisecond may be calculated. For target velocities V1 which are less than the maximum throughput velocity, it is preferably assumed that integral of, and thus the area under, the velocity versus time profile remains constant, and equal to the area thereof at the maximum throughput velocity, to facilitate conventional calculation of the values of the time delay $t_d$, the time intervals Ta, Tc and Td, and the acceleration and deceleration values for each of such lesser velocities V1.

For computer implementation of the foregoing calculations, the computer 500 is programmed to continously poll the communication lines 60 and 62, from the sensing devices 56 and 58, respectively, each time instant $T_n$ at the end of each predetermined time period T, preferably T=one millisecond, and to count the number of time instants $T_n$ which elapse between arrivals of the mailpiece 16 at points A and B as evidenced by a transition signals on lines 60 or 62. Further, the computer 500 is programmed to calculate the current velocity of the mailpiece 16 in terms of the total number Nt of the counted time intervals $T_n$, store the current velocity and, preferably, take an average of that velocity and at least the next previously calculated velocity (if any) to establish the target velocity V1. In addition, it is preferable that precalculated values for the time delay td, acceleration and deceleration corresponding to each of a plurality of target velocities be stored in the memory of the computer 500 for fetching as needed after calculation of the particular target velocity. For marginally spacing the indicia a different predetermined distance from the leading edge of the sheet then would be provided due to the drum's periphery initially engaging the leading edge of the sheet, the value of td may be altered at the time of programming the computer to cause the indicia to initially engage the sheet a different predetermined marginal distance from the leading edge of the sheet. The velocity at any time "t" of the drum 38 may be expressed by adding to the original velocity $V_o$ each successive increment of the product of the acceleration and time during each time period of T=1 millisecond, each successive increment of constant velocity and each successive increment of the product of the deceleration and time during each time period T. Preferably, the acceleration and deceleration values are each stored in the form of an amount corresponding to a predetermined number of counts per millisecond square which are a function of the actual acceleration or deceleration value, as the case may be, and of the scale factor hereinafter discussed in connection with measuring the actual angular displacement of the motor drive shaft 122; whereby the computer 500 may timely calculate the desired angular displacement of the motor drive shaft 122 during any sampling time interval T. In this connection it is noted that the summation of all such counts is representative of the desired linear displacement of the circumference of the drum 38, and thus of the desired velocity versus time profile of drum rotation for timely accelerating the drum 38 to the target velocity V1, maintaining the drum velocity at V1 for feeding the particular mailpiece 16 and timely decelerating the drum 38 to rest.

According to the invention, independently of programming the computer 500 for providing for printing the indicia a predetermined marginal distance from the leading edge of each mailpiece 16, it is desirable that the operator of the mailing machine 12 (FIG. 2) be provided with the means for controlling the marginal distance. To that end, the keyboard 53 is provided with margin control keys **53*c* and 53*d*, which are respectively labeled "M.Incr." and "M.Decr." The keys 53*c* and 53*d* are conventionally coupled to the computer 500 for providing a signal to the computer 500 with each depression of the respective keys 53*c* and 53*d*. Preferably, each signal is representative of a predetermined increment of increase or decrease in the aforesaid predetermined marginal distance that the indicia printing portion 73*b* of the drum 38 is to be spaced from the leading edge of the mailpiece 16 upon engagement with the mailpiece 16. Thus, depression of the M.Incr. key 53*c* provides a signal representative of an increment of increase, whereas depression of the M.decr. key 53*d* provides a signal representative of an increment of decrease, in the predetermined marginal distance, that the indicia will be spaced from the leading edge of the mailpiece 16 when printed. Accordingly, operator control is provided for changing the predetermined location of the indicia to a location which is closer to, or farther from, the leading edge of respective mailpieces, depending upon which of the keys 53*c* or 53*d* and the number of times each key 53*c* or 53*d* is depressed by the operator. For implementation purposes, the computer 500 is preferably programmed to provide an up count representative of each depression of the M.Incr. key 53*c*, and to provide a down count representative of each depression of the M.Decr. key 53*d*. The resulting summation "n" of the up and down counts is then multiplied by an amount representative of a predetermined increment of distance "$d_i$" to obtain a total desired distance change of $d_{in}$. As shown in FIG. 3**(*b*) assuming the time delay $t_d$ before commencing drum rotation is incrementally decreased, the entire drum cycle time period Tct will be advanced by an incremental time interval of $t_i$. Since the velocity V1 of the mailpiece 16 is unchanged, the mailpiece 16 will arrive at point D at the same time. However, the drum 38 will have commenced rotation earlier, with the result that the indicia printing portion **73*b* of the drum 38 will be marginally spaced a lesser distance, i.e., the product of $t_i$ and the calculated target velocity of V1, from the leading edge of the mailpiece 16, when it engages the mailpiece 16 than it would have been had the time delay $t_d$ not been incrementally decreased. Correspondingly, as shown in FIG. 3**(*c*) incrementally increasing the time delay $t_d$ by a time interval of $t_i$ causes the drum cycle time period Tct to be incrementally delayed and the drum 38 to commence rotation later; resulting in the indicia printing portion **73*b* being marginally spaced a greater distance from the mailpiece's leading edge, when it engages the mailpiece 16, than it would have been had the time delay $t_d$ not been incrementally increased. As shown in FIG. 3**(*a*) the time period $t_{bd}$ for a given mailpiece 16 to traverse the distance from point B to point D may be calculated for any mailpiece 16 by dividing the calculated target velocity V1 by the sum of the distances $d_2$ and $2xd_3$. Accordingly, for margin control purposes the print delay time period $t_{pd}$ [FIGS. **3*b* and 3**(*c*)] may be calculated for any given mailpiece 16 from the expression $t_{pd}=t_{bd}-T_a-(\pm t_i)$; wherein $t_i=d_{in}/V1$, V1=the calculated target velocity of the mailpiece 16 and $d_{in}$ is the summation n of the up and down count multiplied by a predetermined increment of distance $d_i$ which is fetched as needed from the memory of computer 500. Thus the computer 500 may be conventionally programmed to change the marginal spacing that the indicia printing portion **73*b* of the drum 38 initially engages a given mailpiece 16, to change the location of the indicia, when printed, from a reference edge of the mailpiece 16. The operator input signals are conventionally processed by the computer 500 for changing the marginal spacing of indicia printing, from the predetermined distance fixed by adjusting the fetched value of $t_d$ for a given calculated mailpiece velocity V1, to a changed distance determined by the calculated value of $t_{pd}$, which, as hereinbefore discussed, is a function of the summation n of the up and down counts generated in response to the operator's successive depressions of the respective M.Incr. and M.decr. keys 53***c* and 53*d*. Preferably, the count summation n as altered by the operator from time to time during any given operating time interval of the mailing machine 12, i.e., from the time of depression of the start key 53*a* to time of subsequent depression of the stop key 53*b*, is stored in an available buffer of the computer 500 for fetching as needed during the operating time interval. Further, the count summation n is preferably erased from the available buffer at the end of the operating time interval, i.e., when the stop key 53*b* is depressed. Accordingly, at the commencement of any given operating time interval, i.e., when the start key 53*a* is depressed, and until one of the keys 53*c* or 53*d* is depressed, the marginal distance of the indicia will be spaced from the leading edge of any mailpiece 16, when printed, will be the fixed distance for which various velocity dependent values of $t_d$, are stored in the computer 500 and are fetched as needed in response to changes in mailpiece velocity V1. Thereafter, with each depression of the respective keys 53*c* or 53*d*, the marginal distance will be changed to the distance determined by calculating the value of $t_{pd}$ until the stop key 53*d* is depressed to end the operating time interval.

The postage meter 10 (FIG. 1) additionally includes a conventional, rotatably mounted, shaft 74 on which the drum 38 is fixedly mounted, and a conventional drive gear 76, which is fixedly attached to the shaft 74 for rotation of the shaft 74.

Further, the mailing machine 12 (FIG. 1) includes an idler shaft 80 which is conventionally journaled to the casing 19 for rotation, and, operably coupled to the shaft 80, a conventional home position encoder 82. The encoder 82 includes a conventional circularly-shaped disc 84, which is fixedly attached to the shaft 80 for rotation therewith, and an optical sensing device 86, which is operably coupled to the disc 84 for detecting an opening 88 formed therein and, upon such detection, signalling the computer 500. The machine 12, also includes an idler gear 90 which is fixedly attached to the shaft 80 for rotation therewith. Further, the machine 12 includes a D.C. motor 120, which is suitably attached to the casing 19 and has a drive shaft 122. The machine 12 also includes a pinion gear 124, which is fixedly attached to the drive shaft 122 for rotation by the shaft 122. The gear 124 is disposed in driving engagement with the idler gear 90. Accordingly, rotation of the motor drive shaft 122 in a given direction, results in the same direction of rotation of the drum drive shaft 76 and thus the drum 38. Preferably, the pinion gear 124 has one-fifth the number of teeth as the drum drive gear 76, whereas the idler gear 90 and drum drive gear 76 each have the same number of teeth. With this arrangement, five complete revolutions of the motor drive shaft 122 effectuate one complete revolution of the drum 38, whereas each revolution of the gear 90 results in one revolution of the gear 76. Since there is a one-to-one relationship between revolutions, and thus incremental angular displacements, of the drum shaft 74 and idler shaft 90, the encoder disc 84 may be mounted on the idler shaft 90 such that the disc's opening 88 is aligned with the sensing device 86 when the drum 38 is disposed in its home position to provide for detection of the home position of the drum shaft 74, and thus a position of the drum shaft 74 from which incremental angular displacements may be counted.

Figure 2:
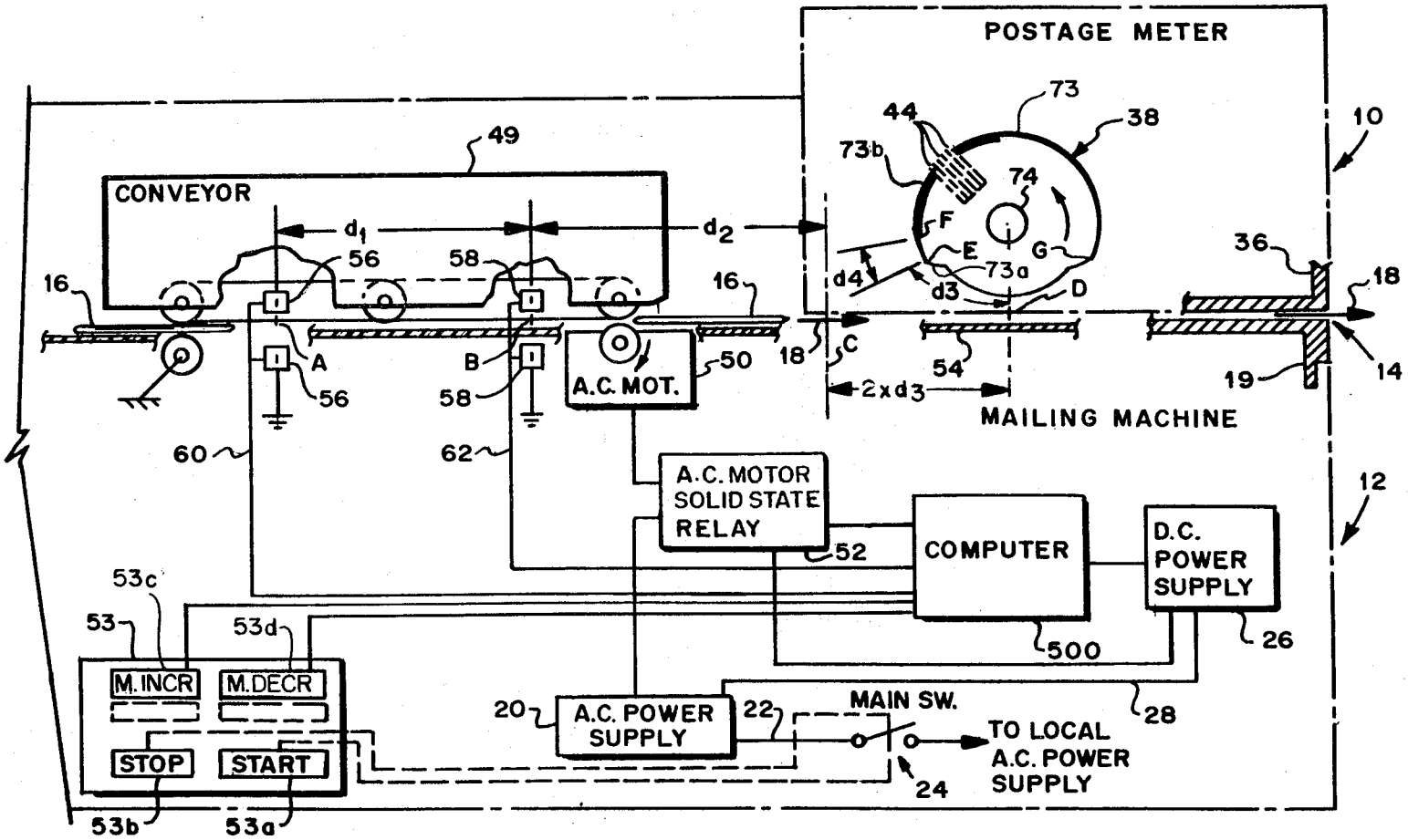
FIG. 2 is a schematic view of the mailing machine of FIG. 1, showing the operator control keys for changing the marginal spacing of indicia printing.
Figure 3:
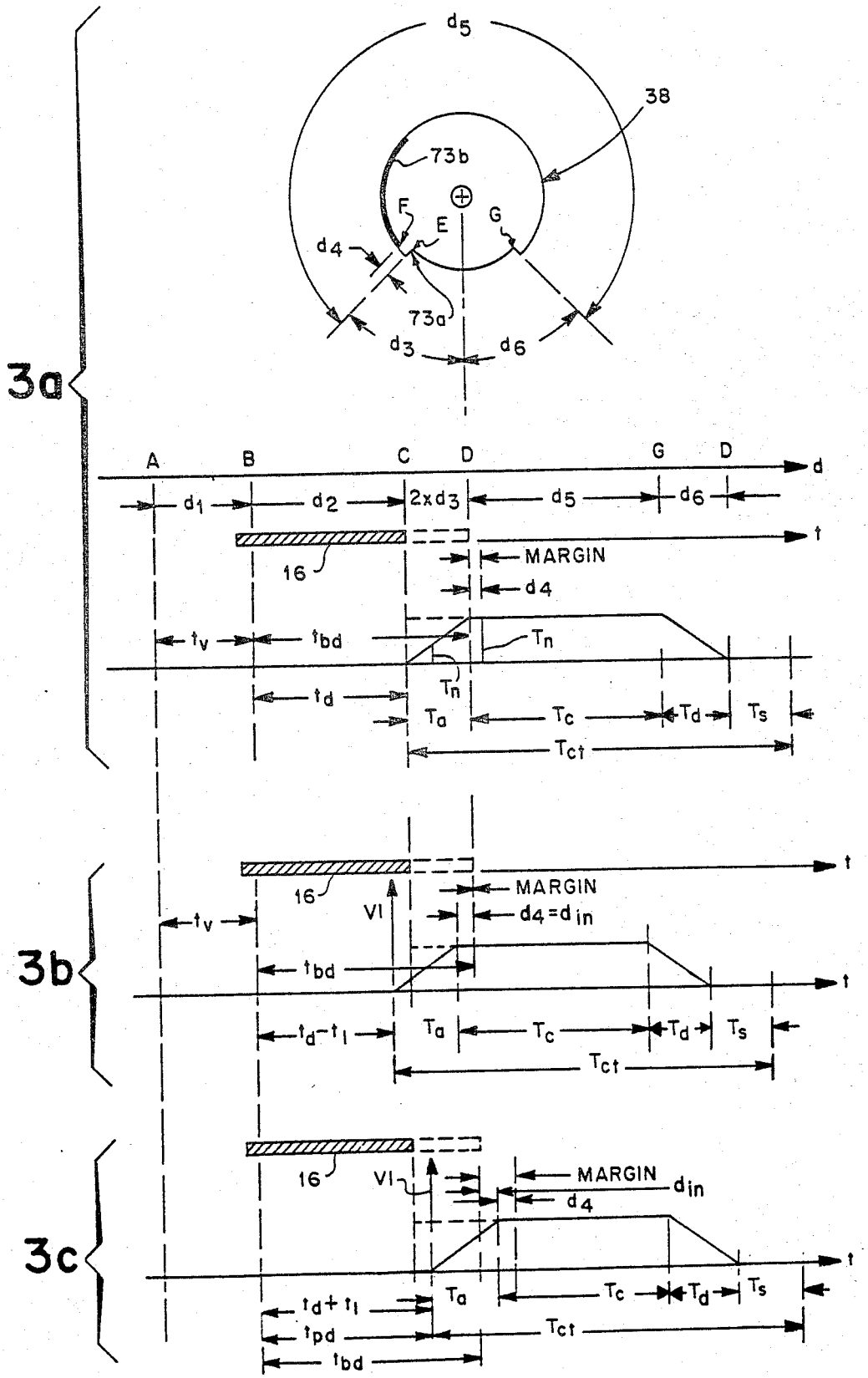
FIG. 3 shows the relationship between the position of a sheet and the periphery of the postage meter drum as a function of time, and an ideal velocity versus time profile of the periphery of the drum.
Figure 4:
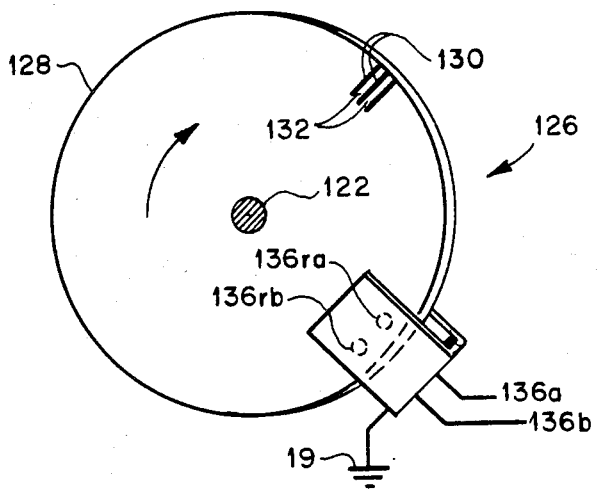
FIG. 4 is a perspective view of the quadrature encoder mounted on a D.C. motor drive shaft.
Figure 5:
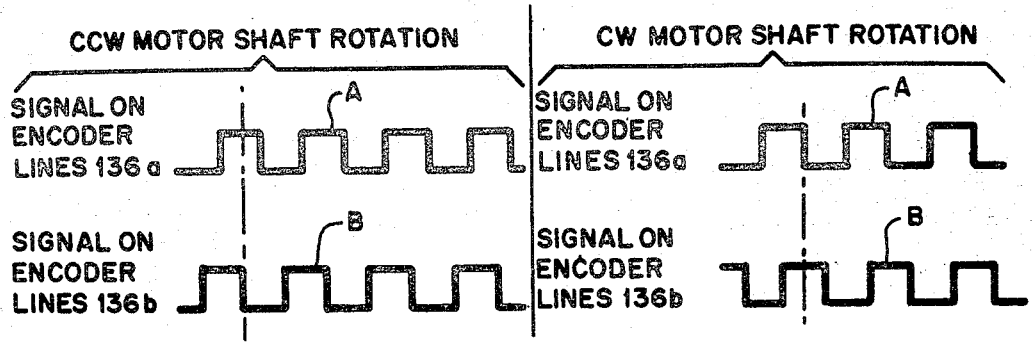
FIG. 5 shows the output signals from the quadrature encoder of FIG. 4 for clockwise and counter-clockwise rotation of the D.C. motor drive shaft.

For sensing actual incremental angular displacements of the motor drive shaft 122 (FIG. 1) from a home position, and thus incremental angular displacements of the drum 38 from its rest or home position as shown in FIG. 2, there is provided a quadrature encoder 126 (FIG. 1). The encoder 126 is preferably coupled to the motor drive shaft 122, rather than to the drum shaft 74, for providing higher mechanical stiffness between the armature of the d.c. motor 120 and the encoder 126 to avoid torsional resonance effects in the system. The encoder 126 includes a circularly-shaped disc 128, which is fixedly attached to the motor drive shaft 122 for operably connecting the encoder 126 to the motor 120. The disc 128 (FIG. 4) which is otherwise transparent to light, has a plurality of opaque lines 130 which are formed on the disc 128 at predetermined, equidistantly angularly-spaced, intervals along at least one of the disc's opposed major surfaces. Preferably the disc 128 includes one hundred and ninety-two lines 130 separated by a like number of transparent spaces 132. In addition, the encoder 126 includes an optical sensing device 134, which is conventionally attached to the casing 19 and disposed in operating relationship with respect to the disc 128, for serially detecting the presence of the respective opaque lines 130 as they successively pass two reference positions, for example, positions 136*ra* and 136*rb*, and for responding to such detection by providing two output signals, one on each of communications lines 136*a* and 136*b*, such as signal A (FIG. 5) on line 136*a* and signal B on line 136*b*. Since the disc 128 (FIG. 4) includes 192 lines 130 and the gear ratio of the drum drive gear 76 (FIG. 1) to the motor pinion gear 124 is five-to-one, nine hundred and sixty signals A and B (FIG. 5) are provided on each of the communications lines 136*a* and 136*b* during five revolutions of the motor drive shaft 122, and thus, during each cycle of rotation of the drum 38. Since the angular distance between successive lines 130 (FIG. 4) is a constant, the time interval between successive leading edges (FIG. 5) of each signal A and B is inversely proportional to the actual velocity of rotation of the motor drive shaft (FIG. 1) and thus of the drum 38. The encoder 126 is conventionally constructed and arranged such that the respective reference positions 136*a* and 136*b* (FIG. 4) are located with respect to the spacing between line 130 to provide signals A and B (FIG. 5) which are 90 electrical degrees out of phase. Accordingly, if signal A lags signal B by 90° (FIG. 5) the D.C. motor shaft 122 (FIG. 1), and thus the drum 38, is rotating clockwise, whereas if signal A leads signal B by 90° (FIG. 5) the shaft 122 and drum 38 are both rotating counter-clockwise. Accordingly, the angular displacement in either direction of rotation of the drum 38 (FIG. 1) from its home position may be incrementally counted by counting the number of pulses A or B, (FIG. 5) as the case may be, and accounting for the lagging or leading relationship of pulse A (FIG. 5) with respect to pulse B.

The quadrature encoder communication lines, 136*a* and 136*b* (FIG. 1), may be connected either directly to the computer 500 for pulse counting thereby or to the computer 500 via a conventional counting circuit 270

Figure 6:
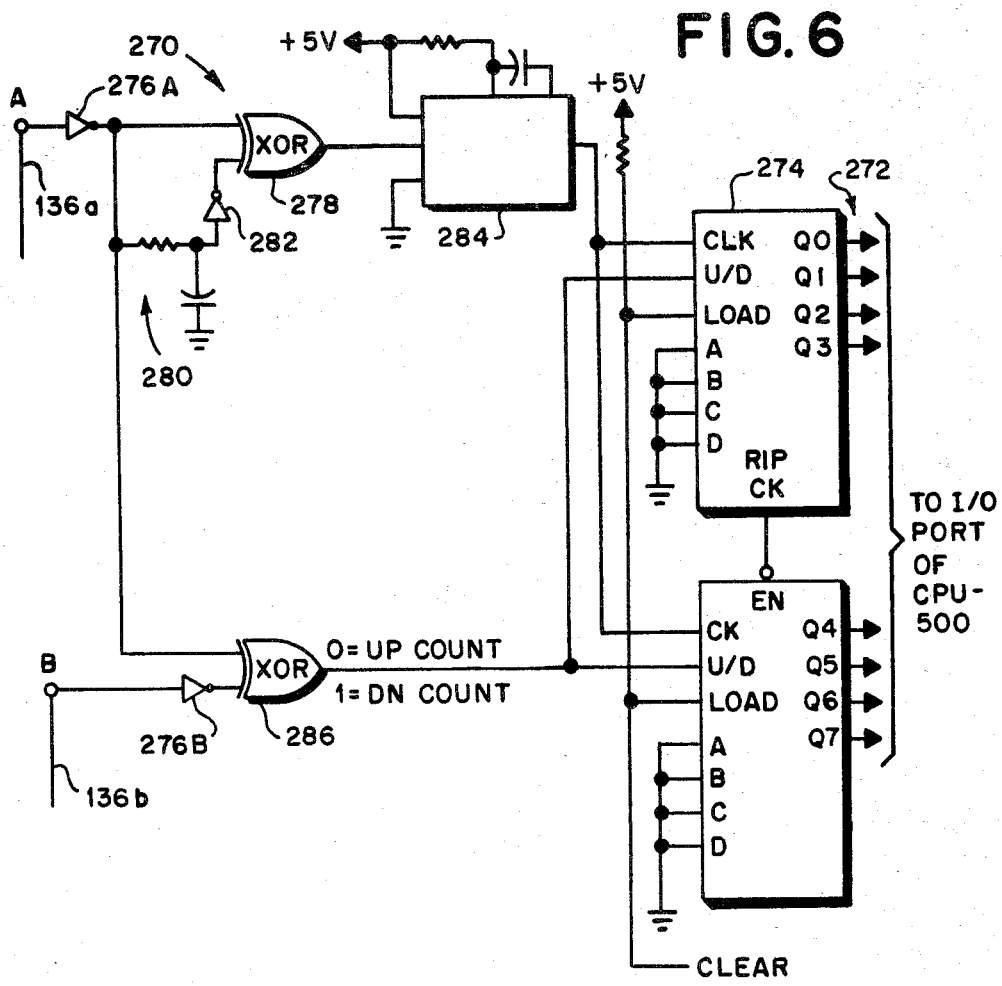
FIG. 6 is a schematic diagram of a preferred counting circuit for providing an eight bit wide digital signal for the computer which numerically represents the direction of rotation, and angular displacement, of the motor drive shaft, and thus the drum, from its home position.

(FIG. 6), depending on whether or not the internal counting circuitry of the computer 500 is or is not available for such counting purposes in consideration of other design demands of the system in which the computer 500 is being used. Assuming connection to the computer 500 via a counting circuit 270, the aforesaid communications lines, 136*a* and 136*b* are preferably connected via terminals A and B, to the counting circuit 270.

In general, the counting circuit 270 (FIG. 6) utilizes the pulses A (FIG. 5) to generate a clock signal and apply the same to a conventional binary counter 274 (FIG. 6), and to generate an up or down count depending on the lagging or leading relationship of pulse A (FIG. 5) relative to pulse B and apply the up or down count to the binary counter 274 (FIG. 6) for counting thereby. More particularly, the pulses A and B (FIG. 5) which are applied to the counting circuit terminals A and B (FIG. 6) are respectively fed to Schmidt trigger inverters 276A and 276B. The output from the inverter 276A is fed directly to one input of an XOR gate 278 and additionally via an R-C delay circuit 280 and an inverter 282 to the other input of the XOR gate 278. The output pulses from the XOR gate 278, which acts as a pulse frequency doubler, are fed to a conventional one-shot multivibrator 284 which detects the trailing edge of each pulse from the XOR gate 278 and outputs a clock pulse to the clock input CK of the binary counter 274 for each detected trailing edge. The outputs from the Schmidt trigger inverters 276A and 276B are respectively fed to a second XOR gate 286 which outputs a low logic level signal (zero), or up-count, to the up-down pins U/D of the binary counter 274 for each output pulse A (FIG. 5) which lags an output pulse B by 90 electrical degrees. On the other hand the XOR gate 286 (FIG. 6) outputs a high logic level (one) or down-count, to the up-down input pins of the binary counter 274 for each encoder output pulse A (FIG. 5) which leads an output pulse B by 90° electrical degrees. Accordingly, the XOR gate 286 (FIG. 6) provides an output signal for each increment of angular displacement of the encoded shaft 122 (FIG. 1) and identifies the direction, i.e., clockwise or counter-clockwise, of rotation of the encoded shaft 122. The binary counter 274 (FIG. 6) counts the up and down count signals from the XOR gate 286 whenever any clock signal is received from the multivibrator 284, and updates the binary output signal 272 to reflect the count.

Accordingly, the counting circuit 270 converts the digital signals A and B, which are representative of incremental angular displacements of the drive shaft 122 in either direction of rotation thereof, to an eight bit wide digital logic output signal 272 which corresponds to a summation count at any given time, of such displacements, multiplied by a factor of two, for use by the computer 500. Since the angular displacement of the shaft 122 from its home position is proportional to the angular displacement of the drum 38 from its home position, the output signal 272 is a count which is proportional to the actual linear displacement of the outermost periphery of the drum 38 at the end of a given time period of rotation of the drum 38 from its home position. For a typical postage meter drum 38, having a circumference, i.e., the arc described by the outermost periphery of the drum 38 in the course of revolution thereof, of 9.42 inches, which is connected to the motor drive shaft 122 via a mechanical transmission system having a 5:1 gear ratio between the motor 120 and drum 38, wherein the encoder disc 128 has 192 lines; the counting circuit 270 will provide an output of $2\times192=384$ counts per revolution of the shaft 122, and $5\times384=1920$ counts per revolution of the drum 38 which corresponds to 203.82 counts per inch of linear displacement of the periphery of the drum. Accordingly, the maximum mailpiece transport velocity of $V1=61(10^{-3})$ inches per millisecond may be multiplied by a scale factor of 203.82 counts per inch to express the maximum transport velocity in terms of counts per millisecond, or, counts per sampling time period T where T=1 millisecond; i.e., $61(10^{-3})$ inches per millisecond times 203.82 counts per inch=12.43 counts per sampling time period T. Similarly, any other target velocity V1, or any acceleration or deceleration value, may be expressed in terms of counts per sampling time interval T, or counts per square millisecond, as the case may be, by utilization of the aforesaid scale factor.

For energizing the D.C. motor 120 (FIG. 1) there is provided a power amplifying circuit 300. The power amplifying circuit 300 (FIG. 7) is conventionally operably connected to the motor terminals 302 and 304 via power lines 306 and 308 respectively. The power amplifying circuit 300 preferably comprises a conventional, H-type, push-pull, control signal amplifier 301 having input leads A, B, C and D, a plurality of optical-electrical isolator circuits 303 which are connected on a one-for-one basis between the leads A–D and four output terminals of the computer 500 for coupling the control signals from the computer 500 to the input leads A, B, C, and D of the amplifier 301, and a plurality of conventional pull-up resistors 305 for coupling the respective leads A–D to the 5 volt source. The amplifier 301 includes four conventional darlington-type, pre-amplifier drive circuits including NPN transistors T1, T2, T3 and T4, and four, conventional, darlington-type power amplifier circuits including PNP transistors Q1, Q2, Q3 and Q4 which are respectively coupled on a one-for-one basis to the collectors of transistors T1, T2, T3 and T4 for driving thereby. The optical-electrical isolator circuits 303 each include a light emitting diode D1 and a photo-responsive transistor T5. The cathodes of D1 are each connected to the 5 volt source, the emitters of T5 are each connected to ground and the collectors of T5 are each coupled, on a one-for-one basis, to the base of one of the transistors T1, T2, T3 and T4. With respect to each of the opto-isolator circuits 303, when a low logic level signal is applied to the anode of D1, D1 conducts and illuminates the base of T5 thereby driving T5 into its conductive state; whereas when a high logic level signal is applied to the anode of D1, D1 is non-conductive, as a result of which T5 is in its non-conductive state. With respect to each of the combined amplifier circuits, T1 and Q1, T2 and Q2, T3 and Q3, and T4 and Q4, when the lead A, B, C or D, as the case may be, is not connected to ground via the collector-emitter circuit of the associated opto-isolator circuit's transistor T5, the base of T1, T2, T3 or T4, as the case may be, draws current from the 5 volt source via the associated pull-up resistor 305 to drive the transistor T1, T2, T3 or T4, as the case may be, into its conductive state. As a result, the base of transistor Q1, Q2, Q3 or Q4, as the case may be, is clamped to ground via the emitter-collector circuit of its associated driver transistor T1, T2, T3 or T4, thereby driving the transistor Q1, Q2, Q3 or Q4, as the case may be, into its conductive state. Contrariwise, the transistor pairs T1 and Q1, T2 and Q2, T3 and Q3, and T4 and Q4 are respectively biased to cut-off when lead A, B, C or D, as the case may be, is connected to ground via the collector-emitter circuit of the associated opto-isolator circuit's transistor T5. As shown in the truth table (FIG. 8) for clockwise motor rotation, Q1 and Q4 are turned on and Q2 and Q3 are turned off; whereas for counter-clockwise motor rotation, Q2 and Q3 are turned on and Q1 and Q4 are turned off. Accordingly, for clockwise motor rotation: terminal 302 (FIG. 7) of the motor 120 is connected to the 30 volt source via the emitter-collector circuit of Q1, which occurs when Q2 is turned off and the base of Q1 is grounded through the emitter-collector circuit of T1 due to the base of T1 drawing current from the 5 volt source in the presence of a high logic level control signal at input terminal A; and terminal 304 of the motor 120 is connected to ground via the emitter-collector circuit of Q4, which occurs when Q3 is turned off and the base of Q4 is grounded through the emitter-collector circuit of T4 due to the base of T4 drawing current from the 5 volt source in the presence of a high logic level signal at the input terminal D. On the other hand, for counter clockwise rotation of the motor 120: terminal 302 of the motor 120 is connected to ground via the emitter-collector circuit of Q2, which occurs when Q1 is turned off and the base of Q2 is grounded through the emitter-collector circuit of T2 due to the base of T2 drawing current from the 5 volt source in the presence of a high logic level control signal at the input terminal B; and terminal 304 of the motor 120 is connected to the 30 volt source via the emitter-collector circuit of Q3, which occurs when Q4 is turned off and the base of Q3 is grounded through the emitter-collector of T3 due to the base of T3 drawing current from the 5 volt source in the presence of a high logic level control signal at the input terminal C. For turning off the respective powers transistors Q1–Q4, on a two at a time basis, low level control signals are applied on a selective basis to the two terminals B and C, or A and D, as the case may be, to which high logic control level signals are not being applied; which occurs when the opto-isolator circuit's transistors T5 associated with the respective leads B and C or A and D are driven to their conductive states. When this occurs the bases of the transistors T2 and T3, or T1 and T4, as the case may be, are biased to open the emittercollectors circuits of the transistors T2 and T3, or T1 and T4, as the case may be, as a result of which the bases of the transistors Q2 and Q3, or Q1 and Q4, as the case may be, are biased to open the emitter-collector circuits of transistors Q2 and Q3, or Q1 and Q4, as the case may be.

The velocity of the motor 120 (FIG. 7) is controlled by modulating the pulse width and thus the duty cycle of the high logic level, constant frequency, control signals, i.e., pulse width modulated (PWM) signals, which are timely applied on a selective basis to two of the leads A–D, while applying the low level logic signals to those of leads A–D which are not selected. For example, assuming PWM signals (FIG. 9) having a 50% duty cycle are applied to leads A and D (FIG. 7), and low level logic signals are applied to leads B and C, for clockwise rotation of the motor 120, the velocity of the motor 120 will be greater than it would be if high logic level PWM signals (FIG. 9) having a 25% duty cycle were similarly applied and will be less than it would be if high logic level PWM signals having a 75% duty cycle were similarly applied. Accordingly, assuming rotation of the motor 120 (FIG. 7) is commenced by utilizing high logic level PWM signals having a given duty cycle percentage, the velocity of the motor 120 may be decreased or increased, as the case may be, by respectively decreasing or increasing the duty cycle percentage of the applied high logic level PWM signals. Further, assuming the motor 120 is rotating clockwise due to PWM signals having a selected positive average value being applied to leads A and D, in combination with low level logic signals being applied to leads B and C, the motor 120 may be dynamically braked by temporarily applying high level PWM signals having a selected duty cycle corresponding to a given positive average value to leads B and C, in combination with low logic signals being applied to leads A and D. To avoid damage to the power transistors Q1, Q2, Q3 and Q4 which might otherwise result, for example, due to current spikes accompanying back emf surges which occur in the course of switching the circuit 301 from one mode of operation to the other, the emitter-collector circuits of the power transistors Q1, Q2, Q3 and Q4 are respectively shunted to the 30 volt source by appropriately poled diodes, D1, D2, D3 and D4 connected across the emitter-collector circuits of Q1, Q2, Q3 and Q4.

To control the motion of the drum 38 (FIG. 1) during each cycle of drum rotation, the D.C. motor 120 and its shaft encoder 126 are respectively connected to the computer 500 via the power amplifier circuit 300 and the counting circuit 270. And the computer 500 is programmed to calculate the duration of and timely apply PWM control signals to the power amplifier circuit 300 after each sampling time instant Tn, utilizing an algorithm based upon a digital compensator D(s) derived from analysis of the motor 120, motor load 38, 74, 76, 90 and 124 amplifying circuit 300, encoder 126, counting circuit 270, and the digital compensator D(s) in the closed-loop, sampled-data, servo-control system shown in FIG. 10.

Figure 10:
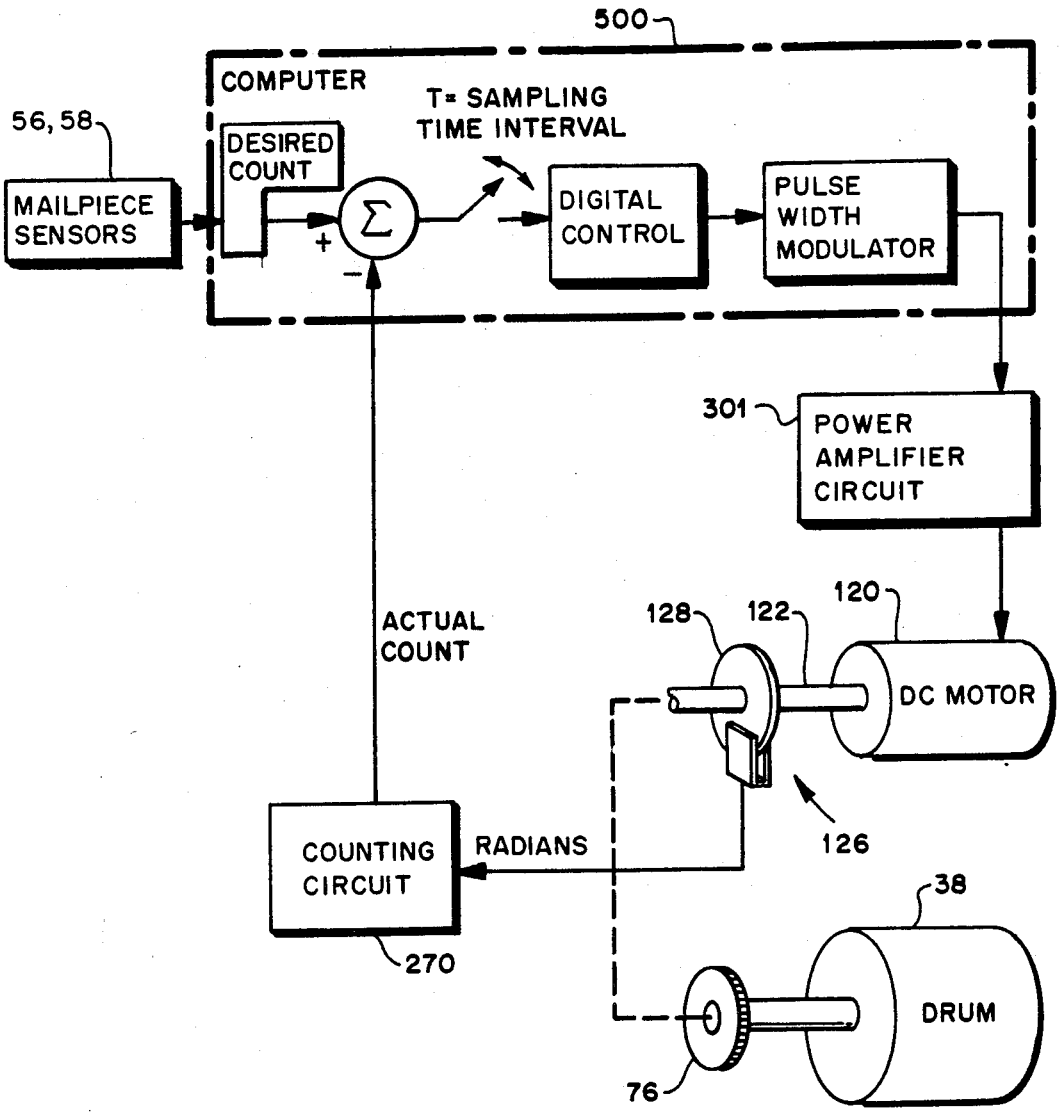
FIG. 10 shows a closed-loop servo system including the D.C. motor and computer.

With reference to FIG. 10, in general, at the end of each predetermined sampling time period of T=1 millisecond, the eight bit wide count representing the angular displacement of the motor drive shaft 122, and thus the drum 38, from its home position is sampled by the computer 500 at the time instant Tn. Under the control of the program of the computer 500 (FIG. 10), a summation is taken of the aforesaid actual count and the previously calculated count representing the desired position of the motor drive shaft 122, and thus the drum 38, at the end of the time period T, and, under control of the computer program implementation of the algorithm, a PWM control signal which is a function of the summation of the respective counts, or error, is applied to the power amplifier circuit 301 for rotating the motor drive shaft 122 such that the error tends to become zero at the end of the next sampling time period T.

Figure 11:
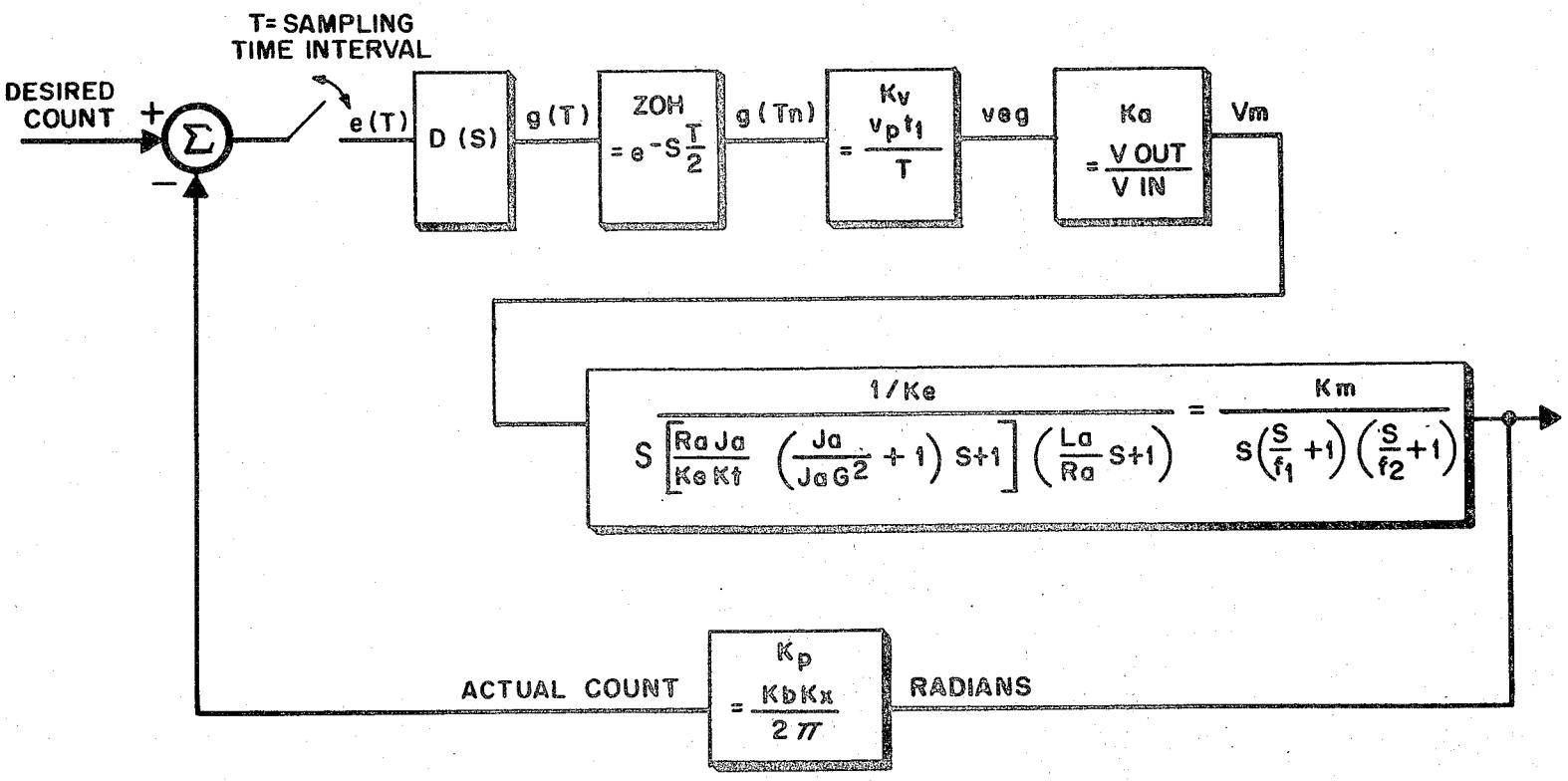
FIG. 11 is a block diagram portraying the Laplace transform equations of the closed-loop servo system shown in FIG. 10.

To derive the algorithm, the servo-controlled system of FIG. 10 is preferably analyzed in consideration of its equivalent Laplace transformation equations shown in FIG. 11, which are expressed in terms of the following Table of Parameters and Table of Assumptions.

TABLE I

| Parameters | | |
|---|---|---|
| Parameter | Symbol | Value and/or Dimension |
| Zero-Order-Hold | ZOH | None |
| Laplace Operator | S | jw |
| Sampling Interval | T | Milliseconds |
| PWM D.C. Gain | $K_v$ | Volts |
| PWM Pulse Amplitude | $V_p$ | 5 Volts |

TABLE I-continued

| Parameter | Symbol | Value and/or Dimension |
|---|---|---|
| PWM Pulse Width | $t_1$ | $10^{-6}$ Micro-seconds |
| Power Switching Circuit Gain | $K_a$ | None |
| Motor back e.m.f. Constant | $K_e$ | 0.63 Volts/ radian/second |
| Motor Armature Resistance | $R_a$ | 1.65 Ohms |
| Motor Armature Moment of Inertia | $J_a$ | 2.12 ($10^{-5}$) Kilograms (meters $^2$) |
| Motor Torque Constant | $K_t$ | 0.063 Newton-Meters/amp |
| Drum Moment of Inertia | $J_1$ | 70.63 ($10^{-5}$) Kilograms (meters) |
| Gear Ratio, Motor to Load | G | 5:1, None |
| Motor Armature Inductance | $L_a$ | 2.76 Millihenrys |
| Motor Shaft Encoder Gain | $K_p$ | Counts/radian |
| Motor Shaft Encoder Constant | $K_b$ | 192 Lines/ revolution |
| Counting Circuit Multiplier | $K_x$ | 2, None |
| Motor Gain | $K_m$ | 16, None |
| Poles in frequency domain | $f_1;f_2$ | 48;733 Radians/ second |
| Starting Torque Gain | $K_c$ | None |
| System Overall Gain | $K_o$ | None |

TABLE II—ASSUMPTIONS

ZOH: Since the output and input are held constant during each sampling period a zero-order-hold is assumed to approximate the analog time function being sampled.

Veq.: Since the integral of the voltage in time is assumed equal to the area under the PWM pulse, the output from the PWM is linear.

With reference to FIG. 10, D(S) is the unknown transfer function of an open loop compensator in the frequency domain. Due to a key factor for providing acceptably fast motor response being the system's resonance between the motor and load, the derivation of the transfer function D(S) for stabilization of the system is preferably considered with a view to maximizing the range of frequencies within which the system will be responsive, i.e., maximizing the system's bandwidth, BW. For calculation purposes a sampling period of T=1 millisecond was chosen, due to having chosen a Model 8051 microprocessor, available from Intel Corporation, Palo Alto, Calif., for control purposes, and inasmuch as the Model 8051 microprocessor equipped with a 12 MHz crystal for providing a clock rate of 12 MHz, is able to conveniently implement a 1 KHz sampling rate and also implement application software routines, after control algorithm interations, during the sampling period of T=1 millisecond. However, other sampling periods and other conventional microprocessors may be utilized without departing from the spirit and scope of the invention.

The open loop system gain $H_1(S)$ without compensation, of the servo-loop system of FIG. 10 is shown in FIG. 12(*a*). To tolerate inaccuracies in the transmission system between the motor and drum load, such as backlash, it was considered acceptable to maintain a steady-state count accuracy of plus or minus one count. To reflect this standard, the gain equation of FIG. 12(*a*) was adjusted to provide a corrective torque $C_t$ with a motor shaft movement, in radians per count, equivalent to the inverse expressed in radians per count, of the gain $K_p$ of the encoder counting circuit transform. Since the corrective torque $C_t$ is primarily the friction of the transmission system which has to be overcome by the motor at start-up, the value of $C_t$ may be assumed to be substantially equal to a maximum estimated numerical value based on actual measurements of the starting friction of the system, i.e., 35 ounce-inches, as a result of which a numerical value of the starting voltage $V_s$ may be calculated from the expression $V_s=(C_t)R_a/K_t$, i.e., $V_s=6.5$ volts, which, in turn, permits calculation of a numerical value for the minimum overall system gain $K_o$, at start-up, from the equation $K_o=V_s/K_p$, i.e., $K_o=397$ volts per radian, or for simplication purposes, 400 volts/radian. Accordingly, the open-loop uncompensated gain $H_1(S)$ may be rewritten as $H_2(S)$ as shown in FIG. 12(*b*), in which a gain factor of $K_c$ has been included, to account for the torque $C_t$ and the value of $K_o$ is substituted for the overall D.C. gain, i.e., $(K_v)(K_m)(K_p)(K_a)(K_c)=K_o$. Although the numerical value of $K_c$ may also be calculated, it is premature to do so, since it has not as yet been established that $K_o$, which has been adjusted by the value of $K_c$ to provide a minimum value of $K_o$, is acceptable for system stability and performance purposes. Otherwise stated, $K_o$ may not be the overall system gain which is needed for system compensation for maximizing the system bandwidth BW, as a result of which it is premature to conclude that $K_c$ will be equivalent to the D.C. gain of the system compensator D(S).

At this juncture, the Bode diagram shown in FIG. 13, may be constructed due to having calculated a minimum value for $K_o$. As shown in FIG. 13, the absolute value of $H_2(S)$, in decibels, has been plotted against the frequency W in radians per second, based on the calculated minimum value of $K_o$, the selected value of T and calculated values of the poles $f_1$ and $f_2$. From the Bode diagram, a numerical value of the crossover frequency $W_{c1}$ of the Bode plot of $H_2(S)$ may be determined, i.e., $W_{c1}$ was found to be substantially 135 radians per second. And, since the value of $W_{c1}$ is substantially equal to the bandwidth $BW_u$ of the uncompensated open-loop system $H_2(S)$, a calculation may be made of the phase margin $\theta_m$ of the uncompensated system from the expression $\phi_m=180°-\theta[H(S)]$ at $W_{c1}$, or, otherwise stated: $\phi_m=180°-\tan^{-1}(pi/2)-\tan^{-1}(W_{c1}/f_1)-\tan^{-1}(W_{c1}/f_2)-\tan^{-1}(W_{c1}T/2)$. From this calculation, there was obtained a phase margin value which was much, much, less (i.e., 5°) than 45°, which, for the purposes of the calculations was taken to be a minimum desirable value for the phase margin $\phi_m$ in a position-type servo system. Accordingly, it was found that the uncompensated system $H_2(S)$ was unstable if not compensated. Since an increase in phase lead results in an increase in bandwidth BW, and the design criteria calls for maximizing the bandwidth BW and increasing the phase margin to at least 45°; phase lead compensation was utilized.

By definition, a phase lead compensator D(S) has the Laplace transform shown in FIG. 14, wherein $K_c$ is the phase lead D.C. gain, and $f_z$ and $f_p$ are respectively a zero frequency and a pole frequency. Adding the transfer function of the phase lead compensator D(S) to the Bode plot of the uncompensated system's transfer function $H_2(S)$, results in the Bode plot of the compensated system transfer function $H_3(S)$, if the zero frequency fz of the phase lead compensator D(S) is chosen to be equivalent to $f_1$ in order to cancel the lag due to the mechanical time constant of the uncompensated transfer function $H_2S$. As shown in FIG. 13, the cross-over frequency $W_{c2}$ for the compensated system $H_3(S)$ may be read from the Bode diagram, i.e., $W_{c2}$ was found to be substantially equal to 400 radians per second. And, since by definition the crossover frequency $W_{c2}$ lies at the geometric mean of $f_p$ and $f_z$, the value of the $f_p$ may be established by doubling from $f_z$ linear distance between $W_{c2}$ and $f_z$, as measured along the logarithmic frequency axis, w, and reading the value of $f_p$ from the Bode diagram, i.e., $f_p$ was found to be substantially equal to 3,400 radians per second. Since numerical values may thus be assigned to both $W_{c2}$ and $f_p$ from the Bode diagram, the compensated phase margin $\phi_{mc}$, i.e., the phase margin for the phase lead compensated system $H_3(S)$ in which $f_z$ has been equated to $f_1$, may be found from the expression $\phi_{mc}=180°-90°-\tan^{-1}(W_{c2}/f_2)-\tan^{-1}(W_{c2}T/2)$. Upon calculating the compensated phase margin $\phi_{mc}$ it was found to be 50° and, therefore, greater than the minimum phase margin criteria of 45°. In addition, the value of $W_{c2}$ for the compensated system $H_3(S)$ was found to be substantially three times that of the uncompensated system $H_2(S)$, as a result of which the bandwidth BW of the system H(S) was increased by a factor of substantially three to $BW_c$.

At this juncture, the compensated system $H_3(S)$ is preferably analyzed with reference to the system's overshoot $O_s$ and settling time $t_s$ based on a calculation of the system damping factor $d_f$ and the assumption that the system will settle in five times constants, i.e., $t_s=5t_x$. The relevant values may be calculated or estimated, as the case may be, from the expressions, for $d_f$, $o_s$, $t_x$ and $t_s$ shown in FIG. 15. In connection with this analysis, reference is also made to the typical mailing machines hereinbefore described, wherein a maximum drum cycle time period $T_{ct}$ (FIG. 3) of 234 milliseconds and a maximum mailpiece transport speed (FIG. 2) of 61 inches per second are typical values. Assuming the velocity profile of FIG. 3, and, as previously discussed an acceleration time period of $T_a=37$ milliseconds, a constant velocity time period of $T_c=124$ milliseconds and deceleration time period of $T_d=24$ milliseconds, the longest permissible settling time for the system was calculated, i.e., $T_{ct}-(T_a+T_c+T_d)=234-185=49$ milliseconds. For analysis purposes a series of calculations of the aforesaid system characteristics and phase margin were performed, assuming incremental increases in the overall system gain $K_o$, while holding $f_z=f_1$. The results of such calculations are shown in the following Table III.

TABLE III

| | $H_3(S)$ with $f_z=f_1$ | | | |
|---|---|---|---|---|
| $K_o$ = system gain | $W_c$ = BW (rad./sec.) | $\Theta_m$ = phase Margin (deg.) | $O_s$ = overshoot (percent) | $t_s$ = settling time (MS.) |
| 400 | 400 | 50 | 28 | 28.67 |
| 447 | 450 | 46 | 31 | 27.78 |
| 501 | 500 | 42 | 34 | 27.50 |
| 562 | 550 | 38 | 38 | 27.41 |

As shown in Table III, the system bandwidth BW may be maximized at 450 radians per second while maintaining a phase margin $\phi_m$ of at least 45° the two design criteria discussed above. Although this results in an increase in system overshoot $O_s$ accompanied by a negligible decrease in the settling time $t_s$, the settling time $t_s$ is well within the maximum allowable settling time, $T_s=49$ milliseconds. On the other hand, if a bandwidth of 400 radians per second is acceptable, it is desirable to reduce the percentage of overshoot $O_s$, and increase the phase margin to $\theta_{mc}=50$ to provide for greater system stability than would be available with a phase margin value (i.e., 46°) which is substantially equal to the design criteria minimum of 45°; in which instance it is preferable to choose the bandwidth of BW=400 radians per second, overshoot of $O_s=28\%$ and compensated phase margin of $\theta_{mc}=50°$. For the example given, a compensated Bandwidth of $BW_c=400$ radians per second is acceptable inasmuch as worst case load conditions were assumed. In this connection it is noted that the foregoing analysis is based on controlling a postage meter drum, which has a high moment of inertia, contributes high system friction, and calls for a cyclical start-stop mode of operation during which the load follows a predetermined displacement versus time trajectory to accommodate the maximum mailpiece transport speed in a typical mailing machine. Accordingly, the compensated system bandwidth $BW_c=400$ radians per second may be chosen, as a result of which the overall system gain $K_o$ may be fixed at $K_o=400$, and the value of $K_c$ may be calculated from the expression $K_c=K_o/(K_v)(K_a)(K_p)$. Since $f_z=f_1$, and $f_1$ and $f_p$ are also known, the Bode plot of the compensator D(S), FIG. 14, may be added to the Bode diagram (FIG. 13) wherein the system compensator D(S) is shown as a dashed line.

Since the analog compensator D(S) was derived in the frequency domain, D(S) was converted to its Z-transform equivalent D(Z) in the sampled data domain for realization in the form of a numerical algorithm for implementation by a computer. Of the numerous well-known techniques for transforming a function in the frequency domain to a function in the sampled-data domain, the bi-linear transformation may be chosen. For bi-linear transformation purposes the Laplace operator S is defined by the expression shown in FIG. 16. Using the values $K_c=13.64$, $f_z=f_1=48$, and $f_p=3{,}400$ in the expression for D(S) shown in FIG. 14, and substituting the bilinear transformation expression for S shown in FIG. 16 and the sampling interval T=1 millisecond, in the expression shown in FIG. 14 results in the expression for D(Z) shown in FIG. 17. As shown in FIG. 11, D(T)=output/input=g(T)/e(T), which, in the sampled data domain is expressed by the equation D(Z)=G(Z)/E(Z). Accordingly, the expression for D(Z) shown in FIG. 17 may be rewritten as shown in FIG. 18*a*. Cross-multiplying the equivalency of FIG. 18*a* results in the expression shown in FIG. 18*b*, which defines the output G(Z) in the sampled data domain of the system compensator D(S). Taking the inverse Z-transform of the expression shown in FIG. 18*b*, results in the expression shown in FIG. 19 which defines the output $G(T_n)$ in the time domain of the system compensator D(S), and is a numerical expression of the algorithm to be implemented by the computer for system compensation purposes. As shown by the expression in FIG. 19 and in the following Table IV the output of the digital compensator for any current sampling instant $T_n$ is a function of the position error at the then current sampling time instant $T_n$, is a function of the position error at the end of the next previous sampling time instant $T_{n-1}$ and is a function of the algorithm output at the end of the next previous sampling time instant $T_{n-1}$.

TABLE IV

| Function | Definition |
|---|---|
| $G(T_n)$ | Algorithm output for current sampling time instant $T_n$ |

TABLE IV-continued

| Function | Definition |
|---|---|
| $E(T_n)$ | Position error for current sampling time instant $T_n$ |
| $G(T_{n-1})$ | Algorithm output for next previous sampling time instant $T_{n-1}$ |
| $E(T_{n-t})$ | Position error for next previous sampling time instant $T_{n-1}$ |
| $K_1$, $K_2$ & $K_3$ | Constants of the compensated system which are a function of the parameters of the motor load and system friction for a sampling time period of T = 1 millisecond. |

Accordingly, the algorithm which is to be implemented by the computer 500 for system compensation purposes is a function of a plurality of historical increments of sampled data for computing an input value for controlling a load to follow a predetermined position trajectory in a closed loop sampled-data servo-control system.

Figure 20:
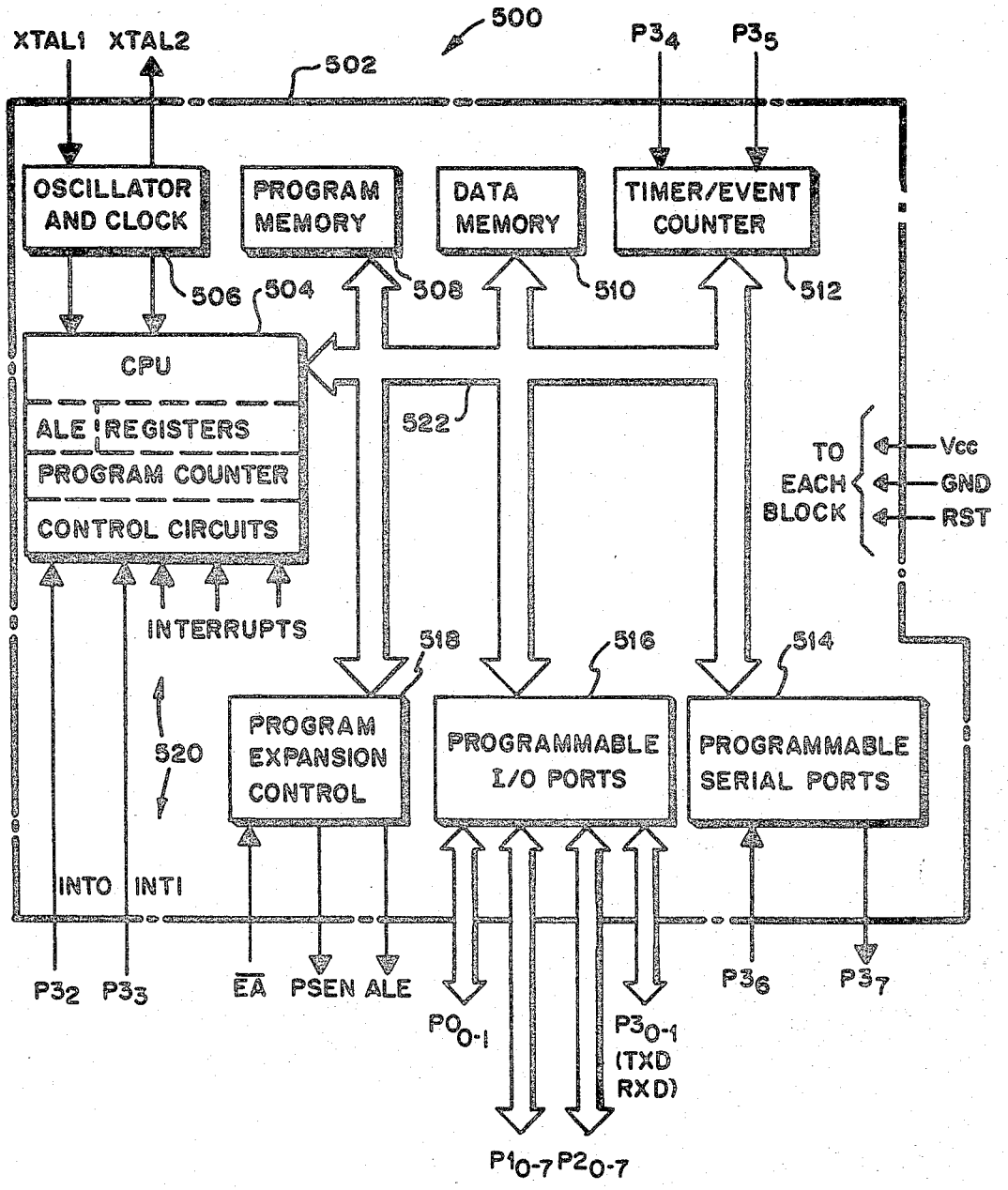
FIG. 20 is a block diagram of a preferred microprocessor for use in controlling the D.C. Motor.

As shown in FIG. 20 the computer 500 preferably includes a conventional, inexpensively commercially available, high speed microprocessor 502, such as the Model 8051 single chip microprocessor commercially available from Intel Corporation, 3065 Bowers Avenue, Santa Clara, Calif. 95051. The microprocessor 502, generally comprises a plurality of discrete circuits, including those of a control processor unit or CPU 504, an oscillator and clock 506, a program memory 508, a data memory 510, timer and event counters 512, programmable serial ports 514, programmable I/O ports 516 and control circuits 518, which are respectively constructed and arranged by well known means for executing instructions from the program memory 508 that pertain to internal data, data from the clock 506, data memory 510, timer and event counter 512, serial ports 514, I/O ports 514 interrupts 520 and/or bus 522 and providing appropriate outputs from the clock 506, serial ports 514, I/O ports 516 and timer 512. A more detailed discussion of the internal structural and functional characteristics and features of the Model 8051 microprocessor, including optional methods of programming port 3 for use as a conventional bidirectional port, may be found in the Intel Corporation publication entitled MCS-51 Family of Single Chip Microcomputers Users Manual, dated January 1981.

For implementing the sampling time period of T=1 millisecond, one of the microprocessor's timer and event counters 512 (FIG. 20) is conventionally programmed as a sampling time period clock source. To that end, a timer 512 is programmed for providing an interrupt signal each 250 microseconds, and each successive fourth interrupt signal is utilized as a clock signal for timing the commencement of successive sampling time periods of T=1 millisecond.

Figure 21:
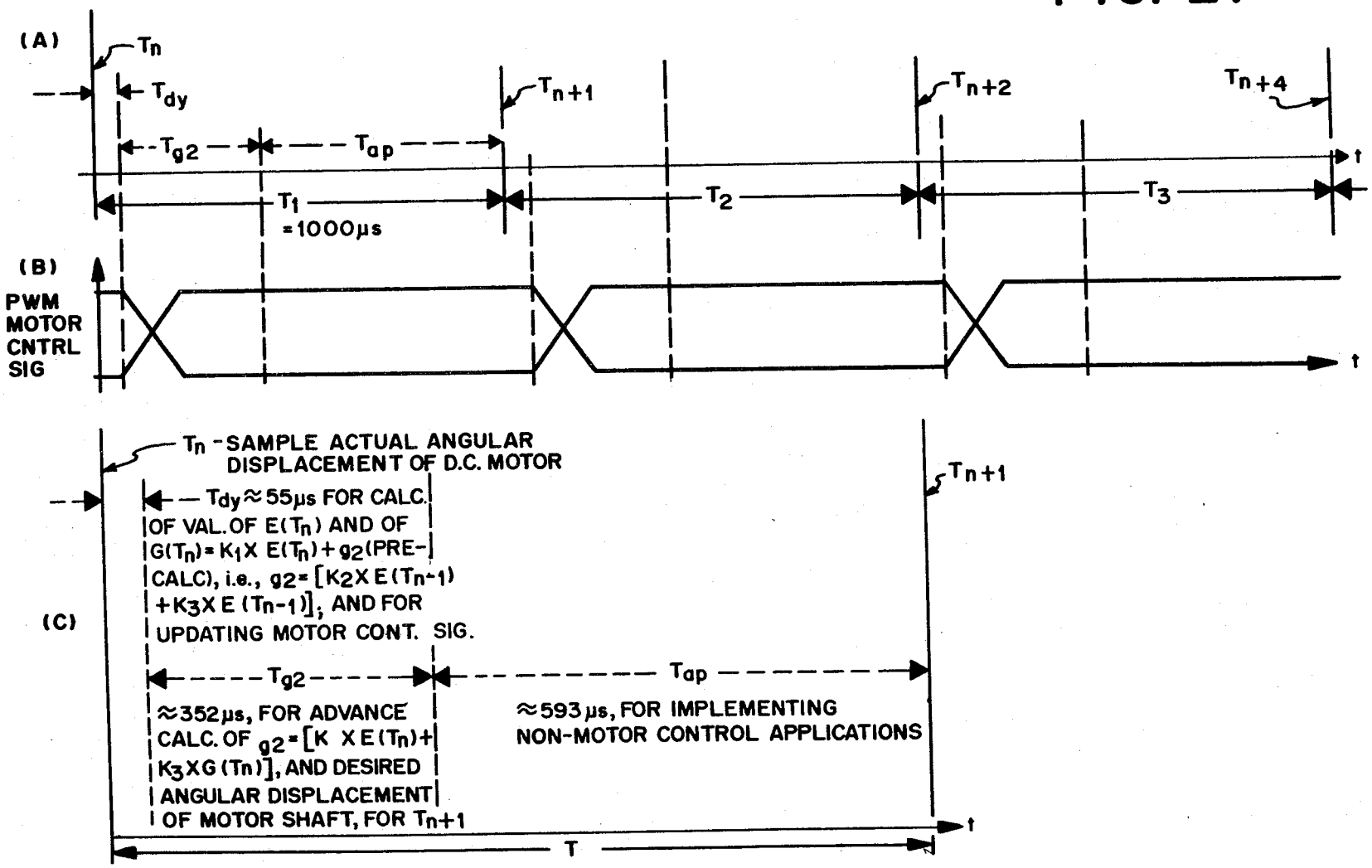
FIG. 21 (including FIGS. 21*a*, 21*b* and 21*c*) shows the time intervals during which the motor control signal and its separable components are calculated to permit early application of the signal to the motor.

In general, as shown in FIG. 21, at the commencement of each sampling time period of T=1 millisecond, during the sampling instant $T_n$, a sample is taken of the count representative of the actual angular displacement of the motor drive shaft and, substantially immediately thereafter, the actual count is summed with the count representative of the desired angular displacement of the motor drive shaft which was calculated during the next preceding time period T in order to obtain the then current error value $E(T_n)$ for calculating the then current compensation algorithm output value $G(T_n)$. Due to the recursive mathematical expression for $G(T_n)$ [FIG. 19] being a function of the then current error value $E(T_n)$, the next previous error value $E(T_{n-1})$ and the next previous compensation algorithm output value $G(T_{n-1})$, the expression for $G(T_n)$ is preferably separated into two components for calculation purposes, i.e., $G(T_n)=g_1+g_2$; wherein $g_1=K_1\times E(T_n)$, and wherein $g_2=-[K_2\times E(T_{n-1})+K_3\times G(T_{n-1})]$, to permit calculation of the value of $g_2$ in advance of the time period T when it is to be added to the value of $g_1$ for calculating the value of $G(T_n)$, thereby reducing to a negligible value (in view of the time period T) the time delay $T_{dy}$ before completion of sampling the actual displacement of the motor drive shaft at the instant $T_n$ and applying the PWM motor control signal to the output ports of the microprocessor. For example, when calculating the value of $G(T_n)$ based upon the first error value resulting from the summation of the counts representing the desired and actual angular displacements of the motor drive shaft, the value of $g_2$ is by definition equal to zero since the error signal $E(T_{n-1})$ is equal to zero, due to the desired and actual angular displacement values during the next previous sampling time period T having been equal to each other. Accordingly, upon obtaining the value of the first error signal $E_1(T_n)$, the value of $G_1(T_n)$ may be calculated as being equivalent to $g_1$, i.e., $G_1(T_n)=g_1=K_1\times E_1(T_n)$. And, upon calculating $G_1(T_n)$ the value of $g_2$ for use in calculating the next successive compensation algorithm output value $G(T_{n+1})$ may be calculated for subsequent use, since $g_2(T_{n+1})=-[K_2\times E_1(T_n)+K_3\times G_1(T_n)]$, and $K_2$, $K_3$, $E_1(T_n)$ and $G_1(T_n)$ are all known values. In addition, during any given time period T, a calculation may be made of the desired angular displacement of the motor drive shaft for the next subsequent time period T. Preferably, the microprocessor is programmed for implementation of the aforesaid calculation process to facilitate early utilization of the compensation algorithm output value $G(T_n)$ for driving the D.C. motor. Accordingly, the microprocessor is preferably programmed for: during the first sampling time period $T_1$, sampling the count representative of the actual angular displacement of the motor drive shaft at the time instant $T_n$, then taking the summation of that count and the previously calculated value of the desired angular displacement of the motor drive shaft to obtain the first error value $E_1(T_n)$, then calculating the first compensation algorithm output value $G_1(T_n)=K_1\times E_1(T_n)+g_2$, wherein $g_2=0$, and generating a PWM motor control signal representative of $G_1(T_n)$, then calculating the value of $g_2$ for the next sampling time period, i.e., $g_2=-[K_2\times E_1(T_n)+K_3\times G_1(T_n)]$, and then calculating the count representing the desired angular displacement of the motor drive shaft for use during the next sampling time period $T_2$; during the second sampling time period $T_2$, sampling the count representative of the actual angular displacement of the drive shaft and taking the summation of that count and the previously calculated desired count to obtain the error value $E_2(T_{n+1})$, calculating the compensation algorithm output value $G_2(T_{n+1})=K_1\times E_2(T_{n+1})+g_2=K_1\times E_2(T_{n+1})-K_2\times E_1(T_n)-K_3\times G_1(T_n)$, and generating a PWM motor control signal representative thereof, then calculating the value of $g_2$ for the next sampling time period $T_3$, i.e., $g_2-[K_2\times E_2(T_{n+1})+K_3\times G_2(T_{n+1})]$, and then calculating the count representative of the desired angular displacement of the motor drive shaft for use during the time period $T_3$; and so on, during each successive sampling time period.

Accordingly, as shown in FIG. 21, the microprocessor is programmed for immediately after calculating the then current compensation algorithm output value $G(T_n)$, and thus while the calculation of the value of $g_2$ for the next sampling time period is in progress, generating a motor control signal for energizing the power amplifier. For this purpose, the relative voltage levels of motor control signal are determined by the sign, i.e., plus or minus, of the compensation algorithm output value $G(T_n)$, and the duty cycle of the control signal is determined by the absolute value of the compensation algorithm output value $G(T_n)$. Preferably, for timing the duration of the motor control signal, the other timer and event counter 512, i.e. the timer 512 which was not used as a sampling time period clock source, is utilized for timing the duration of the duty cycle of the motor control signal. For example, by loading the absolute value of the $G(T_n)$ into the other timer 512, commencing the count, and timely invoking an interrupt for terminating the duty cycle of the control signal. As shown in FIG. 21(*c*), the time delay $T_{dy}$ from commencement of the time period T to updating the PWM motor control signal at the output ports of the microprocessor is substantially 55 microseconds, and the time interval allocated for calculating the value of $g_2$ and the ocunt representative of the desired angular displacement of the motor drive shaft for use during the next time period is substantially 352 microseconds. As a result, substantially 593 microseconds of microprocessor calculation time is available during any given sampling time period T=1 millisecond for implementing non-motor control applications.

Figures 7, 22B:
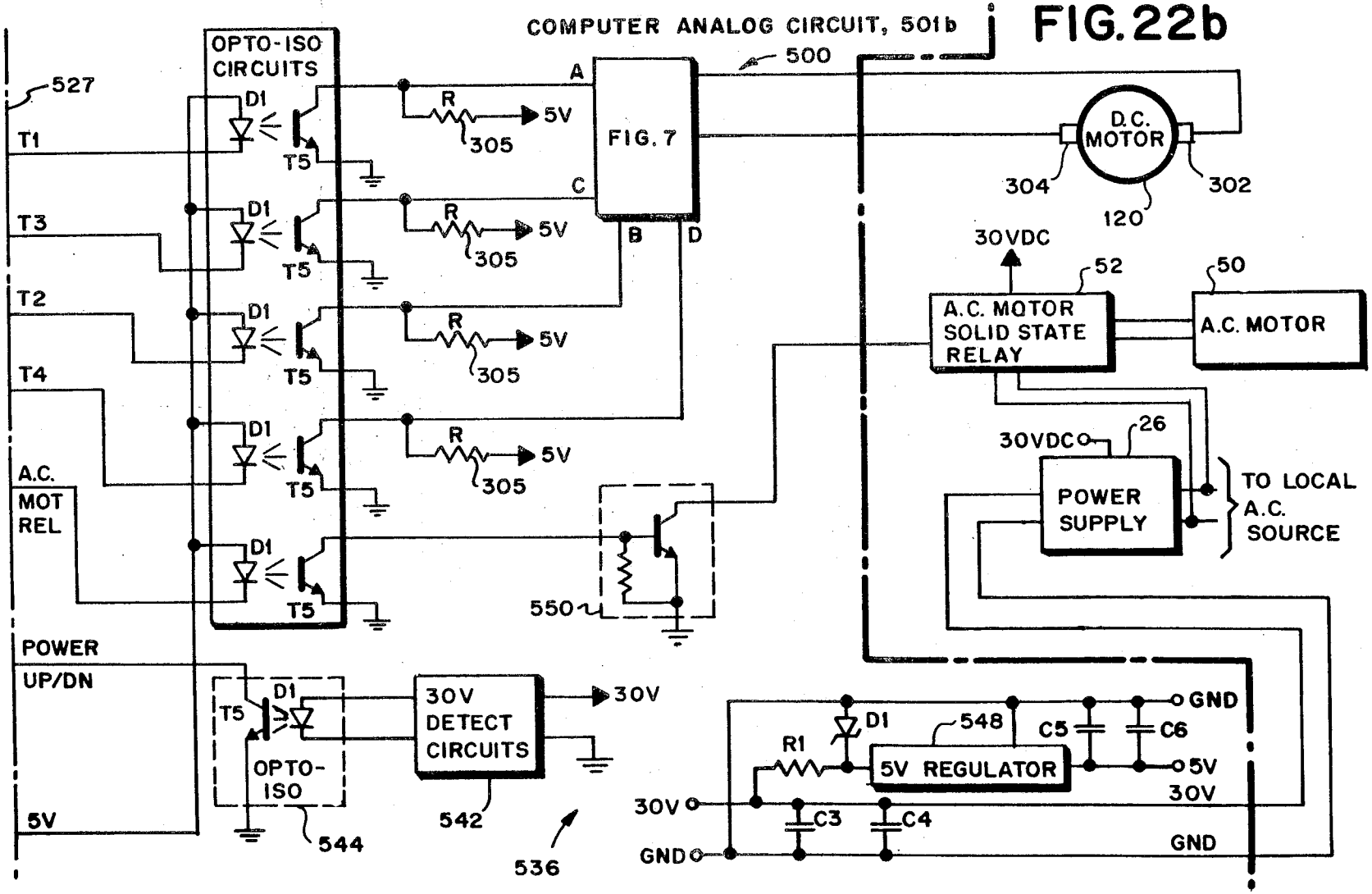

As shown in FIG. 22 the computer 500 is preferably modularly constructed for segregating the components of the logic circuit 501*a* and analog circuit 501*b* of the computer 500 from each other. To that end, the respective circuits 501*a* and 501*b* may be mounted on separate printed circuit boards which are electrically isolated from each other and adapted to be interconnected by means of connectors located along the respective dot-dash lines 516, 527 and 528. In any event, the components of the logic circuit 521*a* and analog circuit 521*b* are preferably electrically isolated from each other. To that end, the logic circuit 501*a* preferably includes 5 V and ground leads from the mailing machine's power supply for providing the logic circuit 501*a* with a local 5 volt source 530 having 5 V and GND leads shunted by filter capacitors C1 and C2. And the analog circuit 501*b* includes 30 volt and ground return leads from the mailing machine's power supply for providing the analog circuit 501*b* with a local 30 volt source 536 including 30 V and GND leads shunted by filter capacitors C3 and C4. In addition, the analog circuit 501*b* includes a conventional 30 volt detection circuit 542 having its input conventionally connected to the analog circuit's 30 volt source 536, and its output coupled to a power up/down lead from the analog circuit via a conventional optical-electrical isolator circuit 544. Further, to provide the analog circuit 501*b* with a local 5 volt source 546, the analog circuit 501*b* is equipped with a conventional regulated power supply having its input appropriately connected to the analog circuit's 30 volt source 536 via a series connected resistor R1 and a 5 volt, voltage regulator 548. A zener diode D1, having its cathode shunted to ground and having its anode connected to the input of the 5 V regulator 548 and also connected via the resistor R1 to the 30 volt terminal line, is provided for maintaining the input to the 5 V regulator 548 at substantially a 5 volt level. In addition, a pair of capacitors C5 and C6 are provided across the output of the regulator 548 for filtration purposes.

To accommodate interfacing the postage meter's computer 41 (FIG. 1) with the computer 500, any two available ports of the computer 41 may be programmed for two-way serial communications purposes and coupled to the computer 500. For example, the postage meter's printing module 41*c* may be conventionally modified to include an additional two-way serial communications channel for communication with the computer 500.

Assuming the latter arrangement, serial input communications to the computer 500 (FIG. 22) are received from the postage meter computer's printing module 41*c* via the serial input lead to the logic circuit 501*a* (FIG. 22), which is operably coupled to port $P3_0$ of the microprocessor 502 by means of a conventional inverting buffer circuit 550. Accordingly, port $P3_0$ is preferably programmed for serial input communications, and the input to the buffer circuit 550 is resistively coupled to the logic circuit's 5 volt source 530 via a conventional pull-up resistor R2. Serial output communications from the microprocessor 502 are transmitted from port $P3_1$. Accordingly, port $P3_1$ is preferably programmed for serial output communications, and is operably coupled to the input of a conventional inverting buffer 552, the output of which is resistively coupled to the logic circuit's 5 V source 530 via a suitable pull-up resistor R2 and is additionally electrically connected to the serial output lead from the logic circuit 501*a*.

Since it is preferable that the microprocessor 502 be reset in response to energization of the logic circuit 501*a*, the logic circuit's 5 V source 530 is connected in series with an R-C delay circuit and a conventional inverting buffer circuit 554 to the reset pin, RST, of the microprocessor 502. The R-C circuit includes a suitable resistor R3 which is connected in series with the logic circuit's local 5 V source 530 and a suitable capacitor C7 which has one end connected between the resistor R3 and the input to the buffer circuit 554, and the other end connected to thelogic circuit's ground return.

In addition to the VCC and GND (i.e., VSS) terminals of the microprocessor 502 being respectively conventionally connected to the logic circuit's 5 volt source and ground, since the microprocessor 502 does not utilize an external program memory, the $\overline{EA}$ terminal is connected to the logic circuit's 5 V source. And, since no other external memory is used, the program storage enable and address latch enable terminals, PSEN and ALE are not used. In addition to the $\overline{EA}$ terminal being available for future expansion, ports $P1_5$–$P1_7$, ports $P2_2$–$P2_7$, the read and write terminals, $\overline{RD}$ and $\overline{WR}$, and one of the interrupt terminals INTO/$P3_2$ are also available for future expansion.

In general, the microprocessor 502 is programmed for receiving input data from the postage meter drum's home position encoder 82, each of the M.Incr. and M.Decr. keys 53*c* and 53*d*, the envelope sensors 56, 58 and the D.C. motor shaft encoder 126, and, in response to a conventional communication from the postage meter's printing module 41*c*, timely energizing the D.C. motor under the control of the CPU of the microprocessor 502. Ports $P2_o$ and $P2_1$, respectively receive transition signals, via the lines M.Incr. and M.Decr. from the keys $53_c$ and $53_d$ to permit the microprocessor to generate a running up and down count summation of the total number of depressions of each of the keys $53_c$ and $53_d$. Port P0 is programmed for receiving a transition signal representative of the disposition of the postage meter's drum 38 at its home position; transition signals from the envelope sensors 56 and 58 which represent detection of the leading edge of a mailpiece or other sheet 16 being fed to the drum 38 to permit calculation by the computer 500 of the velocity of the mailpiece and thus the desired angular displacement of the D.C. motor shaft 122 and thus the drum 38; and a count representative of the actual angular displacement of the D.C. motor shaft 122. Preferably, port P0 is multiplexed to alternately receive inputs from groups of the various sensors, under the control of an output signal from Port $P3_4$ of the microprocessor 502. The shaft encoder 82 which is utilized for sensing the home position of the postage meter drum 38 is coupled to the computer 500 via the drum home position lead of the logic circuit, which, in turn, is connected to one input of a differential amplifier 562, the output of which is connected to the other input of the differential amplifier 562 via a feedback resistor R4. The aforesaid other input to the amplifier 562 is also resistively coupled, by means of a resistor R5, to the midpoint of a voltage divider circuit including resistors R6 and R7. Resistors R6 and R7 are connected in series with each other and across the logic circuit's 5 V source and ground return leads. The LED sensors 56 and 58, which are utilized for successively sensing the leading edges of each envelope being fed by the letter transport, are separately coupled to the computer 500 via the envelope sensor-1 and envelope sensor-2 input leads of the logic circuit 501*a*. In the logic circuit 501*a*, the envelope sensor-1 and sensor-2 leads are connected on a one-for-one basis to one of the inputs of a pair of conventional amplifiers 564, the other inputs of which are connected together and to the mid-point of a voltage divider including resistors R8 and R9. Resistors R8 and R9 are connected in series with each other and across the logic circuit's 5 V source and ground return leads. Further, the three output signals from the differential amplifier 562 and the two amplifiers 564 are connected on a one-for-one basis to the three input ports $P0_{0\text{-}2}$ of the microprocessor 502, each via a conventional tri-state buffer circuit 566, one of which is shown. The input signals A and B from the D.C. motor shaft encoder 126 are coupled to the logic circuit 501*a* by means of leads A and B, which are conventionally electrically connected to the counting circuit 270 to provide the microprocessor 502 the the count representative of the actual angular displacement of the motor shaft 122 from its home position. The counting circuit's leads Q0–Q7 are electrically connected on a one-for-one basis to Ports $P0_0$–$P0_7$ of the microcomputer 502 via one of eight conventional tri-state buffer circuits 568, one of which is shown, having their respectivecontrol input leads connected to each other and to the output of a conventional inverting buffer circuit 570, which has its input conventionally connected port $P3_4$ of the microprocessor 502. Thus, either the three input signals, i.e., from the drum home position and the two envelope position sensors are operably electrically coupled to Ports $P0_0$–$P0_2$ of the microprocessor 502, or the eight input Q0–Q7 from the counter circuit 270 are operably electrically coupled to ports $P0_0$–$P0_7$ of the microprocessor 502 for scanning purposes, in response to an appropriate control signal being applied to the respective buffer circuits 566 and 568 from port $P3_4$ of the microprocessor 502. In operation, assuming a low logic level signal is required for activating either of the sets of buffers 566 or 568; when the microprocessor 502 applies such a signal to port $P3_4$, the buffer circuits 566 operate, whereas since the buffer circuit 570 inverts this signal to a high logic level signal before applying the same to the buffer circuit 568, the latter is inoperative. Conversely, a high logic level signal from port $P3_4$ will operate buffer circuits 568 and not operate the buffer circuits 566. Accordingly, depending upon the level, high or low, of the signal from port $P3_4$ of the microprocessor 502, the eight bit input to one or the other buffer circuits 566 or 568 will be made available to port P0 for scanning purposes. Aside from the foregoing, to permit the microprocessor 502 to clear the counter 270 for any reason in the course of execution of the program, port $P3_5$ is connected to the clear pin CLR of the counter 270 via a conventional inverting buffer 572, and the microprocessor 502 is programmed for timely applying the appropriate signal to port $P3_5$ which, when inverted, causes the counting circuit 270 to be cleared.

Figure 7:
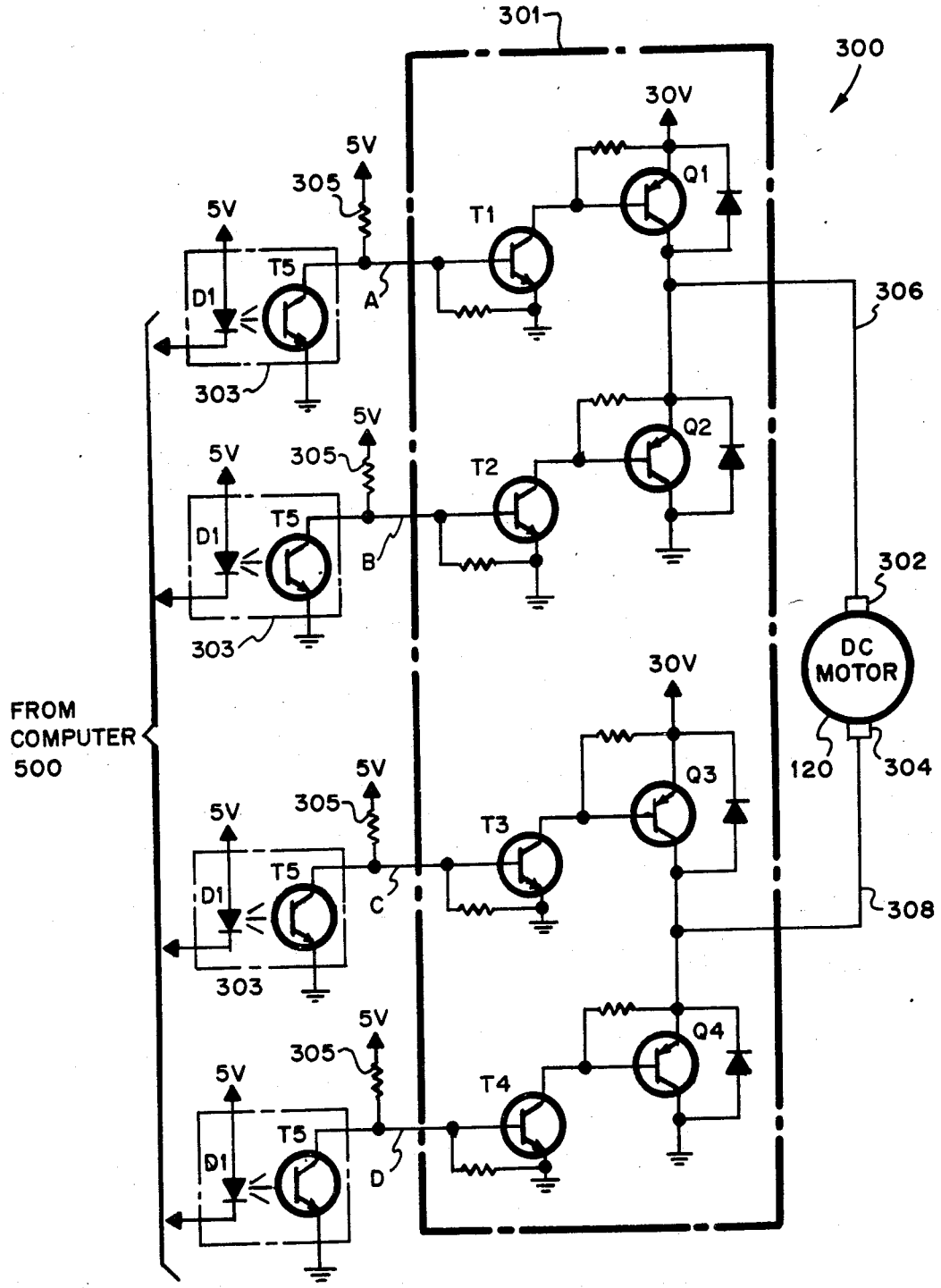
FIG. 7 shows a power amplifier circuit for coupling the computer to the D.C. motor.
Figures 8, 9:
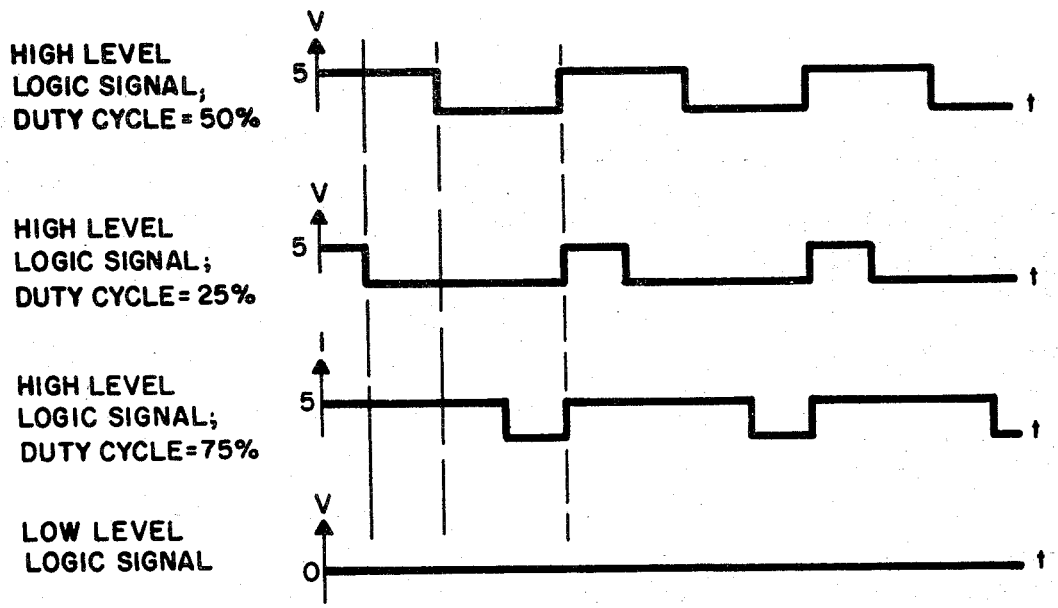
FIG. 8 is a truth table showing the status of the transistors in the power amplifying circuit for clockwise and counter-clockwise rotation of the D.C. motor.
FIG. 9 shows the relationship between the encoder output signals for various D.C. motor duty cycles.

In general, ports $P1_0$–$P1_3$ are utilized by the microprocessor 502 for providing pulse width modulated (PWM) motor control signals for controlling energization of the D.C. motor 120 and port $P1_4$ is utilized by the microprocessor 502 for controlling energization of the solid state, A.C. motor, relay 52 and thus operation of the mailpiece conveyor 49. To that end, ports $P1_0$–$P1_4$ of the microprocessor 502 are each conventionally electrically connected on a one-for-one basis to the input of a conventional inverting buffer circuit 580, one of which is shown. The outputs of each of the buffer circuits 580 are connected on a one-for-one basis, via a conventional resistor R10, to output leads from the logic circuit 501*b*, one of which is designated solid state, A.C. motor, relay, and four of which are respectively designated T1, T3, T2 and T4, since, as shown in FIG. 7, the four preamplifier stages of the power amplifier utilized for driving the D.C. motor 120 include the transistors T1–T4. Thus, the upper nibble of the signal from port P1 is utilized for controlling energization of the D.C motor and one bit of the lower nibble is utilized for controlling energization of the solid state, A.C. motor, relay 52 and thus the A.C. motor 50. In the analog circuit 501*b*, each of the leads Tl, T2, T3, T4 and solid state relay, from the logic circuit 501*a*, is electrically connected on a one-for-one basis to the anode of the light emitting diode D1 of five, conventional, phototransistor type, optical-electrical isolator circuits 303. Since the cathodes of the light emitting diodes D1 of the opto-isolator circuits 303 are connected to each other and to the 5 volt lead from the analog circuit 501*b* which extends to the 5 volt source of the logic circuit 501*a*, the motor control signals are isolated from the power system of the analog circuit 501*b* to avoid having spurious noise signals in the analog circuit 501*b* and its components interfere with the control signals generated by the microprocessor 502. The analog circuit 501*b* also includes a lead, designated power up/down, which extends from the analog circuit 501*b* to the logic circuit 501*a* and is connected to the microprocessor's interrupt INTI, port $P3_3$, to provide the microprocessor 502 with an appropriate input signal when the power is turned on, off or fails. In the analog circuit 501*b*, the power up/down lead from the logic circuit 501*a* is coupled to the thirty volt detect circuit 542 by means of a conventional optoisolator 544, the power up/down lead being electrically connected to ground through collector-emitter circuit of the opto-isolator's photo-transistor when the light emitting diode D1 is lit in response to the D.C. supply voltage level matching the internal reference voltage level, e.g., 30 volts, of the 30 volt detection circuit.

In the analog circuit 501*b* each of the outputs from the photo-transistors of each of the opto-isolators 303 are resistively coupled to the analog circuits 5 V source by means of a conventional pull-up resistor 305, and the emitters of the photo-transistors T5 are connected to the analog circuit's ground system. In addition, the collectors of the photodiodes of the opto-isolators 303, which are utilized for transmitting the motor control signals from ports $P1_0$–$P1_3$ of the microprocessor 502 are connected ona one-for-one basis to the appropriate input leads A. B, C and D of the power amplifiers shown in FIG. 7, the outputs of which are connected to the D.C. motor 120. Further, the collector of the photodiode of the opto-isolator 303 which is utilized for transmitting the A.C. relay control signals from port $P1_4$ of the microprocessor 502 is connected to the input lead of a conventional darlington-type power amplifier 550, the output of which is conventionally connected to the mailing machine's 30 volt D.C. source via a solid state, A.C. motor, relay 52, which is in turn conventionally connected for energizing the A.C. motor 50 from the local A.C. source.

Figures 1, 23A:
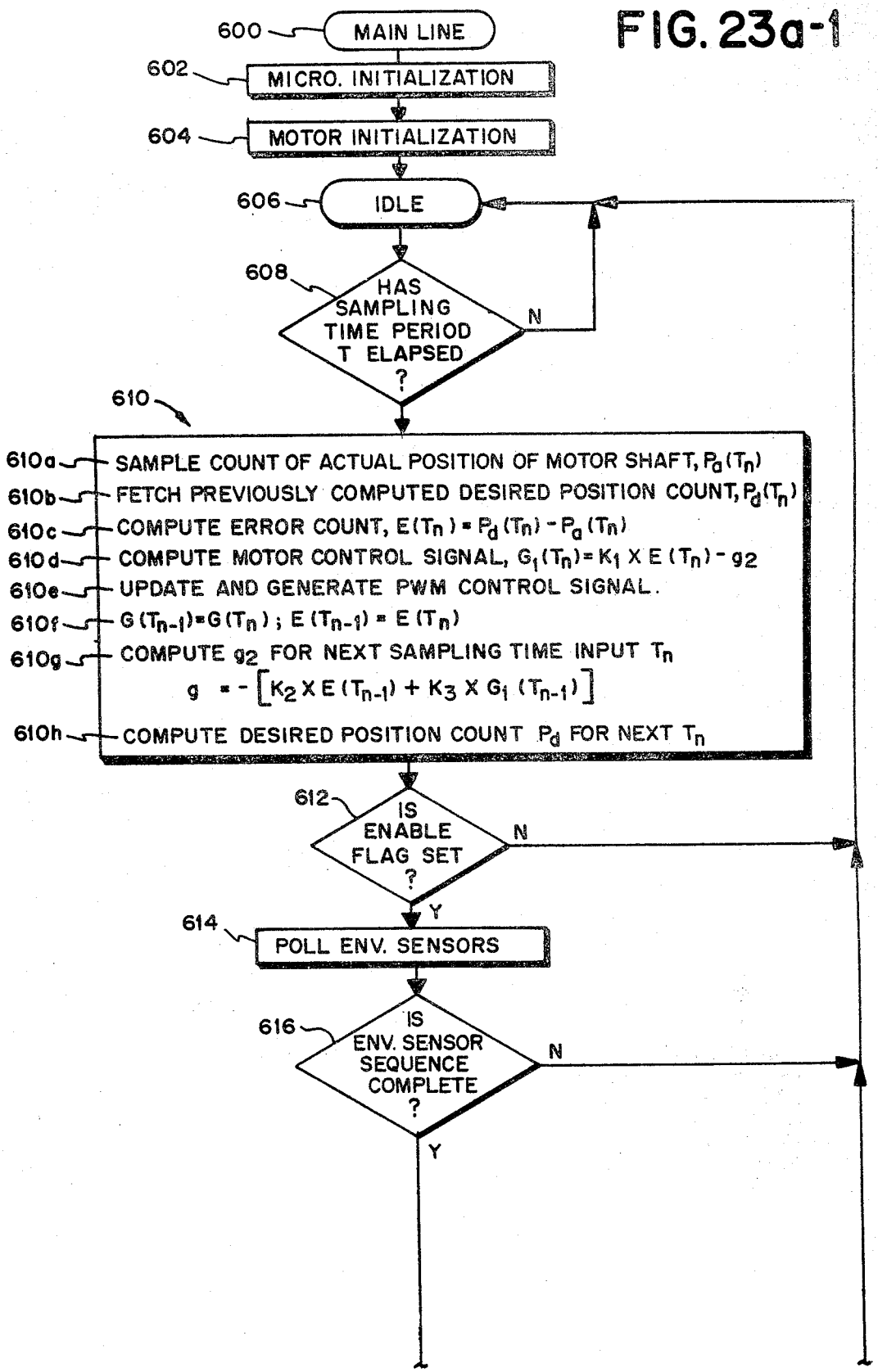
Figures 2, 23A:
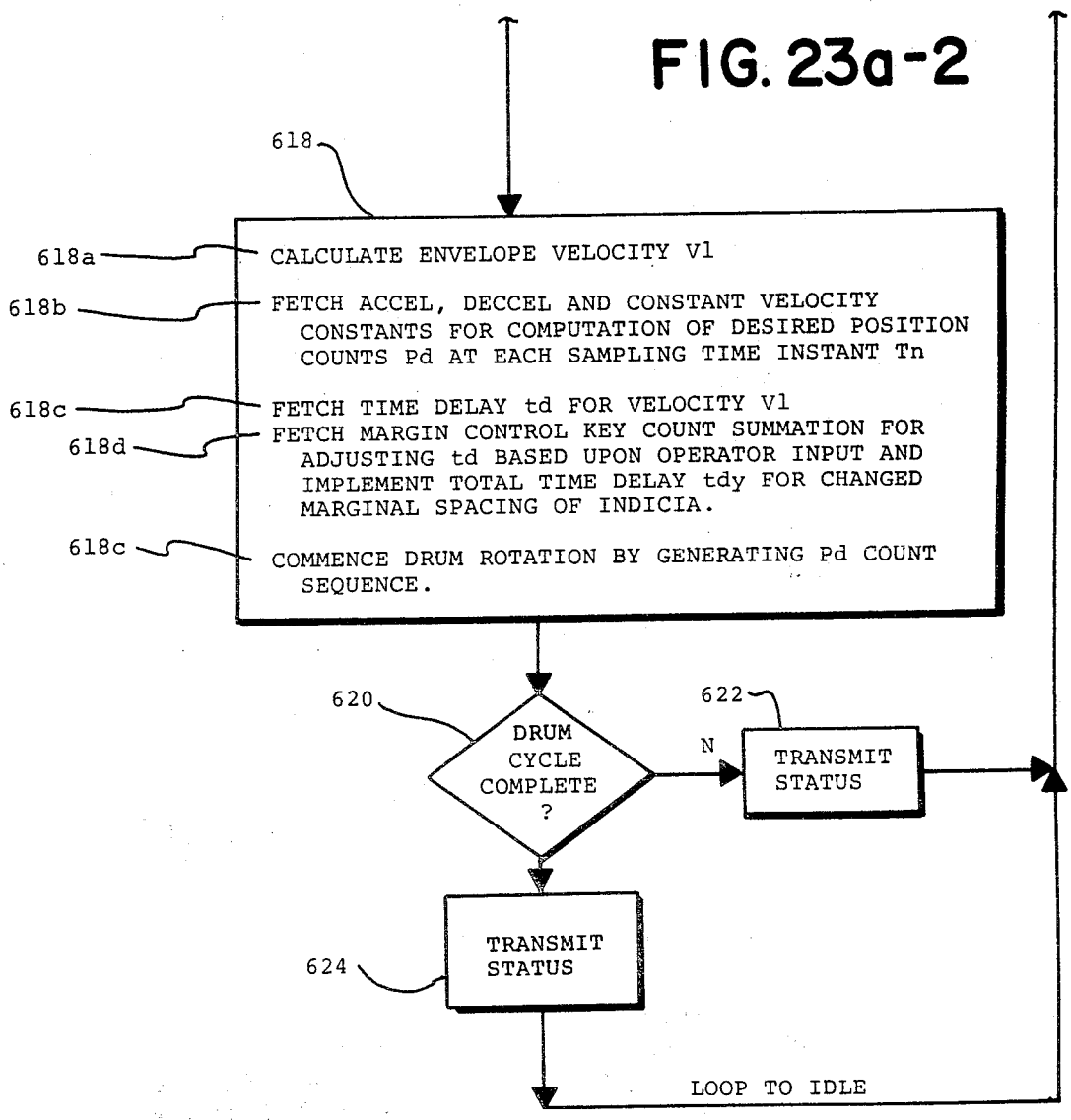

In general, the computer 500 includes three software programs, including a main line program FIG. 23, a transmit and receive program and a command execution program, respectively identified by the 600, 700 and 800 series of numbers. When the mailing machine 10 is energized by actuation of the main power switch 24, the resulting low level logic signal from D.C. supply is applied to the reset terminal RST of the computer's microprocessor 502, thereby enabling the microprocessor 502. Whereupon, as shown in FIG. 23, the microprocessor 502 commences execution of the main line program 600.

The main line program 600 (Fi9.123) commences with the step of conventionally initializing the microprocessor 602, which generally includes establishing the initial voltage levels at the microprocessor's ports, and interrupts, and setting the timers and counters. Thereafter, the D.C. motor drive unit is initialized 604. Step 604 entails scanning the motor home position sensor input port $P0_0$, to determine whether or not the D.C. motor 120 is located in its home position and, if it is not, driving the motor 120 to its home position. Assuming the D.C. motor 120 is in its home position, either before or after the initialization step 604, the program then enters an idle loop routine 606.

In the idle loop routine 606, a determination is initially made as to whether or not the sampling time period of T=1 millisecond has elapsed, step 608, it being noted that each successive sample is taken at the time instant $T_n$ immediately after and in response to the fourth 250 millisecond interrupt generated by the timer utilized for implementing the sampling time period T. Assuming the time period T has not elapsed, the program loops to idle 606. On the other hand, assuming the time period T has elapsed, the microprocessor 502 updates the servo-control system, step 610. For the purpose of explaining step 610 it will be assumed until otherwise stated that the desired location of the postage meter drum 38, and thus the motor drive shaft 122, is the home position. Step 610 includes the successive steps 610*a* and 610*b*, respectively, of sampling the count of the actual position Pa of the motor drive shaft 122 at the sampling time instant $T_n$, and fetching the previously computed count representing the desired position Pd of the shaft 122 at the same sampling time instant $T_n$. If for any reason the motor drive shaft 122 is not located in its home position when the value of the desired position count $Pd(T_n)$ is representative of the home position location, then the values of $Pa(T_n)$ and $Pd(T_n)$ will be different. On the other hand, if the motor drive shaft 122 is located in its home position when the desired position count $Pd(T_n)$ is representative of the home position location, then the values of $Pa(T_n)$ and $Pd(T_n)$ will be the same. Accordingly, computation of the error count, 610*c*, may or may not result in an error count value $E(T_n)$ of zero. Further, independently of the computed value of $E(T_n)$, the computed value $G(T_n)$ of the motor control signal, step 601*d*, may or may not result in a value of $G(T_n)$ of zero; it being noted that although step 610*c* results in a computed value of $E(T_n)=0$, the value of $g_2$ may not be equal to zero due to the computed value of the error for the next previous sampling time instant $E(T_{n-1})$ having resulted in a non-zero value, step 610*g*. Assuming steps 610*c* and 610*d* both result in zero value computations, then, upon updating and generating the PWM motor control signal, step 610*e*, no motor control signal will be generated. Under any other circumstances, step 610*e* will result in generating a PWM motor control signal for driving the D.C. motor 120, and thus the drum 38, to its home position. Thereafter, as shown in step 610*f*, the computed values of $E(T_n)$ and $G(T_n)$ are utilized as the values of $E(T_{n-1})$ and $G(T_{n-1})$ respectively for pre-calculating the value of $g_2$ for the next subsequent time instant $T_n$.

Accordingly, the computation made in the next step, 610*g*, to obtain the value of $g_2$ for the next sampling time instant $T_n$ is made by utilizing the replacement values $E(T_{n-1})$ and $G(T_{n-1})$. Thereafter, as shown in step 610*h*, the desired position count Pd for the next sampling time instant $T_n$ is made, which, as previously stated has been assumed to be representative of location of the motor drive shaft 122 in its home position. At this juncture it should be noted that the next step 612 in the program is to determine whether or not the enable flag is set, and, as hereinafter further discussed, this inquiry will be answered in the negative, causing the program to return to idle 606, unless a command has been received from the postage meter's computer 41 which results in feeding a mailpiece 16 to the postage meter drum 38. Accordingly, until a mailpiece 16 is fed to the postage meter drum 38, the main line program will continuously loop through steps 608, 610 and 612. As a result the motor drive shaft 122, and thus the drum 38, will be driven to the home position, against any force tending to move the drum 38 or shaft 122 out of the home position, until a mailpiece 16 is fed to the drum 38.

At this juncture it will be assumed that the enable flag is set, as a result of which the inquiry of step 612 is answered affirmatively, or, as above stated, a mailpiece 16 is being fed to the drum 38. Accordingly, the microprocessor 502 commences polling the ports connected to the envelope sensors 56 and 58, step 614. Since polling occurs at one millisecond time intervals, the polling sequence is continuous. As shown by the following step 616, between successive time instants $T_n$, the program continuously loops to idle 606 and through steps 608–616 inclusive until the envelope sensing sequence for a given envelope is complete. Whereupon the microprocessor commences executing step 618, which includes the steps of calculating the envelope's velocity, 618*a*; then fetching from memory the corresponding acceleration, deceleration and constant velocity constants, 618*b*, for computation of the desired position counts Pd at each successive time instant $T_n$ in advance of sampling the actual position counts Pa as hereinbefore discussed in connection with step 610; then fetching the time delay $t_d$ corresponding to the particular velocity VI for commencing acceleration of the drum 38 to the target velocity V1, step 618*c*; then fetching the count representative of the summation n of the number of depressions of the marginal increase and decrease keys 53*c* and 53*d* for adjusting the value of the time delay $t_d$ to the total time delay $t_{pd}$ based upon operator input, and implementing the total time delay value $t_{pd}$ for establishing the changed marginal distance indicia is to be spaced from the leading edge of the sheet when printed, 618*d*; and then commencing drum rotation by generating the desired position Pd for the initial one millisecond sampling time instant of acceleration of the motor drive shaft 122 and storing the value for subsequent use in step 601*b*. Accordingly, the value of Pd will no longer be assumed to be the value representative of the home position.

Thereafter the inquiry is made as to whether or not the drum cycle is complete, step 620. Assuming as stated above that only the initial desired value of Pd has been computed and stored, this inquiry of step 620 will be answered in the negative. Whereupon the microprocessor 502 transmits a status message, step 622, to the postage meter's computer 41 and the program loops to idle 606. Thereafter the microprocessor 502 continuously executes steps 608–620 until the entire Pd count sequence 618*d* for the trapezoidal-shaped velocity versus time profile for the target velocity V1 has been exhausted. In this connection it is noted that the drum cycle $T_{ct}$ is not complete until the settling time interval $T_s$ which is allowid for damping any overshoot of the motor drive shaft 122 is complete. During the settling time interval $T_s$ the value of Pd is a constant and representative of the home position of the shaft 122 and thus the drum 38. Assuming that the drum cycle is complete, the inquiry of step 620 will be answered affirmatively. Whereupon the microprocessor 502 transmits a status message, step 624, to the postage meter's computer 41 and the program loops to idle 606. Thereafter, the foregoing steps 606–622 of the main line, servo-control, idle loop are continuously executed by the microprocessor 502 in accordance with the above discussion until the main power switch 24 is opened by the operator.

The serial communications program 700 includes the transmit status routine 704. The latter routine 704 includes the steps of receiving and decoding any message, step 706, and invoking the execute command routine, step 708, both of which steps are self explanatory.

Assuming the execute command routine 800 has been invoked, step 708, the microprocessor 502 executes the routine 800 commencing with the step 802 of inquiring whether or not the decoded message is an enable command. Assuming the answer is yes, an enable status flag is set, step 804, to indicate that an envelope is to be fed to the drum 38. Whereupon the A.C. motor relay 52 is energized, step 806, for feeding the envelope to the drum 38, and the transmit status routine is invoked, step 808. On the other hand, assuming the decoded message is not an enable command, step 802, an enable status flag is cleared, step 810. Whereupon the A.C. relay is deenergized, step 812, and the status transmit routine is invoked 808.

Assuming the status transmit routine 702 has been invoked, step 806, the microprocessor 502 executes the routine 702 commencing with the step 710 of inquiring whether or not the drum cycle is complete. Assuming completion of the drum cycle, a drum cycle complete message is transmitted to the postage meter's computer 41, step 712. On the other hand, assuming the drum cycle is not complete, an inquiry is made as to whether or not the A.C. relay is energized, step 716, and, if it is, an A.C. relay energized message is transmitted to the postage meter's computer 41, step 718. If however the drum cycle is not complete, step 710, and the A.C. relay is not energized, step 716, then, an A.C. relay deenergized message is transmitted to the postage meter's computer 41, step 720. Upon transmitting any of the messages, drum cycle complete, step 710, A.C. relay energized, step 716, or A.C. relay deenergized, step 720, the microprocessor 502 returns to the idle 606 of the main line program 600.

The term postage meter as used herein includes any device for affixing a value or other indicia on a sheet or sheet-like material for governmental or private carrier parcel, envelope or package delivery, or other purposes. For example, private parcel or freight services purchase and employ postage meters for providing unit value pricing on tape for application on individual parcels.

A more detailed description of the programs hereinbefore discussed is disclosed in the appended program listing which describes in greater detail the various routines incorporated in, and used in the operation of, the postage meter.

Although the invention disclosed herein has been described with reference to a simple embodiment thereof, variations and modifications may be made therein by persons skilled in the art without departing from the spirit and scope of the invention. Accordingly, it is intended that the following claims cover the disclosed invention and such variations and modifications thereof as fall within the true spirit and scope of the invention.

"APPENDEX" B-990

For patent application entitled
APPARATUS FOR CONTROLLING PRINTING MEANS

Inventors: Edilberto I. Salazar and Wallace Kirschner

```
8051 ASSEMBLER V1.0     14-JUN-1984 10:42:37.77
      <<< ASSEMBLY COMMAND STRING >>>
  MOTORC1.
   <<< end of assembly command string >>>

ER   LINE  ADDR  OBJECT        TYPE

       1                                 $ABS
       2                                 $NOGEN
       3                                 $ERRORPRINT
       4                                 $INCLUDE(DECLARE.DMS)
       5                                 ;*************************************************
       6                                 ;        INTERNAL 8051 RAM's DECLARATION
       7                                 ;*************************************************
       8                                 ;*must have directly addressable bits.
       9                                 ;-----------------------------------------
      10                                              DSEG
      11                                              ORG     20H
      12  0020                          FLAGS:      DS      5       ;*Mapped for flags.
      13  0025                          SAV_SENSR:  DS      1       ;*Sensors status register.
      14  0026                          STAT_HEADER: DS     1       ;*System status communication header.
      15  0027                          MSG1_STAT:  DS      1       ;*System status first byte.
      16  0028                          MSG2_STAT:  DS      1       ;*System status second byte.
      17  0029                          MISTRIP_CTR: DS     1       ;*Missed-trip counter (third status byte).
      18  002A                          ERR_CNT:    DS      1       ;*Error count register.
      19  002B                          K2H:        DS      1       ;*ABS(error) x COEFF2 (High) register.
      20  002C                          K2L:        DS      1       ; Low byte.
      21  002D                          CMMD_HEADER: DS     1       ;Command-complete header.
      22  002E                          POSN_ACC:   DS      2       ;Desired position count accum (2-byte).
      23  0030                          BASE_INDEX: DS      2       ;One cycle index accum (2-byte).
      24  0032                          RUN_SPEED:  DS      1       ;Computed velocity, counts/sample.
      25  0033                          VEL_OFFS:   DS      1       ;Velocity offset during deccel.
      26  0034                          GP_LATCH:   DS      1       ;Register for 'on-the-fly0 latching.
      27  0035                          MARGIN:     DS      1       ;Print margin delay register.
      28  0036                          AUX_REG:    DS      1       ;Indirectly addressed register.
      29  0037                          ACCEL_CNT:  DS      2       ;Acceleration distance, counts (2-byte)
      30  0039                          DECCEL_INT: DS      1       ;Deceleration time interval
      31  003A                          CYC_CTR:    DS      1       ;Cycle repeater counter
      32  003B                          TOTAL_CNT:  DS      2       ;Desired total distance (2-byte)
      33  003D                          ACCELK:     DS      1       ;Accel constant
      34  003E                          SLEWK:      DS      1       ;Maximum speed constant.
      35  003F                          BOFFS:      DS      2       ;MEIER_INDEX save area.
      36  0041                          DECCELK:    DS      1       ;Deccel constant
      37  0042                          PLIM_ERR:   DS      1       ;Positive error count limit.
      38  0043                          NLIM_ERR:   DS      1       ;Negative error count limit.
      39  0044                          PORTX_LATCH: DS     1       ;Port X software latch.
      40  0045                          TRIP_CTR:   DS      2       ;Trip counter.
      41  0047                          SAV2_AREA:  DS      2       ;Last set bank no. and lir conv.
      42  0049                          DRUM_DECCEL: DS     2       ;Drum deccel time constant reg.
      43  004B                          GP_PTR:     DS      2       ;General purpose pointer.
      44  004D                          START_OF_STACK: DS  1
```

```
46                          ;*********************************
47                          ;       REGISTER BANK 0
48                          ;*********************************
49                          ;USED BY MAIN LINE ROUTINE.
50                          ;       R0 = general purpose; for indirect addressing modes.
51                          ;       R1 = general purpose; for indirect addressing modes.
52                          ;            local in Stepper Drive Loop.
53                          ;       R2 = 1ms-interval counter.
54                          ;       R3 = 256-ms interval counter
55                          ;       R4 = general purpose register.
56  0004                    R4_RB0          EQU     04
57                          ;       R5 = accel/deccel timer high byte.
58                          ;       R6 = 1ms-increment time delay counter.
59                          ;       R7 = accel/deccel timer low byte.

61                          ;*******************************
62                          ;       REGISTER BANK 1
63                          ;*******************************
64                          ;R4 is exclusively used by Communication rtn.
65                          ;-----------------------------------------
66                                          DSEG
67                                          ORG     08
68  0008                    R0_RB1:         DS      1
69  0009                    R1_RB1:         DS      1
70  000A                    R2_RB1:         DS      1
71  000B                    R3_RB1:         DS      1
72  000C                    R4_RB1:         DS      1
73  000D                    R5_RB1:         DS      1
74                                          CSEG
75  0004                    COMERR_CTR      EQU     R4
76  0008                    GP1_SAVE        EQU     R0_RB1
77  0009                    GP2_SAVE        EQU     R1_RB1

79                          ;*********************************
80                          ;       REGISTER BANK 2
81                          ;*********************************
82                          ;       R0 = trajectory computed count.
83                          ;       R1 = accum save location during int rtn.
84                          ;       R2 = control algorithm partial result storage (lbyte).
85                          ;       R3 = control algorithm partial result storage (hbyte).
86                          ;       R4 = scratchpad
87                          ;       R5 = scratchpad
88                          ;       R6 = 'on-the-fly' count latch
89                          ;       R7 = T1 timeout counter.
90                                          DSEG
91                                          ORG     10H
92  0010                    COMP_CNT:       DS      1       ;Computed encoder count.
93  0011                    TEMP:           DS      1       ;Accum temp storage.
94  0012                    K1L:            DS      1       ;Partial control result lbyte.
95  0013                    K1H:            DS      1       ;              hbyte.
96  0014                    R4_RB2:         DS      1
97  0015                    R5_RB2:         DS      1
98  0016                    SAVE_LATCH:     DS      1
99  0017                    T1_CTR:         DS      1
```

```
101                     ;*********************************
102                     ;        REGISTER BANK 3
103                     ;*********************************
104                     ;RECEIVED MESSAGE ARRAY

106  0018               CMMD:          DS      5
107  001D               OLD_CMMD:      DS      1        ;Previous command.

109                     ;*********************************
110                     ;        FLAGS DECLARATION
111                     ;*********************************
112                     ;5 (20H-24H) BYTES WITH DIRECTLY-ADDRESSABLE BITS RESERVED
113                     ;Bit address 0 to 27H.
114                     ;-----------------------------------------------------
115                                    BSEG
116                                    ORG     00
117  0000               COM_RSRV:      DBIT    5
118  0005               BITMODE_FLG:   DBIT    1        ;Bit mode communication.
119  0006               COMERR_FLG:    DBIT    1        ;Communication error flag.
120  0007               DCMDIR_FLG:    DBIT    1        ;0 =DCmotor dir =CCW; 1=CW.
121  0008               RUN_FLG:       DBIT    1        ;Slew mode flag.
122  0009               ACCEL_FLG:     DBIT    1        ;Accel/deccel flag
123  000A               PROF_FLG:      DBIT    1        ;0 =point-to-point; 1=velocity-position
124  000B               INIT7_FLG:     DBIT    1        ;Initialization mode.
125  000C               TR1_FLG:       DBIT    1        ;First mail detect.
126  000D               TR2_FLG:       DBIT    1        ;Second mail detect.
127  000E               QMSG_FLG:      DBIT    1        ;Message qued flag.
128  000F               HOME_FLG:      DBIT    1        ;Load home indicator.
129  0010               SMALL_FLG:     DBIT    1        ;5 counts or less flg.
130  0011               CONT_FLG:      DBIT    1        ;Continuous mode flag.
131  0012               SKIP_FLG:      DBIT    1        ;Flow skip flag.
132  0013               CMMDSRC_FLG:   DBIT    1        ;Command source flag.
133  0014               TEST_FLG:      DBIT    1        ;Test mode flag.
134  0015               SAVE1_BIT:     DBIT    1        ;Bit temp storage.
135  0016               RECVER_FLG:    DBIT    1        ;Transmission receiver.
136  0017               DCMOVE_FLG:    DBIT    1        ;DC motor in active motion.

139                     ;*********************************
140                     ;        STATUS BITS EQUATES
141                     ;        (REGISTERS MSG_STAT)
142                     ;*********************************
143                                    CSEG
144  003B               WTCHDOG_FLG    EQU     MSG1_STAT.0      ;Program flow watchdog.
145  003A               SYS_ENABLE     EQU     MSG1_STAT.2      ;Drive system enabled
146  003B               STAT_FLG       EQU     MSG1_STAT.3      ;Status-change flag.
147  003C               BADSENS_FLG    EQU     MSG1_STAT.4      ;Sensor stucked on.
148  003D               TRIPEN_FLG     EQU     MSG1_STAT.5      ;Trip logic enable flag.
149  003E               DCMBND_FLG     EQU     MSG1_STAT.6      ;DC motor bind

151  0040               LO30VDC_FLG    EQU     MSG2_STAT.0      ;Low 30 VDC supply.
152  0041               BADFEED_FLG    EQU     MSG2_STAT.1      ;Bad feed (paper jammed/shingle)
153  0042               STRMF_FLG      EQU     MSG2_STAT.2      ;Streamfeed flag.
154  0045               XPORT_FLG      EQU     MSG2_STAT.5      ;Transport path not clear
```

```
0046    BADCOM_FLG      EQU     MSG2_STAT.6     ;Bad communication line.
0047    INITZERR_FLG    EQU     MSG2_STAT.7     ;Initialization error.

                        ;*****************************************
                        ;       CONSTANTS DECLARATION
                        ;*****************************************
0000    CHECK_SUM       EQU     0000    ;Checksum code.
03E8    TC_SAMP         EQU     1000    ;Sampling interval= 1000us.
00FA    TC_T1INT        EQU      250    ;T1 interrupt inerval = 250us.
000A    TRIP_LTM        EQU       10    ;Trip limit pause.
1F40    COMWTCHDOG      EQU     8000    ;Communication rtn watchdog interval.
0014    LONG_TC         EQU       20    ;Long settling time interval.
0005    SHORT_TC        EQU        5    ;Short. -
0014    TC3_SETTLE      EQU       20
000A    TC1_STEP        EQU       10    ;Per step time interval.
0004    TC2_STEP        EQU        4
0024    HARD            EQU       36    ;Hard error count limit.
0030    HARDER          EQU       48    ;Harder error.
003F    HARDEST         EQU       63    ;Hardest error count limit.
0004    SOFTERR         EQU        4    ;Soft (endstop) error limit.
0001    INITZ_SPEED     EQU        1    ;Digit move speed during initz'n.
0059    INITZ_ACCEL     EQU      59H    ;Accel constant with speed = INITZ_SPEED
0006    SRCH_CNT        EQU        6    ;Search mode count constant.
0004    ADJC            EQU        4    ;Backlash adjustment constant.
0168    COFFF0          EQU      360    ;Algorithm coefficient 0
00FF    COEFF1          EQU      255    ;Algorithm coefficient 1
0050    COFFF2          EQU       60    ;Algorithm coefficient 2 (COEFF2/256)
0A00    BASE_1REV       EQU     512*5   ;Base drv shaft 1 rotation distance.
0011    RUND            EQU       17            ;Drum velocity, cnt/sample.
001A    BMAX_RUN        EQU       26            ;Base maximum velocity.
0079    ACCD            EQU      79H            ;Drum accel rate, cnt/sample^2.
00AE    DECCD           EQU     0AEH            ;Drum deccel rate.
0088    BACCT           EQU      88H            ;Base maximum accel rate.
009A    INTEN           EQU      9AH            ;Interrupt enable mask.
1000    END_OF_PGM      EQU    1000H            ;End of program memory.
FA00    MAX_CNT         EQU  BASE_1REV*25       ;Base maximum displacement.

                        $NOCOND
                        ;*****************************************
                        ;       8155's MEMORY & I/O ADDRESS MAP
                        ;-----------------------------------------
B800    P8155           EQU     08800H  ;SDK emulation = 08800H
                                        ;2732A eprom = 07800H.

                        IF      HIGH(P8155) EQ 008H
B801    PORTA           EQU     08801H  ;Port A address
B802    PORTB           EQU     08802H  ;Port B address
B803    PORTC           EQU     08803H  ;Port C address
9000    PORTX           EQU      9000H  ;Port X address
1000    EXRAM1          EQU      1000H  ;8155 start of RAM.

                        ;-----------------------------------------
                        ;       SDK-51 AUXILLARY RTNS ENTRY
                        ;-----------------------------------------
```

```
209  E00F                          CLRDSP          EQU     0E00FH  ;Clear SDK display.
210  E006                          DSPCHR          EQU     0E006H  ;Display an ASCII character.
211  E018                          DSP2BY          EQU     0E018H  ;Display 2-byte hex.
212  E015                          DSP1BY          EQU     0E015H  ;Dispaly 1-byte hex.
213  E01E                          DSPMSG          EQU     0E01EH  ;Display ASCII string.
214  E64C                          UPI_IN          EQU     0E64CH
215  E625                          UPI_CMD         EQU     0E625H
216  E3CB                          CSMERR          EQU     0E3CBH  ;Display checksum err msg.
217  C000                          KEYBD           EQU     0C000H
218                                                 ELSE
219                                                 ENDIF
220                                $INCLUDE(INTVECTOR.DMS)

222                                ;*************************************************
223                                ;               PROGRAM STARTS HERE
224                                ;*************************************************
225                                                ORG     00
226  0000                          BEGIN           EQU     $
227  0000  01 99          .C..                      AJMP    POWER_ON        ;Power-up initialization routine.

229                                ;*****************************************
230                                ;               LOOPS FOREVER
231                                ;*****************************************
232                                                ORG     03
233  0003  02 00 03       ..C.                      LJMP    $               ;Loops forever if checksum error.
234  0006  00 00                   CHKSUM_CODE:    DW      CHECK_SUM
235  0008  C0 83          .D..     TOCONT:         PUSH    DPH
236  000A  32                                      RETI

238                                ;*****************************************************************
239                                ;               TO INTERRUPT SERVICE ROUTINE
240                                ;*****************************************************************
241                                ;Used to keep track of the PWM turn-on time interval.
242                                ;Timer is reloaded and started in the T1_INT interrupt routine
243                                ;       every sampling interval with computed servo output
244                                ;       value ( =PWM turn-on time for the next sampling interval.)
245                                ;Used by communication routine as watchdog.
246                                ;Not used by servo control (output Xtors always OFF) when
247                                ;       used by communication routine.
248                                ;-----------------------------------------------------------------
249                                                ORG     0BH
250  000B  43 90 03       .D..     TO_INT:         ORL     P1,#00000011B   ;Turn-off both source Xtors.
251  000E  10 06 01       .BR.                     JBC     COMERR_FLG,$+4  ;COMERR_FLG =1 when in comm rtn.
252  0011  32                                      RETI
253  0012  90 0A 8F       ..C.                     MOV     DPTR,#BADCOM    ;Force return to BADCOM but restore
254  0015  8E 81          .D..                     MOV     SP,R6           ;SP for proper program continuation.
255                                ;-----------------------------------
256                                ;       SPECIFY RETURN ADDRESS
257                                ;         FOR FORCED RETURN
258                                ;-----------------------------------
259  0017  C0 82          .D..     FORCRET:        PUSH    DPL             ;Push to stack PC return address.
260  0019  80 ED          .R..                     SJMP    TOCONT
```

```
                                ;*****************************************************************
                                ;NAME:  TIMER1_INT
                                ;
                                ;ABSTRACT: Invokes by the sampling interval timeout; computes
                                ;       the desired duty cycle for the next sampling interval
                                ;       based on the sampled error count, last error count, and
                                ;       last output (pwm turn-on time).
                                ;
                                ;INPUTS:  SYS_WTCHDOG, K1L, K1H, ERR_CNT, DCMOVE_FLG, DPTR
                                ;
                                ;OUTPUTS:  SGN(PWM turn-on time) in K2H, K2L.
                                ;          ABS(PWM turn-on time) in Timer 0 and start Timer.
                                ;
                                ;VARIABLES MODIFIED: RB1 Registers, ERR_CNT, T0 Latches, TR0, P1
                                ;               K2H, K2L, Carry C, SYS_WTCHDOG
                                ;
                                ;RESTRICTIONS:
                                ;           For logic correctness and servo loop stability, this
                                ;           interrupt service rtn is position and time sensitive.
                                ;           Timer 1 interrupt must have WAIT_T1 loop of UPDATE_SERVO
                                ;           module as its only background routine to synchronize
                                ;           the system to the servo sampling interval. The time to
                                ;           compute the servo output must be insignificant relative
                                ;           to the sampling period, ie., time delay between sampling
                                ;           and outputting of PWM motor control must approach zero.
                                ;           Hence, DPTR, B register, and PSW are preset to PORT1,
                                ;           LOW(COEFF0), and Register Bank 2 respectively.
                                ;
                                ;SUBRTNS ACCESSED: None
                                ;*****************************************************************

                                        ORG     18H
0018  D5 17 7A      .DR.        TIMER1_INT:     DJNZ    T1_CTR,T1_EXIT
001E  C2 8C         .B..                        CLR     TR0             ;Stop PWM timer.
0020  F9                                        MOV     R1,A            ;Save accum of background rtn.

                                ;-----------------------------------
                                ;       COMPUTE ERROR COUNT
                                ;-----------------------------------
0021  E0                                        MOVX    A,@DPTR         ;Sample actual position.
0022  FD                                        MOV     R5,A
0023  E0                                        MOVX    A,@DPTR
0024  B5 15 02      .DR.                        CJNE    A,R5_RB2,REREAD
0027  80 02         .R..                        SJMP    COMP_ERR
0029  E0                        REREAD:         MOVX    A,@DPTR
002A  FD                                        MOV     R5,A
002B  E8                        COMP_ERR:       MOV     A,R0            ;Get desired position count.
002C  C3                                        CLR     C               ;Acc =desired ;COMP_CNT =sampled.
002D  9D                                        SUBB    A,R5            ;Error Count =desired count-Sampled
002E  F5 2A         .D..                        MOV     ERR_CNT,A       ;Save error count.
0030  20 E7 02      .BK.                        JB      ACC.7,$+5       ;Determine sign of error.
0033  80 02         .R..                        SJMP    CHK_IDLE_TOL    ;Bit =0 +; =1 -.
0035  F4                                        CPL     A               ;Get absolute value of error if negat
0036  04                                        INC     A
```

```
0037  20 17 06      .RR.   CHK_IDLE_TOL:  JB      DCMOVE_FLG,COMP_PWM     ;Is mode still in active DC motor c
003A  B4 01 03      ..R.                  CJNE    A,#01,COMP_PWM          ;+/- 1 count tolerance if in idling
003D  E4                                  CLR     A                       ;ie, error count is made =0.
003E  F5 2A         .D..                  MOV     ERR_CNT,A

                                   ;-----------------------------------------------
                                   ;                COMPUTE SERVO OUTPUT
                                   ;-----------------------------------------------
0040  FC                           COMP_PWM:     MOV     R4,A            ;Acc =ABS(err cnt) =R4.
0041  A4                                         MUL     AB              ;B =constant LOW(COEFF0).
0042  CC                                         XCH     A,R4
0043  25 F0         .D..                         ADD     A,B
0045  CA                                         XCH     A,R2            ;LOW( COEFF0 x err cnt )= R4; HIGH =R2.
0046  20 57 05      .RR.                         JB      ERR_CNT.7,MINUS
0049  2C                                         ADD     A,R4            ;R2(low),R3(high) registers hold the term
004A  CB                                         XCH     A,R3            ;[-COEFF1 x E(k-1)T - COEFF2 x G(k-1)T]
004B  3A                                         ADDC    A,R2            ;Output G(k)T is in R3=Lbyte, Acc=Hbyte.
004C  80 04         .R..                         SJMP    UPD_PWM
004E  C3                           MINUS:        CLR     C
004F  9C                                         SUBB    A,R4
0050  CB                                         XCH     A,R3
0051  9A                                         SUBB    A,R2

                                   ;-----------------------------------------------
                                   ;                UPDATE PWM DRIVE
                                   ;-----------------------------------------------
0052  BB 2C         .D..           UPD_PWM:      MOV     K2L,R3
0054  20 5F 05      .BR.                         JB      K2H.7,$+8               ;Determine previous output sign bit.
0057  20 E7 07      .BR.                         JB      ACC.7,SIGNC_NEG         ;Output sign change from + to -.
005A  80 1F         .R..                         SJMP    SAME_POS                ;No change + to +.
005C  30 E7 15      .BR.                         JNB     ACC.7,SIGNC_POS         ;Changed from - to +.
005F  80 07         .R..                         SJMP    SAME_NEG                ;No change - to -.
0061  43 90 0F      .D..           SIGNC_NEG:    ORL     P1,#00001111B   ;Turn off output Xtors if sign
0064  7C 08                                      MOV     R4,#08          ;changed to avoid pwr supply short.
0066  DC FE         .R..                         DJNZ    R4,$            ;Turn-off delay time.
006B  F5 2B         .D..           SAME_NEG:     MOV     K2H,A           ;Save output.
006A  F5 BC         .D..                         MOV     TH0,A           ;Load timer registers.
006C  8B 8A         .D..                         MOV     TL0,R3
006E  00                                         NOP
006F  53 90 F6      .D..           DIR_CW:       ANL     P1,#11110110B   ;Turn on Xtor CW pair.
0072  80 13         .R..                         SJMP    ON_TIMER        ;+err cnt =CCW; -err cnt =CW.
0074  43 90 0F      .D..           SIGNC_POS:    ORL     P1,#00001111B
0077  7C 08                                      MOV     R4,#08
0079  DC FE         .R..                         DJNZ    R4,$
007B  F5 2B         .D..           SAME_POS:     MOV     K2H,A
007D  F4                                         CPL     A               ;Set cpl of output if positive
007E  CB                                         XCH     A,R3            ;because timer is upcount overflow.
007F  F4                                         CPL     A
0080  F5 BA         .D..                         MOV     TL0,A
0082  53 90 F9      .D..           DIR_CCW:      ANL     P1,#11111001B   ;Turn on Xtor CCW pair.
0085  8B BC         .D..                         MOV     TH0,R3
0087  D2 BC         .B..           ON_TIMER:     SETB    TR0             ;Start timer.
```

```
0089  E9                          MOV     A,R1            ;Restore accumulator.
008A  10 38 0B      .BR.          JBC     WTCHDOG_FLG,T1_EXIT     ;Program in sync?
008D  D2 38         .B..          SETB    WTCHDOG_FLG     ;Program went out of sync with servo
008F  D0 4B         .D..  TFATAL: POP     GP_PTR          ;control sampling clock.
0091  D0 4C         .D..          POP     GP_PTR+1        ;Save actual return address for later
0093  90 02 03      ..C.          MOV     DPTR,#JFATAL    ;diagnostics before forcing a RETI to
0096  01 17         .C..          AJMP    FORCRET         ;fatal error trap.
0098  32                  T1_EXIT:  RETI
                          $INCLUDE(POWERON.OMS)

                          ;*****************************************************
                          ;******     POWER-UP PROGRAM INITIALIZATION     ******
                          ;*****************************************************

                          ;-----------------------------------------------------
                          ;               COMPUTE PROGRAM CHECKSUM
                          ;-----------------------------------------------------
0099  30 B3 FD      .BR.  POWER_ON:     JNB     P3.3,$          ;wait for 30 volts supply.
009C  90 00 00      ..C.          MOV     DPTR,#BEGIN     ;Program memory 0 to 1K.
009F  7F 00                       MOV     R7,#00          -
00A1  E4                  CHKSUM_LOOP:  CLR     A
00A2  93                          MOVC    A,@A+DPTR
00A3  2F                          ADD     A,R7
00A4  FF                          MOV     R7,A
00A5  A3                          INC     DPTR
00A6  E5 83         .D..          MOV     A,DPH
00A8  B4 10 F6      ..R.          CJNE    A,#10H,CHKSUM_LOOP
00AB  EF                          MOV     A,R7
00AC  60 03         .R..          JZ      INITZ_RTN
00AE  02 E3 CB            CHKSUM_ERR:   LJMP    CSMERR

                          ;-----------------------------------------------
                          ;               INITIALIZE I/O PORTS
                          ;-----------------------------------------------
00B1  C2 B1         .B..  INITZ_RTN:    CLR     P3.1            ;Hold Transmit Line low.
00B3  12 E0 0F                    LCALL   CLRDSP          ;Clear SDK display.
00B6  74 0C                       MOV     A,#0CH          ;Set up 8155 command register.
00B8  90 B8 00                    MOV     DPTR,#P8155     ;Configures Port C as output
00BB  F0                          MOVX    @DPTR,A         ;Ports A and B as inputs.
00BC  74 FF                       MOV     A,#0FFH         ;write 1's to output ports:
00BE  F5 90         .D..          MOV     P1,A            ;P1
00C0  75 82 03      .D..          MOV     DPL,#03
00C3  F0                          MOVX    @DPTR,A         ;Port C
00C4  90 90 00                    MOV     DPTR,#9000H
00C7  F0                          MOVX    @DPTR,A         ;Port X

                          ;-------------------------------------------------
                          ;               CLEAR INTERNAL RAMS
                          ;       SET UP TIMERS, INTERRUPTS, STACK
                          ;-------------------------------------------------
00C8  E4                          CLR     A
00C9  78 7F                       MOV     R0,#7FH                 ;Clear 8051 internal ram's.
00CB  F6                  CLR_8031:   MOV     @R0,A
00CC  D8 FD         .R..          DJNZ    R0,CLR_8031
```

```
00CE  F5 B8          .D..        MOV     TCON,A                  ;Clear all interrupt flags.
00D0  F5 A8          .D..        MOV     IE,A                    ;and interrupt enables.
00D2  F4                         CPL     A
00D3  F5 44          .D..        MOV     PORTX_LATCH,A           ;Put FFH to Port X latch.
00D5  75 B8 02       .D..        MOV     IP,#02                  ;T0 highest priority
00D8  75 89 21       .D..        MOV     TMOD,#21H               ;T1 =mode 2; T0 =mode 1.
00DB  75 8D 06       .D..        MOV     TH1,#(-TC_T1INT)        ;Timer 1 interval constant.
00DE  75 81 4C       .DD.        MOV     SP,#START_OF_STACK-1    ;First stack location.
00E1  43 A8 9A       .D..        ORL     IE,#INTEN               ;Enable interrupts except EX1.

                                 ;-----------------------------------------------
                                 ;           COMPUTE CONSTANT PARAMETERS
                                 ;-----------------------------------------------
00E4  75 3D AE       .D..        MOV     ACCELK,#DECCD   ;Given deccel rate and running speed,
00E7  0F                         INC     R7              ;compute deccel distance and
00E8  12 09 42       ..C.        LCALL   COMP_ACCEL      ;deccel time interval.
00EB  25 4A          .D..        ADD     A,DRUM_DECCEL+1
00ED  F5 4A          .D..        MOV     DRUM_DECCEL+1,A
00EF  BC 11 E5       ..R.        CJNE    R4,#ROUND,ITER00
00F2  8F 49          .D..        MOV     DRUM_DECCEL,R7
00F4  75 35 46       .D..        MOV     MARGIN,#70      ;Initialize MARGIN to 1/4 inch.
                                 $INCLUDE(INITZLOAD.DMS)

                                 ;*******************************************
                                 ;*****     INITIALIZE MECHANICAL BASE     *****
                                 ;*******************************************
00F7  D2 3A          .B..        INITZ_LOAD:     SETB    SYS_ENABLE          ;Enable system.
00F9  91 34          .C..                        ACALL   START_SERVO         ;Start servo control.

                                 ;-----------------------------------
                                 ;        CHECK OPTICAL SENSORS
                                 ;-----------------------------------
00FB  90 B8 01                   MOV     DPTR,#PORTA             ;Check for stucked sensrs.
00FE  E0                         MOVX    A,@DPTR
00FF  44 38                      ORL     A,#00111000B
0101  B4 FF 02       ..R.        CJNE    A,#0FFH,STUCKED
0104  80 04          .R..        SJMP    ENBLE_OPTO              ;Enable optics if all off.
0106  D2 3C          .B..        STUCKED:        SETB    BADSENS_FLG     ;Set status bit for 'sensr fail'.
0108  21 1F          .C..                        AJMP    FAIL_INITZ
010A  7C EF                      ENBLE_OPTO:     MOV     R4,#11101111B   ;Enable system optical sensors.
010C  91 94          .C..                        ACALL   ON_BIT

                                 ;-----------------------------------------
                                 ;        FIND MAIN DRIVE SHAFT HOME
                                 ;-----------------------------------------
010E  12 05 05       ..C.        LCALL   HOME_CHK                ;Read base home sensr.
0111  60 06          .R..        JZ      ALIGNED                 ;Not home if not 0.
0113  12 04 ED       ..C.        LCALL   HOME_SRCH               ;Initialize main drv shaft home.
0116  10 3B 06       .BR.        JBC     START_FLG,FAIL_INITZ
0119  F5 30          .D..        ALIGNED:        MOV     BASE_INDEX,A    ;Reset base index regs.
011B  F5 31          .D..                        MOV     BASE_INDEX+1,A
011D  21 23          .C..                        AJMP    EX_INITZLOAD
```

```
                                ;-----------------------------------
                                ;       INITIALIZATION FAILURE
                                ;-----------------------------------
011F  D2 47          .B..       FATL_INITZ:     SETB    INITZERR_FLG        ;Tell of initial'n failure.
0121  41 03          .C..                        AJMP    JFATAL              ;Proceed to Fatal Loop.
0123                            EX_INITZLOAD    EQU     $
                                $INCLUDE(MAINLINE.DMS)

                                ;*********************************
                                ;*****     IDLE CONTROL LOOP     *****
                                ;*********************************
                                ;The program loops here when not executing
                                ;any command; polls the control flags, the
                                ;communication line, the SDK keyboard, the
                                ;machine's optical sensors and switches.
                                ;True state triggers a task/ or a command.
                                ;One loop pass is equal to the servo sampling
                                ;interval, hence, steady-state demotor shaft
                                ;posn is always maintained.
                                ;R3 (RR0) is used as loop monitor for coarse,
                                ;long time durations, seconds, +/-.255sec, ie.,
                                ;timeout in waiting for an event to occur.
                                ;-----------------------------------------
0123  78 00                     IDLE_LOOP:      MOV     R3,#00          ;Clr 256ms-interval counter.
0125  C2 B4          .B..       MON_LOOP:       CLR     P3.4            ;Entry point for loop monitor.
0127  75 3A 01       .D..                       MOV     CYC_CTR,#01     ;Clr busy line and reset cmmd
                                                                       ;repeater counter.
                                ;-----------------------------------------
                                ;       POLL CONTROL FLAGS AND INPUTS
                                ;-----------------------------------------
012A  10 3B 02       .BR.       CHK_STAT:       JBC     STAT_FLG,$+5    ;STAT_FLG =1 change of status occured;
012D  80 02          .R..                       SJMP    CHK_DMSG         ;transmit status registers to
012F  21 B6          .C..                       AJMP    JXMIT             ;main control module.
0131  10 0E 02       .BR.       CHK_DMSG:       JBC     DMSG_FLG,$+5    ;DMSG_FLG =1 message received while
0134  80 02          .R..                       SJMP    CHK_TMSG         ;executing the previous task;
0136  21 D5          .C..                       AJMP    GET_CMMD         ;get message and execute command.
0138  91 60          .C..       CHK_TMSG:       ACALL   CHKIMSG         ;Check for incoming msg from channels.
013A  50 02          .R..                       JNC     CHK_TRIP         ;C =1 get msg and execute cmmd.
013C  21 A3          .C..                       AJMP    JRECVMSG
013E  20 0D 59       .BR.       CHK_TRIP:       JB      TR2_FLG,TRIP_RDY ;TR2_FLG =1 valid trip sequence
                                                                         ;detected while in last trip cycle.
                                ;-----------------------------------------------
                                ;       MAINTAIN SERVO STEADY-STATE POSITION
                                ;-----------------------------------------------
0141  12 08 02       ..C.       STEADY_STATE:   LCALL   UPDTE_SERVO     ;Update servo cntrl; track realtime eve
0144  20 3D 26       .BR.                       JB      TRIPEN_FLG,TRIP_ON      ;=1 trip logic is enabled.
                                                                                ;=0 trip logic is disabled.
                                ;-----------------------------------
                                ;       TRIP LOGIC IS DISABLED
                                ;-----------------------------------
0147  74 FF                                    MOV     A,#0FFH         ;Keep stepper motor off.
0149  B1 14          .C..                       ACALL   OUT_STEP
014B  E5 18          .D..                       MOV     A,CMMD          ;Check if cmmd = Seal-Only.
014D  B4 47 02       ..R.                       CJNE    A,#47H,NOTSEAL  ;If true, same logic as Trip-On
```

```
532  0152  70 05          .R..   NOTSEAL:     JNZ     IDLE_MODE        ;If cmd = 00, wait 20sec for the cntrl
533  0154  BB 4E CF       ..R.                CJNE    R3,#78,MON_LOOP  ;module to indicate its presence.
534  0157  41 03          .C..                AJMP    JFATAL               ;Disable system if it timed out.
535  0159  74 02                  IDLE_MODE:  MOV     A,#00000010B     ;Drive unit is idling; no task to do.
536  015B  91 BB          .C..                ACALL   OFF_SOL          ;Insure inker solenoid is off.
537  015D  91 C4          .C..                ACALL   PEEK_STAT        ;Monitor sensrs/switchs for any change.
538  015F  BB 1B 04       ..R.                CJNE    R3,#27,CHK_DRV   ;Check if there is power on motor.
539  0162  D2 3E          .R..                SETB    DCHBND_FLG       ;There should be no restraining force
540  0164  41 03          .C..                AJMP    JFATAL             ;on motor shaft, hence, servo output
541  0166  12 05 0F       ..C.   CHK_DRV:     CALL    CHKZDC             ;must be zero. Do not allow this condi-
542  0169  60 BB          .R..                JZ      IDLE_LOOP          ;for a long period of time, else, con-
543  016B  21 25          .C..   JMONLOOP:    AJMP    MON_LOOP           ;sider condition a dc motor bind error.

545                                ;-----------------------------------
546                                ;       TRIP LOGIC IS ENABLED
547                                ;-----------------------------------
548  016D  10 0D 2A       .BR.   TRIP_ON:     JBC     TR2_FLG,TRIP_RDY    ;=1 trip detect sequence OK; =0 false
549  0170  30 0C 05       .BR.                JNB     TR1_FLG,CHK_PATH    ;=1 start trip detect; =0 false
550  0173  20 41 0F       .BR.                JB      BADFEED_FLG,BAD_FEED  ;=1 bad feed detected; =0 false
551  0176  21 23          .C..                AJMP    IDLE_LOOP
                                                                         ;R4 holds sensrs reading from UPDTE.
552

570  019A  30 3D 02       .BR.   TRIP_RDY:    JNB     TRIPEN_FLG,IGNORE_TRIP  ;TRIPEN_FLG =1 rotate drum.
571  019D  41 4D          .C..                AJMP    PRNT_MAIL

575                                ;-----------------------------------------------
576                                ;       EXTERNAL MESSAGE IS TO BE RECEIVED
577                                ;-----------------------------------------------
578  01A3  D2 B4          .R..   JRECVMSG:    SETB    P3.4                    ;Set busy signal.
579  01A5  12 0A 14       ..C.                LCALL   RECV_MSG                ;Receive message from source.
580  01A8  10 3B 02       .BR.                JBC     STAT_FLG,IGNORE_MSG     ;Ignore msg if error, else
581  01AB  21 D5          .C..                AJMP    GET_CMMD                ;Get command.
582  01AD  30 3D 91       .BR.   IGNORE_MSG:  JNB     TRIPEN_FLG,STEADY_STATE ;Loop idle if trip not enabled;
583  01B0  C2 0D          .R..   DISABLE_TRIP: CLR    TR2_FLG                 ;Disable trip if enabled.
584  01B2  91 40          .C..                ACALL   STOP_XPORT
585  01B4  21 23          .C..   EX_IGNORE:   AJMP    IDLE_LOOP

587                                ;-----------------------------------------------------
588                                ;       A CHANGE OF STATUS IS TO BE TRANSMITTED
589                                ;-----------------------------------------------------
590  01B6  91 48          .C..   JXMIT:       ACALL   CHK_RECV            ;Check for incoming msg before xmit.
591  01B8  12 09 7C       ..C.                LCALL   XMIT_STAT           ;Transmit status to Control Module.
592  01BB  30 3A 45       .BR.                JNB     SYS_ENABLE,JFATAL   ;Check if status is fatal (syst. disabled)
593  01BE  21 23          .C..                AJMP    IDLE_LOOP           ;(If there is comm err, status will be
594                                                                       ;retransmitted, ie., STAT_FLG still 1.
595                                ;-----------------------------------------
596                                ;       COMMAND EXECUTION IS COMPLETED
597                                ;-----------------------------------------
598  01C0  20 3B 0D       .BR.   CMMD_COMPLETE: JB    STAT_FLG,EXRET          ;Error?
599  01C3  91 48          .C..                ACALL   CHK_RECV
600  01C5  20 0E 03       .BR.                JB      DMSG_FLG,RETURN_IDLE    ;Repeat cmd if no msg queued.
601  01C8  D5 3A 0F       .DR.                DJNZ    CYC_CTR,REPEAT          ;Command to be repeated?
602  01CB  12 09 97       ..C.   RETURN_IDLE: LCALL   XMIT_CMMDC              ;Status will be xmitted if comm err
603  01CE  C2 3B          .R..                CLR     STAT_FLG
```

```
01D0  20 41 DD      .BR.   FXRET:        JB      BADFEED_FLG,DISABLE_TRIP ;Insure transport is stopped if true
01D3  21 23         .C..                 AJMP    IDLE_LOOP                ;Else, terminate cmnd execution.

                           ;-----------------------------------------
                           ;       COMMAND VECTORS FROM MESSAGE
                           ;-----------------------------------------
01D5  A2 13         .B..   GET_CMND:     MOV     C,CMNDSRC_FLG            ;Indicate source of command.
01D7  92 16         .B..                 MOV     RECVFR_FLG,C
01D9  D2 B4         .B..   REPEAT:       SETB    P3.4                     ;Set busy signal.
01DB  E5 18         .D..                 MOV     A,CMND                   ;Get command.
01DD  90 01 E5      ..C.   EXEC_CMND:    MOV     DPTR,#CMND_TAB           ;Load start of table.
01E0  54 0F                              ANL     A,#0FH                   ;Mask upper nibble.
01E2  C3                                 CLR     C
01E3  33                                 RLC     A                        ;Multiply by 2.
01E4  73                                 JMP     @A+DPTR     ;SDK-51 key  ;Look-up jump table.
01E5  21 B6         .C..   CMND_TAB:     AJMP    REQ_STAT        ;P       ;Status request.
01B6                       REQ_STAT     EQU     JXMIT
01E7  21 23         .C..                 AJMP    IDLE_LOOP       ;A
01E9  21 B0         .C..                 AJMP    DISABLE_TRIP    ;B       ;Disable trip logic.
01EB  41 3D         .C..                 AJMP    ENABLE_TRIP     ;C       ;Enable trip logic.
01ED  21 23         .C..                 AJMP    IDLE_LOOP       ;D
01EF  21 23         .C..                 AJMP    IDLE_LOOP       ;E
01F1  21 23         .C..                 AJMP    IDLE_LOOP       ;F
01F3  41 4B         .C..                 AJMP    SEAL            ;G       ;Turn on the AC motor only.
01F5  21 23         .C..                 AJMP    IDLE_LOOP       ;H
01F7  21 23         .C..                 AJMP    IDLE_LOOP       ;I
01F9  21 23         .C..                 AJMP    IDLE_LOOP       ;J
01FB  41 4D         .C..                 AJMP    PRNT_MAIL       ;K       ;Print on mail.
01FD  21 23         .C..                 AJMP    IDLE_LOOP       ;L
01FF  21 23         .C..                 AJMP    IDLE_LOOP       ;M
0201  21 23         .C..                 AJMP    IDLE_LOOP       ;N
0203                       JFATAL       EQU     $               ;O       ;Disable system.
                           ;-----------------------------------------
                           ;               FATAL ERROR TRAP
                           ;-----------------------------------------
0203  C2 AB         .B..                 CLR     IE.3            ;Disable T1 interrupt.
0205  C2 3A         .B..                 CLR     SYS_ENABLE      ;Disable system.
0207  D2 A8         .B..                 SETB    IE.0            ;Insure EX0 is enabled.
0209  74 0F                              MOV     A,#0FH
020B  F5 90         .D..                 MOV     P1,A            ;Turn off: dcmotors drive.
020D  91 BB         .C..                 ACALL   OFF_SOL         ;        : solenoids drive.
020F  12 E0 0F                           LCALL   CLRDSP                   ;System disable.
0212  7A 02         .C..                 MOV     R2,#HIGH(STRING)            ;Display ERROR #status bytes.
0214  78 39         .C..                 MOV     R3,#LOW(STRING)
0216  12 E0 1F                           LCALL   DSPMSG
0219  AA 28         .D..                 MOV     R2,MSG2_STAT
021B  AB 27         .D..                 MOV     R3,MSG1_STAT
021D  12 E0 18                           LCALL   DSP2BY
0220  B2 B4         .B..   FATAL_LOOP:   CPL     P3.4                     ;Toggle system status LED.
0222  20 46 0C      .BR.   LOOP1MS:      JB      BADCOM_FLG,JLOOP
0225  91 60         .C..                 ACALL   CHK1MSG
0227  50 08         .R..                 JNC     JLOOP
0229  12 0A 14      ..C.                 CALL    RECV_MSG
```

```
657  022C  DC FE        .R..          DJNZ    R4,$
658  022E  12 09 7C     ..C.          CALL    XMIT_STAT
659  0231  DC FE        .R..  JLOOP:  DJNZ    R4,$
660  0233  DC FE        .R..          DJNZ    R4,$
661  0235  DA FB        .R..          DJNZ    R2,LOOP1MS
662  0237  80 E7        .R..          SJMP    FATAL_LOOP          ;Loop forever.

664  0239  03 45 3D 20        STRING:  DB      3,'E= '

666                           ;*****************************************
667                           ;*******                          *******
668                           ;*****************************************
669                           ;Status Registers is used to pass status information from
670                           ;module-to-module (or sub-routines).
671                           ;       STAT_FLG =0 if no change in status
672                           ;                =1 if there is a change in status
673                           ;       and corresponding change information bit(s).
674                           ;Tasks which are required to transmit a Cmd-Complete
675                           ;to the meter module pass thru CMMD_COMPLETE before
676                           ;terminating, else, task terminates directly to IDLE_LOOP.
677                           ;-----------------------------------------------

679                           ;*****************************************
680                           ;               ENABLE TRIP LOGIC
681                           ;*****************************************
682  0240  43 27 28     .D..  ENABLE_TRIP:  ORL   MSG1_STAT,#00101000B   ;Tell trip logic is enabled.
683  0240  53 28 F9     .D..  RUN_XPORT:    ANL   MSG2_STAT,#11111001B
684  0243  74 FD                            MOV   A,#11111101B          ;Turn on AC motor.
685  0245  91 87        .C..                ACALL ON_SOL
686  0247  91 14        .C..                ACALL START_SERVO     ;Reset real-timekeeping registers.
687  0249  21 23        .C..  EX_ONXPORT:   AJMP  IDLE_LOOP

893                           ;*****************************************
894                           ;                ADJUST PRINT MARGIN
895                           ;*****************************************
896  0302  E5 19        .D..  ADJ_MARGIN:   MOV   A,CMMD+1
897  0304  C3                               CLR   C
898  0305  33                               RLC   A
899  0306  24 46                            ADD   A,#70
900  0309  F5 39        .D..  COMP_MARGIN:  MOV   MARGIN,A
901  030A  21 76        .C..                AJMP  IDLE_LOOP

                              ;*****************************************
                              ;               PRINT_ON_MAIL CYCLE
                              ;*****************************************
                              ;Compute time delay before start of drum print motion.
                              ;-----------------------------------------------

03F9  74 FD                                 MOV   A,#11111101B
03FB  F1 24        .C..                     ACALL ON_SOL                ;FLG =1 inker enabled
```

```
03FD  30 3D 2F     .BR.   CONP_SPEED:   JNB    TRIPEN_FLG,UNLOCK        ;FLG =0 exercise only.
0400  E5 16        .D..                MOV    A,SAVE_LATCH             ;SAVE_LATCH = time interval between
0402  C3                               CLR    C                        ;TRIP1 and TRIP2.
0403  94 2D                            SUBB   A,#45                    ;Desired elapsed time is 45ms.
0405  60 09        .R..                JZ     ADJDELAY
0407  40 03        .R..                JC     NOADJ
0409  14                               DEC    A
040A  80 04        .R..                SJMP   ADJDELAY
040C  E4                   NOADJ:      CLR    A                        ;Default to 45ms if less, ie., realistic
040D  75 16 2D     .D..                MOV    SAVE_LATCH,#45           ;condition is transport running at 61ips
0410  25 39        .D..   ADJDELAY:    ADD    A,MARGIN                 ;(eq.=45ms) or less but seldom > 61 ips.
0412  10 12 02     .BR.                JBC    TR2_FLG,QUED_TRIP        ;If =1 mail detected within last print
0415  80 1F        .R..                SJMP   LOAD_DELAY               ;cycle else, detected in idle mode.
0417  FC                   QUED_TRIP:  MOV    R4,A              ;Compute interval from TRIP2 tripped to present.
0418  FA                               MOV    A,R2              ;Get present real-time.
0419  95 16        .D..                SUBB   A,SAVE_LATCH      ;Present time - TRIP1-to-TRIP2 interval.
041B  CC                               XCH    A,R4
041C  C3                               CLR    C
041D  9C                               SUBB   A,R4              ;Remainder =time delay before start
041E  60 1C        .R..                JZ     DRV_DRUM          ;of drum print cycle.
0420  50 14        .R..                JNC    LOAD_DELAY        ;C =0 positive valid letters gap.
0426  05 29        .D..                INC    MISTRIP_CTR       ;Not enough time for complete cycle
0428  24 02                            ADD    A,#210            ;2's cpl add'n.
042A  FE                               MOV    R6,A              ;Pad in delay to complete cycle.
042B  F1 1E        .C..                ACALL  DELAY_LOOP
042D  21 78        .C..   NO_PRINT:    AJMP   IDLE_LOOP         ;Skip print on passing mail.

042F  91 45        .C..   UNLOCK:      ACALL  N_TO_D            ;Engage drive to drum dry posn.
0431  20 33 18     .BR.                JB     STAT_FLG,EX_MAIL
0434  80 06        .R..                SJMP   DRV_DRUM
0436  FE                   LOAD_DELAY: MOV    R6,A
0437  20 18 02     .BR.                JB     TEST_FLG,DRV_DRUM        ;Skip delay in test mode.
043A  F1 1E        .C..                ACALL  DELAY_LOOP
043C  91 C1        .C..   DRV_DRUM:    ACALL  MOVE_DRUM         ;Print on mail.
043E  20 33 08     .BR.                JB     STAT_FLG,EX_MAIL
0441  20 30 04     .BR.   INKD_OFF:    JB     TRIPEN_FLG,PAUSE    ;=1 letter mode: pause to complete
0444  91 72        .C..                ACALL  D_TO_N                ;235ms/letter cycle at 61 ips.
0446  80 04        .R..                SJMP   EX_MAIL              ;=0 single print cmmd: return drive
0448  7E 01                PAUSE:      MOV    R6,#01                ;to neutral.
044A  F1 1E        .C..                ACALL  DELAY_LOOP
044C  41 13        .C..   EX_MAIL:     AJMP   CMMD_COMPLETE
                          $INCLUDE(MOTION.DMS:19)
```

```
                                ;                 ***********************************************************
                                ;                 *******        MOTION CONTROL CALL ROUTINES        *********
                                ;                 ***********************************************************

                                ;*************************************
                                ;        ROTATE PRINT DRUM
                                ;*************************************
0280  C2 07          .B..       MOVE_DRUM:        CLR     DCMDTR_FLG
0282  51 B6          .C..                         ACALL   DRUM_MOVE
0284  20 38 08       .BR.                         JB      STAT_FLG,EX_DRUM -
0287  05 45          .D..                         INC     TRIP_CTR                ;Count no. of drum trips.
0289  E5 45          .D..                         MOV     A,TRIP_CTR
028B  70 02          .R..                         JNZ     EX_DRUM
028D  05 46          .D..                         INC     TRIP_CTR+1
028F  22                        EX_DRUM:          RET

                                ;*****************************************
                                ;        MOVE TO DRIVE HOME POSITION
                                ;*****************************************
0290  90 05 00                  BHOME_MOVE:       MOV     DPTR,#BASE_1REV/2
0293  78 30          .D..                         MOV     R0,#BASE_INDEX
0295  C3                                          CLR     C                       ;Move load to absolute home posn.
0296  E5 82          .D..                         MOV     A,DPL                   ;Compute distance from current posn
0298  96                                          SUBB    A,@R0                       ;to home posn.
0299  FC                                          MOV     R4,A                    ;Result is displacement
029A  E5 83          .D..                         MOV     A,DPH                       ;to be travelled
029C  08                                          INC     R0                          ;and direction of motion.
029D  96                                          SUBB    A,@R0
029E  86 3C          .D..                         MOV     TOTAL_CNT+1,@R0
02A0  18                                          DEC     R0
02A1  86 3B          .D..                         MOV     TOTAL_CNT,@R0
02A3  D2 07          .B..                         SETB    DCMDTR_FLG
02A5  30 E7 0C       .BR.                         JNB     ACC.7,EX_HOMOVE
02A8  CC                                          XCH     A,R4
02A9  25 82          .D..                         ADD     A,DPL
02AB  F5 3B          .D..                         MOV     TOTAL_CNT,A
02AD  EC                                          MOV     A,R4
02AE  35 83          .D..                         ADDC    A,DPH
02B0  F5 3C          .D..                         MOV     TOTAL_CNT+1,A
02B2  C2 07          .B..                         CLR     DCMDTR_FLG
02B4  61 06          .C..       EX_HOMOVE:        AJMP    BPOSN_MOVE

                                ;*********************************************************
                                ;                 MOTION PROFILE REQUIREMENTS
                                ;*********************************************************
                                ;The caller has to supply the following variables.
                                ;---------------------------------------------
                                ;1. ACCELK = acceleration constant (counts/ms^2)
                                ;2. DECCELK =  deceleration constant (counts/ms^2)
                                ;3. SLEWK  = running velocity constant (counts/ms)
                                ;4. TOTAL_CNT = total distance to be traversed (counts)
                                ;5. CONT_FLG = incremental or continuous motion
                                ;6. PROF_FLG = profile or position-only (point-to-point) control.
                                ;7. LIM_ERR = max error count before calling a fault condition.
```

```
02B6  75 3B 00   .D..  DRUM_MOVE:     MOV    TOTAL_CNT,#LOW(BASE_1REV)  ;Specifies drum rotation
02B9  75 3C 0A   .D..                 MOV    TOTAL_CNT+1,#HIGH(BASE_1REV) ;velocity profile and
02BC  75 3D 79   .D..                 MOV    ACCELK,#ACCD                 ;type of control.
02BF  75 41 AE   .D..                 MOV    DECCELK,#DECCD
02C2  75 3E 11   .D..                 MOV    SLEWK,#RUND
02C5  85 49 39   .DD.                 MOV    DECCEL_INT,DRUM_DECCEL
02C8  85 4A 37   .DD.                 MOV    ACCEL_CNT,DRUM_DECCEL+1
02CB  75 38 00   .D..                 MOV    ACCEL_CNT+1,#00
02CE  D2 0A      .B..                 SETB   PROF_FLG
02D0  75 42 3F   .D..                 MOV    PLTM_ERR,#HARDFST
02D3  75 43 C1   .D..                 MOV    NLTM_ERR,#(-HARDFST)
02D6  61 14      .C..                 AJMP   START_MOTION

02D8  E4                      HUNT_MOVE:   CLR    A                  ;Search for a home position signal.
02D9  F5 3C      .D..                 MOV    TOTAL_CNT+1,A
02DB  F5 3A      .D..                 MOV    CYC_CTR,A            ;Will stop in SRCH_CNT once home
02DD  75 3B 06   .D..                 MOV    TOTAL_CNT,#SRCH_CNT  ;the home posn signal is seen.
02E0  D2 11      .B..                 SETB   CONT_FLG                 ;Run continuously
02E2  D2 0F      .B..                 SETB   HOME_FLG                 ;Tell sampling handler to
02E4  75 42 06   .D..                 MOV    PLTM_ERR,#(SRCH_CNT)        ;look for the signal.
02E7  75 43 FA   .D..                 MOV    NLTM_ERR,#(-SRCH_CNT)
02EA  80 0C      .R..                 SJMP   HUNT2

02EC  75 3B FF   .D..  ENDSTOP_MOVE:  MOV    TOTAL_CNT,#0FFH   ;Move towards an endstop.
02EF  75 3C FF   .D..                 MOV    TOTAL_CNT+1,#0FFH   ;Load max 16 bit count.

02F2  75 42 04   .D..  INITZ_MOVE:    MOV    PLTM_ERR,#SOFTERR        ;Lowest error limit for
02F5  75 43 FC   .D..                 MOV    NLTM_ERR,#(-SOFTERR)     ;soft collision at endstop.
02F8  75 3E 01   .D..  HUNT2:         MOV    SLEWK,#INITZ_SPEED       ;Slow speed= 1 cnt/sample.
02FB  75 3D 59   .D..                 MOV    ACCELK,#INITZ_ACCEL
02FE  80 12      .R..                 SJMP   TRAPZPROF
0300  75 3B 00   .D..  ONEREV_MOVE:   MOV    TOTAL_CNT,#LOW(BASE_1REV)   ;One rotation move
0303  75 3C 0A   .D..                 MOV    TOTAL_CNT+1,#HIGH(BASE_1REV) ;at base drv shaft.
0306  75 3D 88   .D..  BPOSN_MOVE:    MOV    ACCELK,#BACCT      ;base point-to-point drive.
0309  75 3E 1A   .D..                 MOV    SLEWK,#BMAX_RUN
030C  75 42 30   .D..  BPOSN2:        MOV    PLTM_ERR,#HARDER     ;Load max. error count limit
030F  75 43 D0   .D..                 MOV    NLTM_ERR,#(-HARDER) ;(harder stop).

                       ;-----------------------------------------
                       ;       INITIALIZE MOTION CONTROL LOOP,
                       ;               HOUSEKEEPING
                       ;-----------------------------------------
0312  91 A2      .C..  TRAPZPROF:      ACALL  COMP_PROF        ;Compute a trapezoidal motion profile.
0314  E4                      START_MOTION:  CLR    A
0315  FD                              MOV    R5,A
0316  F5 2E      .D..                 MOV    POSN_ACC,A       ;Clear position accumulator.
0318  F5 2F      .D..                 MOV    POSN_ACC+1,A
031A  04                              INC    A
031B  FF                              MOV    R7,A             ;Initialize accel/deccel/settl timer.
031C  74 05                           MOV    A,#05                   ;Check for size of displacement.
031E  B5 3B 01   .DR.                 CJNE   A,TOTAL_CNT,$+4           ;5 counts or less= single step
0321  C3                              CLR    C                         ; by 1 count/sample.
0322  40 11      .R..                 JC     PROCEED                   ;Else, proceed with trapz profile
```

```
0324  E4                                  CLR     A
0325  B5 3C 0D        .DR.                CJNE    A,TOTAL_CNT+1,PROCEED
0328  B5 3B 01        .DR.                CJNE    A,TOTAL_CNT,LESS5        ;Check for non-zero displacement.
032B  22                                  RET                              ;no motion required if zero.
032C  D2 10           .B..    LESS5:      SETB    SMALL_FLG
032E  C2 08           .B..                CLR     RUN_FLG
0330  75 32 01        .D..                MOV     RUN_SPEED,#01
0333  80 06           .R..                SJMP    DCMLOOP
0335  D2 08           .B..    PROCEED:    SETB    RUN_FLG
0337  C2 10           .B..                CLR     SMALL_FLG
0339  D2 17           .B..                SETB    DCMOVE_FLG               ;Start of dcmotor motion.

                              ;*************************************************
                              ;*******   DC MOTOR MOTION CONTROL LOOP   *******
                              ;*************************************************
                              ;Loops here during dc motor servo control of a
                              ;desired motion profile.
                              ;RUN_FLG and ACCEL_FLG are modified to reflect
                              ;a trapezoidal motion profile.
                              ;Output decision is used at the next sampling
                              ;instant generation of the target trajectory.
                              ;-------------------------------------------------
033B  12 08 02        ..C.    DCMLOOP:    LCALL   UPDTE_SERVO              ;Update servo control.
033E  E5 2A           .D..                MOV     A,ERR_CNT
0340  20 E7 0B        .BR.                JB      ACC.7,CNT_NEG            ;ACC.7 =1 neg cntng; 0=pos.
0343  B5 42 01        .DR.    CNT_POS:    CJNE    A,PLTN_ERR,$+4           ;Check if error count is within
0346  D3                                  SETB    C                           ;allowable limit = abs(HARDERR)
0347  50 0B           .R..                JNC     FAULT
0349  61 79           .C..                AJMP    COMP_TIMING
034B  B5 43 01        .DR.    CNT_NEG:    CJNE    A,NLTN_ERR,$+4
034E  C3                                  CLR     C
034F  50 28           .R..                JNC     COMP_TIMING

                              ;-------------------------------------------------
                              ;               DC MOTOR CONTROL LOOP EXIT
                              ;-------------------------------------------------
0351  30 0A 04        .BR.    FAULT:      JNB     PROF_FLG,SHUTOFF         ;Do not shut off if drum drv.
0354  D2 3B           .B..                SETB    STAT_FLG                 ;Just indicate fault to caller.
0356  80 21           .R..                SJMP    COMP_TIMING              ;Proceed as usual.
0358  C2 3A           .B..    SHUTOFF:    CLR     SYS_ENABLE               ;DC motor move error.
035A  43 27 4B        .D..                ORL     MSG1_STAT,#010010008     ;Set error flags and
035D  43 90 03        .D..                ORL     P1,#000000118            ;and turn off motor drive.
0360  75 32 00        .D..    END_OF_MOTION: MOV  RUN_SPEED,#00            ;Insure that before exit,
0363  C2 08           .B..                CLR     RUN_FLG                  ;motion is in constant vel
0365  C2 09           .B..                CLR     ACCEL_FLG                ;mode with speed = 0 (stop).
0367  20 3B 0C        .BR.                JB      STAT_FLG,EX_DCMLOOP
036A  20 97 07        .BR.                JB      P1.7,LONG_SETTLE         ;Select settling time delay.
036D  20 0B 04        .BR.                JB      INITZ_FLG,LONG_SETTLE       ;Longer Ts when in base
0370  91 6F           .C..                ACALL   DEL05MS                     ;drive and/or initz'n mode.
0372  80 02           .R..                SJMP    EX_DCMLOOP
0374  91 73           .C..    LONG_SETTLE: ACALL  DEL20MS
0376  C2 17           .B..    EX_DCMLOOP: CLR     DCMOVE_FLG               ;End of dcmotor motion.
0378  22                                  RET
```

```
                                ;*****************************************
                                ;       TRAPEZOIDAL MOTION PROFILE
                                ;              HOUSEKEEPING
                                ;*****************************************
                                ;Decides whether the motion is in accel phase,
                                ;constant velocity phase, deccel phase, or in
                                ;settling phase based on the motion specs and
                                ;control mode inputs.
                                ;Insure the motion stops at final position count.
                                ;Uses the following registers and control flags:
                                ;TOTAL_CNT  =desired total displacement count
                                ;POSN_ACC   =accumulated displacement count wrt time
                                ;ACCEL_CNT  =POSN_ACC value when in accel phase.
                                ;RUN_SPEED  =computed target speed last sampling instant
                                ;VEL_OFFS   =offset count to insure total displ. = desired.
                                ;ACCELK     =desired accel rate
                                ;SLEWK      =desired slew rate (running speed)
                                ;DECCELK    =desired deccel rate
                                ;CYC_CTR    =desired displacement multiplier.
                                ;RUN_FLG    =0 constant velocity phase; 1 accel/deccel
                                ;ACCEL_FLG  =0 accel phase; 1 deccel phase
                                ;PROF_FLG   =0 accel rate = deccel rate; 1 not equal
                                ;CONT_FLG   =0 start-stop mode; 1 continuous run mode
                                ;SMALL_FLG  =0 TOTAL_CNT > 5; 1 not > 5.
                                ;R7 and R5 (R80) as a 16-bit register for
                                ;keeping track of accel/deccel time interval.
                                ;Modifies RUN_FLG, ACCEL_FLG ,R7, R5 for next sampling
                                ;instant generation of the target position count.
                                ;-----------------------------------------------

0379  20 08 02     .BR.   COMP_TIMING:  JB    RUN_FLG,NOTCV          ;Examine last sampling
037C  61 80        .C..                 AJMP  CONST_VEL              ;instant's motion phase.
037F  30 09 02     .BR.   NOTCV:        JNB   ACCEL_FLG,ACCEL_VEL    ;ie.,const velocity? accel?
0381  81 18        .C..                 AJMP  DECCEL_VEL             ;deccel phase?
                                ;-----------------------------------------------
                                ;                ACCELERATION PHASE
                                ;-----------------------------------------------
0383  20 0A 08     .BR.   ACCEL_VEL:    JB    PROF_FLG,CHK_SPEEDLIM  ;Motion in accel mode IF
0386  C3                                CLR   C                      ;POSN_ACC < TOTAL_CNT/4
0387  E5 2E        .D..                 MOV   A,POSN_ACC             ;OR RUN_SPEED < SLEWK
0389  95 37        .D..                 SUBB  A,ACCEL_CNT            ;ELSE motion in constant vel mode.
038B  E5 2F        .D..                 MOV   A,POSN_ACC+1
038D  95 38        .D..                 SUBB  A,ACCEL_CNT+1
038F  50 0E        .R..                 JNC   END_ACCEL              ;Check SGN( POSN-ACCEL ).
0391  E5 32        .D..   CHK_SPEEDLIM: MOV   A,RUN_SPEED            ;If not end of accel, is com-
0393  B5 3E 02     .DR.                 CJNE  A,SLEWK,$+5            ;puted speed = target running
0396  80 07        .R..                 SJMP  END_ACCEL              ;speed? End of accel if it is.
0398  0F                                INC   R7                     ;Else, increment accel/deccel
0399  BF 00 01     ..R.                 CJNE  R7,#00,$+4             ;timekeeping regs R7, R5.
039C  0D                                INC   R5
039D  81 29        .C..                 AJMP  EXIT_TIMING
039F  30 0A 04     .BR.   END_ACCEL:    JNB   PROF_FLG,$+7           ;If end of accel, if accel not
03A2  AF 39        .D..                 MOV   R7,DECCEL_INT          ;= deccel (PROF_FLG set), preset
```

```
949  03A4  80 06          .R..        SJMP    $+8                     ;R7 with deccel interval; else,
950  03A6  85 2E 37       .DD.        MOV     ACCEL_CNT,POSN_ACC      ;save current posn cnt, ie.,
951  03A9  85 2F 38       .DD.        MOV     ACCEL_CNT+1,POSN_ACC+1  ;accel displacement.
952  03AC  C2 08          .R..        CLR     RUN_FLG                 ;indicate motion is in
953  03AE  81 29          .C..        AJMP    EXIT_TIMING             ;'constant velocity phase'.
954                                  ;-----------------------------------------------
955                                  ;           CONSTANT VELOCITY PHASE
956                                  ;-----------------------------------------------
957  03B0  C3                         CONST_VEL:  CLR     C               ;motion in constant vel mode IF
958  03B1  E5 3B          .D..        MOV     A,TOTAL_CNT             ;TOTAL_CNT - POSN_ACC - ACCEL_CNT - RUN_SP
959  03B3  95 2E          .D..        SUBB    A,POSN_ACC              ;result is > 0 OR CONT_FLG is set.
960  03B5  30 10 04       .RR.        JNB     SMALL_FLG,GT5           ;ELSE motion in deccel mode.
961  03B8  60 30          .R..        JZ      END_CONST               ;(When SMALL_FLG is set, ie., target
962  03BA  81 29          .C..        AJMP    EXIT_TIMING             ;displacement <= 5 cnts, profile is
963  03BC  F5 F0          .D..        GT5:    MOV     B,A             ;always constant velocity.)
964  03BE  E5 3C          .D..        MOV     A,TOTAL_CNT+1
965  03C0  95 2F          .D..        SUBB    A,POSN_ACC+1
966  03C2  C5 F0          .D..        XCH     A,B                     ;Result (TOTAL-POSN) lo =A ; hi =B.
967  03C4  50 0A          .R..        JNC     CNTINUE                 ;If SGN(TOTAL-POSN) negative:
968  03C6  12 09 71       ..C.        CALL    TWOS_CPL                ;displacement, must be in continuous
969  03C9  F5 2E          .D..        MOV     POSN_ACC,A              ;mode. Get absolute count to correct
970  03CB  85 F0 2F       .DD.        MOV     POSN_ACC+1,B            ;position registers.
971  03CF  81 29          .C..        AJMP    EXIT_TIMING
972  03D0  95 37          .D..        CNTINUE:    SUBB    A,ACCEL_CNT     ;If SGN positive, result = ACCEL_CNT
973  03D2  F5 33          .D..        MOV     VEL_OFFS,A              ;Save difference (= offset velocity if
974  03D4  E5 F0          .D..        MOV     A,B                     ;difference =< RUN_SPEED)
975  03D6  95 38          .D..        SUBB    A,ACCEL_CNT+1
976  03D8  FC                         MOV     R4,A                    ;Difference lo =VEL_OFFSET; hi =R4.
977  03D9  C3                         CLR     C
978  03DA  E5 33          .D..        MOV     A,VEL_OFFS              ;Result = Difference - RUN_SPEED
979  03DC  95 32          .D..        SUBB    A,RUN_SPEED             ;lo =R4 ; hi =Acc.
980  03DE  CC                         XCH     A,R4
981  03DF  94 00                      SUBB    A,#00
982  03E1  40 07          .R..        JC      END_CONST               ;End of const vel phase if negative
983  03E3  C2 12          .R..        CLR     SKIP_FLG                ;or zero result.
984  03E5  70 42          .R..        JNZ     EXIT_TIMING
985  03E7  BC 00 3F       ..R.        CJNE    R4,#00,EXIT_TIMING
986                                  ;-----------------------------------------------
987                                  ;       CONTINUOUS RUN MODE OR START-STOP?
988                                  ;-----------------------------------------------
989  03EA  30 11 1B       .RR.        END_CONST:  JNB     CONT_FLG,STOP_MOTION    ;CONT_FLG =0 start-stop mode.
990  03ED  20 12 0F       .RR.        JB      SKIP_FLG,CHKSMALL       ;          =1 continuous run.
991  03F0  D2 12          .R..        SETB    SKIP_FLG                ;0 to 1 transition of SKIP_FLG
992  03F2  91 BD          .C..        ACALL   CHKKBD                  ;indicates start of deccel phase.
993  03F4  40 03          .R..        JC      RST_CYCTR               ;motion to be stopped if in
994  03F6  D5 3A 05       .DR.        DJNZ    CYC_CTR,CHKSMALL        ;continuous run mode?
995  03F9  75 3A 01       .D..        RST_CYCTR:  MOV     CYC_CTR,#01     ;Reset cycle counter.
996  03FC  80 0A          .R..        SJMP    STOP_MOTION
997  03FE  30 10 2B       .RR.        CHKSMALL:   JNB     SMALL_FLG,EXIT_TIMING
998  0401  E4                         CLR     A                       ;Reset POSN if in continuous
999  0402  F5 2E          .D..        MOV     POSN_ACC,A              ;run mode and SMALL_FLG set,
1000 0404  F5 2F          .D..        MOV     POSN_ACC+1,A            ;ie., TOTAL <=5.
1001 0406  81 29          .C..        AJMP    EXIT_TIMING
```

```
0408  C2 11          .B..   STOP_MOTION:  CLR    CONT_FLG                ;Yes, motion is to be stopped.
040A  20 10 17       .BR.                 JB     SMALL_FLG,DECR          ;No deccel phase if SMALL_FLG
040D  D2 12          .B..                 SETB   SKIP_FLG                ;is set.
040F  D2 08          .B..                 SETB   RUN_FLG                 ;Indicate deccel phase.
0411  D2 09          .B..                 SETB   ACCEL_FLG
0413  85 41 3D       .DD.                 MOV    ACCELK,DECCELK          ;Load deccel rate.
0416  61 29          .C..                 AJMP   EXIT_TIMING
                                     ;-----------------------------------------------
                                     ;                DECCELERATION PHASE
                                     ;-----------------------------------------------
0418  30 12 09       .BR.   DECCEL_VEL:   JNB    SKIP_FLG,DECR   ;Motion in deccel mode IF
041B  E5 33          .D..                 MOV    A,VEL_OFFS      ;R7 is > 0 ELSE motion is stopped.
041D  B5 32 04       .DR.                 CJNE   A,RUN_SPEED,DECR   ;Adjust with offset velocity to
0420  C2 12          .B..                 CLR    SKIP_FLG           ;arrive at exact target count
0422  80 05          .B..                 SJMP   EXIT_TIMING        ;displacement.
0424  1F                     DECR:        DEC    R7              ;Decrement accel/deccel timekeeping
0425  BF FF 01       ..R.                 CJNE   R7,#0FFH,EXIT_TIMING    ;registers.
0428  1D                                  DEC    R5
                                     ;-----------------------------------------
                                     ;                END OF MOTION?
                                     ;-----------------------------------------
0429  BF 00 05       ..R.   EXIT_TIMING:  CJNE   R7,#00,CHKFLG   ;R7 =R5 =0 end of cycle.
042C  BD 00 02       ..R.                 CJNE   R5,#00,CHKFLG
042F  61 60          .C..                 AJMP   END_OF_MOTION
0431  00                     CHKFLG:      NOP
0432  61 3B          .C..                 AJMP   DCMLOOP
                                     $INCLUDE(MAINSUB.DMS)

                                     ;                ***********************************************
                                     ;                **********    MAIN CALL ROUTINES   ***********
                                     ;                ***********************************************

                                     ;*********************************************
                                     ;        START DCMOTOR SERVO CONTROL
                                     ;*********************************************
0434  75 8B 06       .D..   START_SERVO:  MOV    TL1,#(-TC_T1INT)        ;Initialize TL1 and
0437  75 17 01       .D..                 MOV    T1_CTR,#TC_SAMP/TC_T1INT        ;T1 int ctr.
043A  E4                                  CLR    A                       ;Clear both ins- and
043B  FA                                  MOV    R2,A                    ; 256ms-timeout ctrs.
043C  FB                                  MOV    R3,A
043D  D2 8E          .B..                 SETB   TR1                     ;Start Timer 1.
043F  22                                  RET

                                     ;*************************************************
                                     ;                STOP MAIL TRANSPORT
                                     ;*************************************************
                                     ;Turn off the AC motor.
                                     ;Lock the shutter bar if Trip Logic is enabled.
                                     ;-----------------------------------------------
0440  74 04                          STOP_XPORT:  MOV    A,#00000100B            ;Turn off AC motor.
0442  91 8B          .C..                 ACALL  OFF_SOL
0444  75 18 62       .D..                 MOV    CMND,#62H
0447  22                                  RET
```

```
1056                                ;*****************************************
1057                                ;       CHECK RECEIVE BEFORE TRANSMIT
1058                                ;*****************************************
1059  0448  10 05 14      .RR.      CHK_RECV:       JBC     BITMODE_FLG,EX_CHKRECV
1060  044B  91 60         .C..                      ACALL   CHKIMSG         ;Check for incoming msg.
1061  044D  40 08         .R..                      JC      TURN_RECV       ;Receive msg if C =1.
1062  044F  7E 0F                                   MOV     R6,#0FH         ;Wait 7bus to avoid contention.
1063  0451  DE FE         .R..                      DJNZ    R6,$

1065                                ;*********************************
1066                                ;       RECEIVE QUED MESSAGE
1067                                ;*********************************
1068  0453  91 60         .C..      MSG_QUED:       ACALL   CHKIMSG         ;Look again.
1069  0455  50 08         .R..                      JNC     EX_CHKRECV
1070  0457  12 0A 14      ..C.      TURN_RECV:      LCALL   RECV_MSG
1071  045A  10 3B 02      .RR.                      JBC     STAT_FLG,EX_CHKRECV ;Ignore msg if comm err.
1072  045D  D2 0E         .R..                      SETB    QMSG_FLG        ;Inform mainline of queued msg.
1073  045F  22                          EX_CHKRECV:     RET

1075                                ;*****************************************
1076                                ;       CHECK FOR INCOMING MESSAGE
1077                                ;*****************************************

1078  0460  C3                        CHKIMSG:        CLR     C               ;C =1 incoming msg; C =0 none.
1079  0461  30 B0 04      .RR.                      JNB     P3.0,CHK_KEY
1080  0464  D3                                     SETB    C
1081  0465  C2 13         .R..                      CLR     CMMDSRC_FLG     ;Command source is serial line.
1082  0467  22                                     RET
1083  0468  91 BD         .C..      CHK_KEY:        ACALL   CHKKBD
1084  046A  50 02         .R..                      JNC     EX_CHKIMSG
1085  046C  D2 13         .R..                      SETB    CMMDSRC_FLG     ;Command source is keyboard.
1086  046E  22                          EX_CHKIMSG:     RET

1088                                ;*****************************************************************
1089                                ;               DELAY LOOPS IN MILLISEC INCREMENT
1090                                ;*****************************************************************
1091  046F  7E 05                     DEL05MS:        MOV     R6,#SHORT_TC            ;Short settling time.
1092  0471  80 0E         .R..                      SJMP    DELAY_LOOP
1093  0473  7E 14                     DEL20MS:        MOV     R6,#LONG_TC             ;Long settling time.
1094  0475  80 0A         .R..                      SJMP    DELAY_LOOP
1095  0477  7E 3C                     DEL60MS:        MOV     R6,#60                  ;60ms delay.
1096  0479  80 06         .R..                      SJMP    DELAY_LOOP
1097  047B  7E 78                     DEL120MS:       MOV     R6,#120                 ;120ms delay.
1098  047D  80 02         .R..                      SJMP    DELAY_LOOP
1099  047F  7E F0                     DEL240MS:       MOV     R6,#240                 ;240ms delay.

1101  0481  12 08 02      ..C.      DELAY_LOOP:     LCALL   UPDTE_SERVO
1102  0484  DE F8         .R..                      DJNZ    R6,DELAY_LOOP
1103  0486  22                                     RET
1105                                ;*****************************************
1106                                ;               UPDATE AUXILLARY PORT X
1107                                ;*****************************************
1108                                ;Output solenoid drives on Port X.
1109                                ;-----------------------------------------
```

```
0487  55 44        .D..   ON_SOL:        ANL     A,PORTX_LATCH
0489  80 02        .R..                  SJMP    SAVE_PORTX
048B  45 44        .D..   OFF_SOL:       ORL     A,PORTX_LATCH
048D  F5 44        .D..   SAVE_PORTX:    MOV     PORTX_LATCH,A
048F  90 90 00                           MOV     DPTR,#PORTX
0492  F0                                 MOVX    @DPTR,A
0493  22                                 RET

                          ;*************************************************
                          ;               UPDATE PORT C 8155
                          ;*************************************************
0494  90 B8 03            ON_BIT:        MOV     DPTR,#PORTC      ;PC4, PC5 = 0.
0497  E0                                 MOVX    A,@DPTR
0498  5C                                 ANL     A,R4
0499  F0                                 MOVX    @DPTR,A
049A  22                                 RET
049B  90 B8 03            OFF_BIT:       MOV     DPTR,#PORTC      ;PC4, PC5 = 1.
049E  E0                                 MOVX    A,@DPTR
049F  4C                                 ORL     A,R4
04A0  F0                                 MOVX    @DPTR,A
04A1  22                                 RET


                          ;*************************************************
                          ;               POINT_TO_POINT PROFILE
                          ;*************************************************
                          ;Determines accel/deccel distances for a point-to-point
                          ;trapezoidal velocity profile.
                          ;-------------------------------------------------
04A2  85 3D 41      .DD.  COMP_PROF:     MOV     DECCELK,ACCELK
04A5  C2 0A         .R..                 CLR     PROF_FLG                 ;Point-to-point motion.
04A7  7C 02                              MOV     R4,#02                   ;Estimated accel distance equals
04A9  85 3C 38      .DD.                 MOV     ACCEL_CNT+1,TOTAL_CNT+1     ;total count / 4.
04AC  85 3B 37      .DD.                 MOV     ACCEL_CNT,TOTAL_CNT
04AF  E5 38         .D..   DIV_FOUR:     MOV     A,ACCEL_CNT+1            ;16 bits divided by 4.
04B1  C3                                 CLR     C
04B2  13                                 RRC     A
04B3  F5 38         .D..                 MOV     ACCEL_CNT+1,A
04B5  E5 37         .D..                 MOV     A,ACCEL_CNT
04B7  13                                 RRC     A
04B8  F5 37         .D..                 MOV     ACCEL_CNT,A
04BA  DC F3         .R..                 DJNZ    R4,DIV_FOUR
04BC  22                   EX_PACCEL:    RET

                          ;*************************************
                          ;       CHECK FOR KEY DEPRESSION
                          ;*************************************
04BD  90 C0 00            CHKKBD:        MOV     DPTR,#KEYBD      ;Check for UPI Output Buffer
04C0  E0                                 MOVX    A,@DPTR            ;Full signal.
04C1  A2 E1         .B..                 MOV     C,ACC.4
04C3  22                                 RET
```

```
1161                                ;*****************************************************************
1162                                ;       CHECK FOR ANY CHANGE IN STATUS WHEN TRIP LOGIC IS OFF
1163                                ;*****************************************************************
1164                                ;Returns to the main routine with:
1165                                ;       1. the corresponding status bit (in MSG_STAT) updated.
1166                                ;       2. STAT_FLG set if a status change occurs.
1167                                ;       3. STAT_FLG cleared if no change of status.
1168                                ;-----------------------------------------------------------------
1169  04C4  90 B8 01                PEEK_STAT:      MOV     DPTR,#PORTA             ;Read sensors.
1170  04C7  E0                                      MOVX    A,@DPTR
1171  04C8  F5 25          .D..                     MOV     SAV_SENSR,A             ;Save reading.
1172  04CA  20 2D 04       .BR.                     JB      SAV_SENSR.5,NOSET
1173  04CD  D2 14          .B..                     SETB    TEST_FLG
1174  04CF  80 02          .B..                     SJMP    CHK_MODSEL
1175  04D1  C2 14          .B..          NOSET:     CLR     TEST_FLG
1176  04D3  00                          CHK_MODSEL:     NOP
1195                                ;*****************************************
1196                                ;       HOME SIGNAL SEARCH RTN
1197                                ;*****************************************
1198  04ED  75 3A 05       .D..       HOME_SRCH:      MOV     CYC_CTR,#5
1199  04F0  D2 3A          .B..       SRCHRTRY:       SETB    SYS_ENABLE              ;Restore error flags.
1200  04F2  53 27 B5       .D..                       ANL     MSG1_STAT,#10110101B
1201  04F5  51 D8          .C..                       CALL    HOME_MOVE
1202  04F7  20 3B 05       .BR.                       JB      STAT_FLG,HOME_RTRY
1203  04FA  20 0F 02       .BR.                       JB      HOME_FLG,HOME_RTRY
1204  04FD  E4                                       CLR     A
1205  04FF  22                                       RET
1206  04FF  D5 3A EF       .DR.       HOME_RTRY:      DJNZ    CYC_CTR,SRCHRTRY        ;No. of of retries.
1207  0502  D2 3B          .B..                       SETB    STAT_FLG                ;Give up if exceeded.
1208  0504  22                                       RET
1210                                ;*********************************
1211                                ;       READ HOME SIGNAL
1212                                ;*********************************
1213  0505  91 73          .C..       HOME_CHK:       CALL    DEL20MS
1214  0507  90 B8 01                                  MOV     DPTR,#PORTA             ;Read in home signal input.
1215  050A  E0                                       MOVX    A,@DPTR
1216  050B  54 04                                    ANL     A,#4
1217  050D  22                                       RET
1219                                ;*****************************************
1220                                ;       CHECK FOR ZERO DUTY CYCLE
1221                                ;*****************************************
1222  050E  E5 2C          .D..       CHKZDC:         MOV     A,K2L
1223  0510  70 02          .B..                       JNZ     EX_CHKZDC
1224  0512  65 2B          .D..                       XRL     A,K2H           ;Returns 0 in acc if dc =0.
1225  0514  22                          EX_CHKZDC:      RET
1226  0514                              OUT_STEP        EQU     EX_CHKZDC
1227                                $INCLUDE(UPDSERVO.DMS)
1229                                ;*******************************************
1230                                ;*****   UPDATE SERVO CONTROL ELEMENTS   *****
1231                                ;*******************************************
1232                                                        ORG     B00H
1233  0800  C3                      DUMMY_CALL:     CLR     C               ;For dummy call when SDK-51
```

```
                                                  ;is not in used.

                                  ;*****************************************
                                  ;        COMPUTE MOTION TRAJECTORY
                                  ;***************************************** -
0802  53 D0 E7        .D..        UPDTE_SERVO:    ANL     PSW,#11100111B      ;Insure Reg Bank is 0!!!
0805  30 08 04        .BR.                        JNB     RUN_FLG,CONST_SPEED ;0= constant speed mode.
0808  31 42           .C..                        ACALL   COMP_ACCEL          ;1= accel/deccel (time varying) mode
080A  F5 32           .D..                        MOV     RUN_SPEED,A         ;Save speed result.
080C  85 32 36        .DD.        CONST_SPEED:    MOV     AUX_REG,RUN_SPEED   ;Convert result to double precisio
080F  75 F0 00        .D..                        MOV     B,#00               ;Integrate speed to get distance;
0812  78 2E           .D..                        MOV     R0,#POSN_ACC            ;Target trajectory (in abs posn)
0814  31 10           .C..                        ACALL   INTEGRATE               ;in POSN_ACC register.

                                  ;*****************************************
                                  ;        UPDATE ABSOLUTE POSITIONS
                                  ;*****************************************
0816  30 07 08        .BR.                        JNB     DCMDTR_FLG,INCR_INDEX   ;Sign convention of speed
0819  E5 36           .D..                        MOV     A,AUX_REG               ;for CC# or C# rotation
081B  60 07           .R..                        JZ      INCR_INDEX              ;needed for absolute posn
081D  F4                                          CPL     A                       ;bookeeping and desired
081E  04                                          INC     A                       ;signed encoder count reading
081F  F5 36           .D..                        MOV     AUX_REG,A               ;CC#=0=ons cntlng; CW=1=neg.
0821  75 F0 FF        .D..                        MOV     B,#0FFH
0824  00                          INCR_INDEX:     NOP
0825  11 E2           .C..                        ACALL   TRACK_BASE              ;Compute absolute position.
0827  78 10           .D..                        MOV     R0,#COMP_CNT
0829  31 10           .C..                        ACALL   INTEGRATE

                                  ;*****************************************
                                  ;        COMPUTE ALGORITHM VARIABLES
                                  ;         FOR NEXT SAMPLING INSTANT
                                  ;*****************************************
082B  D2 D4           .B..        COMP_K1K2:      SETB    PSW.4               ;Select register bank 2.
082D  90 00 FF                                    MOV     DPTR,#COEFF1        ;K1 =-(COEFF1 x signed last error cnt)
0830  E5 2A           .D..                        MOV     A,ERR_CNT             ;Get last sampling instant's err cnt.
0832  30 E7 06        .BR.                        JNB     ACC.7,POS_ERR         ;Get absolute value if negative.
0835  F4                          NEG_ERR:        CPL     A
0836  04                                          INC     A
0837  31 57           .C..                        ACALL   XRTN
0839  80 04           .R..                        SJMP    SAV_K1                ;Result is +, ie., -(-K1).
083B  31 57           .C..        POS_ERR:        ACALL   XRTN
083D  31 71           .C..                        ACALL   TWOS_CPL              ;Result is -, ie., -(+K1).
083F  FA                          SAV_K1:         MOV     R2,A                ;Save result.
0840  AB F0           .D..                        MOV     R3,B
                                                                              ;K2 =-(COEFF2/256 x signed last output)
0842  20 5F 0C        .BR.        CMPTK2:         JB      K2H.7,NEG_DC          ;Get abs value of last sampling
0845  85 2B 83        .DD.        POS_DC:         MOV     DPH,K2H               ;instant's algorithm output if (-).
0848  85 2C 82        .DD.                        MOV     DPL,K2L
084B  31 2D           .C..                        ACALL   COMP_K2               ;Multiply with COEFF2 constant.
084D  31 71           .C..                        ACALL   TWOS_CPL                ;Result is (-), ie., -K2.
084F  80 0E           .R..                        SJMP    PARTIAL
0851  E5 2C           .D..        NEG_DC:         MOV     A,K2L
0853  85 2B F0        .DD.                        MOV     B,K2H
```

```
0856  31 71        .C..                ACALL   TWOS_CPL
085A  F5 82        .D..                MOV     DPL,A
085A  85 F0 83     .DD.                MOV     DPH,B
085D  31 2D        .C..                ACALL   COMP_K2          ;Result is (+), ie., -(-K2).
085F  2A                     PARTIAL:  ADD     A,R2           ;Compute algorithm partial result,
0860  FA                               MOV     R2,A             ;K1 reds =K1 + K2.
0861  E5 F0        .D..                MOV     A,B
0863  3B                               ADDC    A,R3
0864  FB                               MOV     R3,A

                             ;*********************************************
                             ;       WAIT FOR SAMPLING PERIOD TIMEOUT
                             ;*********************************************
0865  90 BB 03               WAIT_1MS: MOV     DPTR,#PORTC    ;Enable encoder buffer.
0868  E0                               MOVX    A,@DPTR
0869  B2 E5        .B..                CPL     ACC.5
086B  F0                               MOVX    @DPTR,A
086C  B2 B5        .B..                CPL     P3.5           ;Trigger by hardware watchdog.
086E  15 82        .D..                DEC     DPL            ;Preset DPTR and B.
0870  75 F0 6B     .D..                MOV     B,#LOW(COEFF0)
0873  D2 38        .B..                SETB    WTCHDOG_FLG    ;Must be set when T1 interrupts to
0875  30 38 19     .BB.      WAIT_T1:  JNB     WTCHDOG_FLG,T1_DONE ;indicate pgrm is in sync with
0878  30 0F FA     .BB.                JNB     HOME_FLG,WAIT_T1       ;servo sampling clock.
087B  C2 AF        .B..                CLR     EA             ;Prevent interrupt because DPTR
087D  15 82        .D..                DEC     DPL            ;is changed to PORTA; wait until
087F  E0                               MOVX    A,@DPTR        ;portA is read and DPTR is restored.
0880  A3                               INC     DPTR           ;Bump DPTR to PORTB.
0881  D2 AF        .B..                SETB    EA
0883  54 04                            ANL     A,#04
0885  70 EE        .B..                JNZ     WAIT_T1        ;Home was seen if not zero.
0887  31 1D        .C..                ACALL   READ1_YCTR
0889  FE                               MOV     R6,A           ;Store reading to SAVE_LATCH.
088A  C2 0F        .B..                CLR     HOME_FLG       ;Tell caller home count is latched.
088C  75 3A 01     .D..                MOV     CYC_CTR,#01    ;Tell motion timing housekeeper to stop
088F  80 E4        .B..                SJMP    WAIT_T1        ;motion.

0891  A3                     T1_DONE:  INC     DPTR           ;Disable encoders buffer.
0892  E0                               MOVX    A,@DPTR
0893  B2 E5        .B..                CPL     ACC.5
0895  F0                               MOVX    @DPTR,A
0896  B2 B5        .B..                CPL     P3.5           ;Re-arm watchdog.
0898  7F 04                            MOV     R7,#TC_SAMP/TC_T1INT   ;Reload T1 timeout counter.
089A  C2 D4        .B..                CLR     PSW.4          ;Restore to R30.
089C  31 27        .C..                ACALL   TRACKTIME      ;Update realtime-keeping.
089E  20 B3 05     .BB.      CHK30VOLT: JB     P3.3,EX_UPDTE  ;=0 30VDC dips down beyond tolerance.
08A1  D2 40        .B..                SETB    LD30VDC_FLG
08A3  02 00 8F     ..C.                JMP     TFATAL         ;Force return to fatal error trap.
08A6  20 3D 01     .BB.      EX_UPDTE: JB      TRTPEV_FLG,CHK_FEED
08A9  22                               RET

                             ;*************************************************************
                             ;               CHECK MATL FEED WHEN IN PRINT CYCLE
                             ;*************************************************************
                             ;Detects trips at the transport path to give the ff. info:
```

```
;       1. time when next mail is detected at TRIP1 for its speed
;          calculation in next cycle.
;
;
;
;
;Returns to main routine with:
;       1. TRIP sensors status updated.
;       2. TR1_FLG set if TRIP1 sensor is tripped (0 to 1 transition).
;       3. TR2_FLG set if TRIP2 sensor is tripped.
;       4. No change in flags' state if no trip is detected.
;-----------------------------------------------------------------
CHK_FEED:       MOV     DPTR,#PORTA             ;Read sensors.
                MOVX    A,@DPTR
                MOV     R4,A                    ;Save reading.
                JB      TR1_FLG,CHK_TR2         ;TR1_FLG =1 TRIP1 tripped;  =0 not
CHK_TR1:        JB      ACC.6,$+5               ;Check for 0 to 1 xition at TRIP1
                SJMP    UPD_TRIP                ;No trip.
                JNB     SAV_SENSR.6,TR1_TRIPPED ;Tripped if previous status is 0.
                SJMP    UPD_TRIP
UPD_TRIP:       MOV     SAV_SENSR,R4            ;Update TRIP status.
                JNB     TR1_FLG,EX_CHKFEED
                CJNE    R2,#60,EX_CHKFEED       ;Check TRIP2 watchdog.

;*********************************************
;       CONVERT RELATIVE TO ABSOLUTE
;            LOAD POSITION COUNT
;*********************************************
TRACK_BASE:     MOV     R0,#BASE_INDEX          ;Pointer to base index reg.

                ACALL   INTEGRATE               ;Integrate computed velocity.
                MOV     DPTR,#BASE_1REV         ;DPTR = base drv 1 rev count.
COMP_ABS:       MOV     A,@R0
                JNB     ACC.7,ABS1          ;Convert index to a positive value
                DEC     R0                  ;relative to the home position count.
                XCH     A,@R0                 ;IF SGN(index) is negative
                ADD     A,DPL                   ;THEN index =index + 1 rev count
                XCH     A,@R0                   ;ELSE
                ADDC    A,DPH
                INC     R0
                MOV     @R0,A                 ;Endif.
ABS1:           DEC     R0                  ;Convert positive index value to an
                CLR     C                   ;absolute position count starting from
                MOV     A,DPL               ;home (zero) count.
                SUBB    A,@R0                 ;temp =1 rev count - index
                MOV     R4,A
                MOV     A,DPH
                INC     R0
                SUBB    A,@R0
                JNB     ACC.7,EX_ABS          ;IF SGN(temp) is negative
                XCH     A,R4                    ;THEN index = (-temp)
                CPL     A                       ;ELSE
                ADD     A,#01
                DEC     R0
```

```
1410  0908  F6                          MOV     @R0,A
1411  0909  CC                          XCH     A,R4
1412  090A  F4                          CPL     A
1413  090B  34 00                       ADDC    A,#00
1414  090D  08                          INC     R0
1415  090E  F6                          MOV     @R0,A
1416  090F  22                    EX_ABS:   RET                       ;Endit.

1418                              ;*************************************
1419                              ;       INTEGRATE VELOCITY COUNT
1420                              ;*************************************
1421  0910  E6                    INTEGRATE:  MOV     A,@R0           ;R0 holds index address lobyte.
1422  0911  25 36          .D..               ADD     A,AUX_REG       ;AUX_REG =signed velocity count
1423  0913  F6                                MOV     @R0,A             ;in counts/sample.
1424  0914  08                                INC     R0
1425  0915  E5 F0          .D..               MOV     A,B
1426  0917  36                                ADDC    A,@R0
1427  0918  F6                                MOV     @R0,A
1428  0919  22                                RET

1430                              ;*******************************************
1431                              ;       READ EXTERNAL COUNTER BUFFER
1432                              ;*******************************************
1433  091A  90 B8 02              READ_XCTR:  MOV     DPTR,#PORTB
1434  091D  E0                    READ1_XCTR: MOVX    A,@DPTR         ;Read buffer.
1435  091E  F5 36          .D..               MOV     AUX_REG,A
1436  0920  E0                                MOVX    A,@DPTR
1437  0921  B5 36 01       .DR.               CJNE    A,AUX_REG,RE_READ
1438  0924  22                                RET
1439  0925  E0                    RE_READ:    MOVX    A,@DPTR         ;Best of 3 readings.
1440  0926  22                    EX_READXCTR: RET

1442                              ;*********************************************
1443                              ;       UPDATE SYSTEM REAL-TIMEKEEPING
1444                              ;*********************************************
1445  0927  0A                    TRACKTIME:  INC     R2                      ;R2 counts 1ms-interval.
1446  0928  BA 00 01       ..R.               CJNE    R2,#00,EX_TRACKT        ;R3 counts 256ms-interval.
1447  092B  0B                                INC     R3                      ;Must be in R80.
1448  092C  22                    EX_TRACKT:  RET

1450                              ;*********************************************
1451                              ;       COMPUTE SERVO ALGORITHM VARIABLE
1452                              ;          (K2 =LAST OUTPUT x COEFF2)
1453                              ;*********************************************
1454                              ;DPTR =ABS(output) at last sampling instant.
1455                              ;-------------------------------------------
1456  092D  C3                    COMP_K2:    CLR     C                       ;Limit to maximum absolute
1457  092E  74 E8                             MOV     A,#LOW(TC_SAMP)         ;output value, ie., equals
1458  0930  95 82          .D..               SUBB    A,DPL                   ;sampling period interval.
1459  0932  74 03                             MOV     A,#HIGH(TC_SAMP)
1460  0934  95 83          .D..               SUBB    A,DPH
1461  0936  50 06          .R..               JNC     XK2
1462  0938  75 83 03       .D..               MOV     DPH,#HIGH(TC_SAMP)
```

```
1463  093B  75 82 EB      .D..                MOV     DPL,#LOW(TC_SAMP)
1464  093E  74 50                  XK2:      MOV     A,#COEFF2          ;Multiply output by COEFF2
1465  0940  80 06         .R..                SJMP    BINFRAC            ;algorithm constant.

1467                                ;*****************************************
1468                                ;        COMPUTE POSITION COUNT IN
1469                                ;           ACCELERATION PHASE
1470                                ;*****************************************
1471                                ;Accel posn =accel rate x time displacement
1472                                ;-----------------------------------------
1473  0942  8F 82         .D..      COMP_ACCEL:     MOV     DPL,R7          ;DPTR =motion real-timekeeping regs,
1474  0944  8D 83         .D..                      MOV     DPH,R5          ;ie., time displacement in milliseC.
1475  0946  E5 3D         .D..                      MOV     A,ACCELK        ;Get accel rate, counts/ms^2.

1477                                ;*****************************************
1478                                ;        FIXED-POINT BINARY-INTEGER
1479                                ;           MULTIPLICATION
1480                                ;*****************************************
1481                                ;DPTR =integer ;ACC =binary fraction (N/256)
1482                                ;-----------------------------------------
1483  094B  31 57         .C..      BINFRAC:        ACALL   XRTN        ;Do an integer multiply, integer x N.
1484  094A  A2 E7         .B..      DIV256:         MOV     C,ACC.7     ;Divide result by 256.
1485  094C  E5 F0         .D..                      MOV     A,B             ;Shift 1 byte to left B4, B, ACC.
1486  094E  34 00                                   ADDC    A,#00           ;Round off to nearest integer.
1487  0950  CC                                      XCH     B,R4            ;Result low byte = ACC.
1488  0951  34 00                                   ADDC    A,#00           ;Result high byte = B.
1489  0953  F5 F0         .D..                      MOV     B,A
1490  0955  EC                                      MOV     A,R4
1491  0956  22                                      RET

1493                                ;*****************************************
1494                                ;        DOUBLE-PRECISION INTEGER
1495                                ;           MULTIPLICATION
1496                                ;*****************************************
1497                                ;Multiplier (positive 8 bits) =ACC
1498                                ;Multiplicand (positive 16 bits) =DPTR
1499                                ;Product result in R4 (msd), B, ACC (lsd).
1500                                ;-----------------------------------------
1501  0957  FC                      XRTN:           MOV     R4,A        ;Compute product low byte.
1502  0958  85 82 F0      .DD.                      MOV     B,DPL           ;Load multiplicand low byte
1503  0958  A4                                     MUL     AB              ;Multiplier saved to R4.
1504  095C  C0 E0         .D..                      PUSH    ACC             ;Save product low byte.
1505  095E  C0 F0         .D..                      PUSH    B               ;Save partial product high byte.
1506  0960  EC                                      MOV     A,R4        ;Compute product high byte.
1507  0961  85 83 F0      .DD.                      MOV     B,DPH           ;Load multiplicand high byte.
1508  0964  A4                                     MUL     AB
1509  0965  D0 83         .D..                      POP     DPH             ;Get intermediate prod high byte.
1510  0967  25 83         .D..                      ADD     A,DPH           ;Sum is final prod high byte.
1511  0969  C5 F0         .D..                      XCH     A,B             ;Prod 2nd byte = B.
1512  096B  34 00                                   ADDC    A,#00
1513  096D  FC                                      MOV     R4,A            ;Prod 3rd byte(MSB) = R4.
1514  096E  D0 E0         .D..                      POP     ACC             ;Prod 1st byte(LSB) = ACC
1515  0970  22                                      RET                     ;Return to caller.
```

```
                                ;*********************************
                                ;       DOUBLE-PRECISION
                                ;       TWOS COMPLEMENT
                                ;*********************************
0971  F4                        TWOS_CPL:       CPL     A               ;ACC =lo byte.
0972  24 01                                     ADD     A,#01           ;A =hi byte.
0974  C5 F0           .D..                      XCH     A,B
0976  F4                                        CPL     A
0977  34 00                                     ADDC    A,#00
0979  C5 F0           .D..                      XCH     A,B
097B  22                                        RET
                                $INCLUDE(NEWCOMRTN.DMS)

                                ;*************************************
                                ;       COMMUNICATION ROUTINES
                                ;       TIME DELAY DECLARATIONS
                                ;*************************************
                                ;Transmitter echoplex protocol time
                                ;constants in microsecond.
                                ;--------------------------------
0068                            BITTX           EQU     104             ;Bit-to-bit xmit/echo-sample time.
00AA                            SBTX            EQU     170             ;CTS detect to Start Bit time.
0154                            NEPTX           EQU     340             ;No-Error-Pulse width.
046F                            BYTETX          EQU     1135            ;Byte-to-byte xmit time.
005C                            DELAY1          EQU     (BITTX-12)      ;Delay before xmitting 1st data bit.
0055                            DELAY2          EQU     (BITTX-19)      ;Delay before xmitting next data bit.
005C                            DELAY3          EQU     (BITTX-12)      ;Delay before sampling EOM/EOB.
005B                            DELAY4          EQU     (BYTETX-(BITTX*10)-4)   ;Delay before next byte xmit.
                                ;-----------------------------------
                                ;Receiver echoplex protocol time constants.
                                ;-----------------------------------
0064                            CTSRX           EQU     100             ;RTS detect to CTS xmit time.
002A                            SBRX            EQU     42              ;SB detect to SB echo time.
0078                            BIT1RX          EQU     120             ;SB detect to 1st bit sample time.
008C                            ECH1RX          EQU     140             ;SB detect to 1st data bit echo time.
006A                            BITRX           EQU     106             ;Bit-to-bit sample/xmit-echo time.
04A4                            NEPRX           EQU     1188            ;SB detect to NEP sample time.
0610                            BYTERX          EQU     1552            ;Time until next receiver activity.
0050                            DELAY5          EQU     (CTSRX-20)      ;Delay before xmitting CTS.
004B                            DELAY6          EQU     (BIT1RX-SBRX-3) ;Delay before sampling 1st data bit.
0012                            DELAY7          EQU     (ECH1RX-BIT1RX-2) ;Delay before echoing recv'd bit.
0050                            DELAY8          EQU     (BITRX-DELAY7-8)  ;Delay before sampling next data bit.
008E                            DELAY9          EQU     (BYTETX-(BIT1RX+BITRX*8)-25) ;Delay before next byte recv.
00C3                            DELAY10         EQU     (NEPRX-BYTETX+DELAY9)   ;Delay before sampling NEP.
016C                            DELAY11         EQU     (BYTERX-NEPRX)          ;Delay before recv rtn exit.

                                ;*****************************************
                                ;       MACRO TO GENERATE CODE FOR
                                ;               TIME DELAYS
                                ;*****************************************
                                TIME            MACRO   DVND
                                                IF      (DVND MOD 2) EQ 0
                                                MOV     R2,#((DVND-2)/2)
```

```
                                        DJNZ    R2,$
                                        NOP
                                        ELSE
                                        MOV     R2,#(DVND/2)
                                        DJNZ    R2,$
                                        ENDIF
                                        ENDM

                                ;*****************************************
                                ;       TRANSMIT MESSAGE TO SOURCE
                                ;*****************************************
                                ;RECVER_FLG =0 xmit thru serial line; =1 thru display.
                                ;-----------------------------------------------
097C  E4                        XMIT_STAT:      CLR     A
097D  51 D1             .C..                    ACALL   XCOMPREP                ;transmit system status.
097F  30 16 0C          .BR.                    JNB     RECVER_FLG,STAT_SERIAL
0982  12 E0 0F                                  LCALL   CLRDSP
0985  AA 28             .D..                    MOV     R2,MSG2_STAT
0987  AB 27             .D..                    MOV     R3,MSG1_STAT
0989  12 E0 18                                  LCALL   DSP2BY
098C  41 12             .C..                    AJMP    END_OF_XMIT
098E  79 26             .D..    STAT_SERIAL:    MOV     R1,#STAT_HEADER
0990  7D 03                                     MOV     R5,#03
0992  75 26 80          .D..                    MOV     STAT_HEADER,#80H
0995  21 AF             .C..                    AJMP    XMIT_RTN
0997  74 02                     XMIT_CMMDC:     MOV     A,#02
0999  51 D1             .C..                    ACALL   XCOMPREP        ;transmit command-execution-complete.
099B  30 16 0A          .BR.                    JNB     RECVER_FLG,CMMDC_SERIAL
099E  12 E0 0F                                  LCALL   CLRDSP
09A1  AA 46             .D..                    MOV     R2,TRIP_CTR+1
09A3  12 E0 19                                  LCALL   DSP1BY
09A6  41 12             .C..                    AJMP    END_OF_XMIT
09A8  79 2D             .D..    CMMDC_SERIAL:   MOV     R1,#CMMD_HEADER
09AA  7D 02                                     MOV     R5,#02
09AC  75 2D 83          .D..                    MOV     CMMD_HEADER,#83H

                                ;*********************************************
                                ;       TRANSMISSION ECHOPLEX ROUTINE
                                ;               ( 12 MHZ CLOCK )
                                ;*********************************************
                                ;CAUTION: Instruction code, sequence, and loops
                                ;       are critical to time delay computations.
                                ;R0 =pointer to time constant watchdog.
                                ;R1 =start addrs of xmitting buffer.
                                ;R2 =timer delay constants register.
                                ;R3 =save area for byte to be xmitted.
                                ;R4 =communication failure counter.
                                ;R5 =no. of bytes to be xmitted.
                                ;R6 =stack pointer save area for wtchdg timeout.
                                ;R7 =save area for no. of data bits per byte.
                                ;-----------------------------------------------
09AF  D2 B1             .B..    XMIT_RTN:       SETB    P3.1            ;Xmit RTS.
09B1  30 B0 FD          .BR.                    JNB     P3.0,$          ;wait CTS until wtchdog times out.
09B4                                            TIME    S8TX            ;Delay before xmitting Start Bit.
```

```
09B9  C2 B1        .B..   START_XMIT:  CLR   P3.1              ;Xmit Start Bit.
09BB  7F 08                            MOV   R7,#08            ;Load no. of data bits per byte.

09BD  C3                               CLR   C
09BE  92 15        .B..                MOV   SAVE1_BIT,C       ;First N-1 bit is Start Bit, ie., 0.
09C0  E7                               MOV   A,@R1             ;Get byte to be xmitted.
09C1  F8                               MOV   R3,A              ;Save to work area.
09C2  09                               INC   R1                ;Points to next byte.
09C3                                   TIME  DELAY1            ;Delay before xmitting first data bit.
09C8  EB                   BITOUT:     MOV   A,R3
09C9  13                               RRC   A                 ;Place bit into C.
09CA  FB                               MOV   R3,A
09CB  92 B1        .B..                MOV   P3.1,C            ;Transmit Nth bit (C).
09CD  51 FC        .C..                ACALL CHK_ECHO          ;Check echo of N-1 bit.
09CF  30 06 3B     .BR.                JNB   COMERR_FLG,XMITERR      ;Echo error if set.
09D2  92 15        .B..                MOV   SAVE1_BIT,C       ;Save N bit, ie., N-1 bit = N.
09D4                                   TIME  DELAY2            ;Delay before xmitting next data bit.
09D8  DF EE        .R..                DJNZ  R7,BITOUT         ;All data bits xmitted?
09DA  00                               NOP                     ;NOP to balance bit-to-bit delay.
09DB  DD 18        .R..                DJNZ  R5,XMIT_EOB       ;End-of-Msg if zero, else, End-of-Byte.
09DD  C2 B1        .B..   XMIT_EOM:    CLR   P3.1              ;Xmit EOM.
09DF  51 FC        .C..                ACALL CHK_ECHO          ;Check echo of last data bit.
09E1  30 06 26     .BR.                JNB   COMERR_FLG,XMITERR
09E4                                   TIME  DELAY3            ;Delay before reading EOM/EOB echo.
09E9  20 B0 1F     .BR.                JB    P3.0,XMITERR      ;Check EOM echo.
09EC  D2 B1        .B..                SETB  P3.1              ;Everything is OK; xmit NEP.
09EE                                   TIME  NEPTX             ;Delay for NEP width.
09F3  80 1D        .R..                SJMP  END_OF_XMIT       ;End of xmission.
09F5  D2 B1        .B..   XMIT_EOB:    SETB  P3.1              ;Xmit EOB.
09F7  51 FC        .C..                ACALL CHK_ECHO          ;Check echo of last data bit.
09F9  30 06 0E     .BR.                JNB   COMERR_FLG,XMITERR
09FC                                   TIME  DELAY3
0A01  30 B0 06     .BR.                JNB   P3.0,XMITERR      ;Check EOB echo.
0A04                                   TIME  DELAY4            ;Delay before start of next byte xmit.
0A0B  21 B9        .C..                AJMP  START_XMIT        ;Start xmitting next byte.
0A0A  C2 06        .B..   XMITERR:     CLR   COMERR_FLG        ;Indicate communication error.
0A0C  C2 B1        .B..                CLR   P3.1              ;Drop Xmit line.
0A0E  DA FE        .R..                DJNZ  R2,$              ;Force an EOM error.
0A10  DA FE        .R..                DJNZ  R2,$
0A12  41 BC        .C..   END_OF_XMIT: AJMP  CHK_COMERR        ;Check for xmit error.

                          ;*****************************************
                          ;       RECEIVE MESSAGE FROM SOURCE
                          ;*****************************************
0A14  B5 18 1D     .DD.   RECV_MSG:    MOV   OLD_CMMD,CMMD     ;Save current command.
0A17  75 09 18     .DD.                MOV   R1_RB1,#CMMD
0A1A  51 2B        .C..                ACALL RECV_RTN
0A1C  30 3B 03     .BR.                JNB   STAT_FLG,EX_RECVRTN
0A1F  B5 1D 18     .DD.                MOV   CMMD,OLD_CMMD
0A22  22                   EX_RECVRTN: RET

0A23  75 09 36     .DD.   RECV_KCODE:  MOV   R1_RB1,#AUX_REG
0A26  51 2B        .C..                ACALL RECV_RTN
0A28  E5 36        .D..                MOV   A,AUX_REG
```

```
1717  0A2A  22                                  RET

1719  0A2B  74 04                RECV_RTN:      MOV     A,#04
1720  0A2D  51 D1        .C..                   ACALL   XCOMPREP
1721  0A2F  30 13 0D     .BR.                   JNB     CMMDSRC_FLG,STRT_RECV
1722  0A32  12 F6 4C                GETKCODE:    CALL    UPT_IN          ;Use SDK-51 tool.
1723  0A35  C2 E7        .B..                   CLR     ACC.7
1724  0A37  F7                                  MOV     @R1,A           ;Save keycode.
1725  0A38  7A 00                                MOV     R2,#00
1726  0A3A  12 E6 25                            CALL    UPT_CMD         ;Reset UPI.
1727  0A3D  41 8C        .C..                   AJMP    END_OF_RECV

1729                                ;*****************************************
1730                                ;       RECEIVE ECHOPLEX ROUTINE
1731                                ;           ( 12 MHZ CLOCK )
1732                                ;*****************************************
1733                                ;CAUTION:  Instruction code, sequence, and
1734                                ;loops are critical to time delay computations.
1735                                ;R1 =start addrs of msg recv buffer.
1736                                ;R3 =byte-building register.
1737                                ;-----------------------------------------
1738  0A3F                          STRT_RECV:     TIME    DELAY5          ;Delay before xmitting CTS.
1745  0A44  D2 B1        .B..                     SETB    P3.1            ;Transmit CTS.
1746  0A46  20 B0 FD     .BR.       WAIT_STARTB:  JB      P3.0,$          ;Wait Start Bit until watchdog times out.
1747  0A49                                        TIME    SBRX            ;Delay before echoing Start Bit.
1754  0A4E  C2 B1        .B..                     CLR     P3.1            ;Echo Start Bit.
1755  0A50  7F 08                                 MOV     R7,#08          ;Reset no. of data bits /byte.
1756  0A52                                        TIME    DELAY6          ;Delay before sampling first data bit.
1762  0A56  A2 B0        .B..       RECV_BIT:     MOV     C,P3.0          ;Get bit from recv line.
1763  0A58                                        TIME    DELAY7          ;Delay before echoing recv'd data bit.
1770  0A5D  92 B1        .B..                     MOV     P3.1,C          ;Echo received bit.
1771  0A5F  EB                                    MOV     A,R3            ;Get byte-building register.
1772  0A60  13                                    RRC     A               ;Move recv'd bit to register.
1773  0A61  FB                                    MOV     R3,A
1774  0A62                                        TIME    DELAY8          ;Delay before sampling next data bit.

1781  0A67  DF ED        .R..                     DJNZ    R7,RECV_BIT
1782  0A69  A2 B0        .B..       BYTE_COMPLETE: MOV    C,P3.0          ;Sample FOR/EOM.
1783  0A6B                                        TIME    DELAY7
1790  0A70  92 B1        .B..                     MOV     P3.1,C          ;Echo FOR/EOM.
1791  0A72  A7 0B        .D..                     MOV     @R1,R3_R91      ;Move byte to msg recv buffer.
1792  0A74  09                                    INC     R1              ;Points to next byte buffer.
1793  0A75  50 07        .R..                     JNC     EOM_RECVD       ;What was it, FOR or EOM?
1794  0A77                          FOR_RECVD:    TIME    DELAY9          ;Delay before receiving next byte.
1801  0A7C  41 46        .C..                     AJMP    WAIT_STARTB
1802  0A7E                          EOM_RECVD:    TIME    DELAY10         ;Delay before sampling NFP.
1808  0A82  20 B0 02     .BR.                     JB      P3.0,NO_ERROR   ;No error in received msg if set.
1809  0A85  C2 06        .B..                     CLR     COMERR_FLG      ;Else, indicate communication error.
1810  0A87                          NO_ERROR:     TIME    DELAY11         ;Delay before rtn becomes ready for next msg
1817  0A8C                          END_OF_RECV   EJU     $

1819                                ;*****************************************
1820                                ;       COMMUNICATION RTN EXIT
1821                                ;*****************************************
```

```
0A8C  10 06 0D     .BR.   CHK_COMERR:   JBC    COMERR_FLG,GOODCOM
0A8F  D2 3B        .B..   BADCOM:       SETB   STAT_FLG          ;Communication error is a soft error.
0A91  BC FF 05     ..R.                CJNE   COMERR_CTR,#255,INCOMERR
0A94  D2 46        .B..                SETB   BADCOM_FLG        ;Indicate bad comm line error.
0A96  02 02 03     ..C.                JMP    JFATAL
0A99  0C                      INCOMERR:  INC    COMERR_CTR
0A9A  80 02        .R..                SJMP   COMRETRY
0A9C  7C 00                   GOODCOM:   MOV    COMERR_CTR,#00   ;Reset retry ctr
0A9E  C2 8C        .B..       COMRETRY:  CLR    TR0              ;Stop watchdog timer.
0AA0  C2 B1        .B..                  CLR    P3.1             ;Drop TX line low.
0AA2  C2 D3        .B..                  CLR    PSW.3            ;Return to RB0.
0AA4  C3                                 CLR    C                ;Adjust mainline real-timekeeping,
0AA5  E5 8A        .D..                  MOV    A,TL0            ;ie., compensate for time spent in
0AA7  25 82        .D..                  ADD    A,DPL            ;echoplex communication
0AA9  FC                                 MOV    R4,A                     ;because servo clock was
0AAA  E5 8C        .D..                  MOV    A,TH0                    ;turned off.
0AAC  35 83        .D..                  ADDC   A,DPH
0AAE  CC                      TIERADJ:   XCH    A,R4                 ;Determine no. of sampling period
0AAF  C3                                 CLR    C                        ;that had passed while in
0AB0  94 E8                              SUBB   A,#LOW(TC_SAMP)            ;communication.
0AB2  CC                                 XCH    A,R4
0AB3  94 03                              SUBB   A,#HIGH(TC_SAMP)
0AB5  40 04        .R..                  JC     ADJRMDR
0AB7  31 27        .C..                  ACALL  TRACKTIME            ;Adjust timekeeping registers.
0AB9  80 F3        .R..                  SJMP   TIERADJ
0ABB  CC                      ADJRMDR:   XCH    A,R4                 ;Round off within one sampling
0ABC  8C F0        .D..                  MOV    B,R4                     ;period.
0ABE  31 71        .C..                  ACALL  TWOS_CPL
0AC0  C3                                 CLR    C
0AC1  94 F4                              SUBB   A,#LOW(TC_SAMP/2)
0AC3  E5 F0        .D..                  MOV    A,B
0AC5  94 01                              SUBB   A,#HIGH(TC_SAMP/2)
0AC7  40 02        .R..                  JC     ADJDONE
0AC9  31 27        .C..                  ACALL  TRACKTIME
0ACB  75 8B 06     .D..       ADJDONE:   MOV    TL1,#(-TC_TINT)
0ACE  D2 8E        .B..                  SETB   TR1              ;Re-start servo control.
0AD0  22                                 RET                     ;Return to caller.

                              ;*****************************************
                              ;       SET UP COMMUNICATION WATCHDOG
                              ;*****************************************
0AD1  C2 8E        .B..       XCOMPREP:  CLR    TR1              ;Stop servo.
0AD3  C2 8C        .B..                  CLR    TR0              ;Stop PWM timer.
0AD5  43 90 03     .D..                  ORL    P1,#00000011B    ;Insure no drive to motors.
0AD8  D2 D3        .B..                  SETB   PSW.3            ;Select Register bank 3.
0ADA  90 0A F6     ..C.                  MOV    DPTR,#WTCHDG_TAB
0ADD  93                                 MOVC   A,@A+DPTR
0ADE  FE                                 MOV    R6,A
0ADF  A3                                 INC    DPTR
0AE0  93                                 MOVC   A,@A+DPTR
0AE1  F5 82        .D..                  MOV    DPL,A            ;Save watchdog time interval.
0AE3  F4                                 CPL    A
0AE4  F5 8A        .D..                  MOV    TL0,A            ;Load watchdog timer.
```

```
1875  0AE6  EE                                  MOV     A,R6
1876  0AE7  F5 83          .D..                 MOV     DPH,A
1877  0AE9  F4                                  CPL     A
1878  0AEA  F5 8C          .D..                 MOV     TH0,A
1879  0AEC  D2 06          .B..                 SETB    COMERR_FLG      ;Enable communication error flag.
1880  0AEE  D2 8C          .B..                 SETB    TR0             ;Start watchdog timer.
1881  0AF0  E5 81          .D..                 MOV     A,SP            ;Set-up stack pointer for
1882  0AF2  14                                  DEC     A               ;forced-return if watchdog
1883  0AF3  14                                  DEC     A               ;times out.
1884  0AF4  FE                                  MOV     R6,A            ;Save to R5 (RBI).
1885  0AF5  22                                  RET
1886  0AF6  0F A0                    WTCHDG_TAB:  DW      4000            ;4ms interval.
1887  0AF8  13 88                                DW      5000            ;5ms interval.
1888  0AFA  1F 40                                DW      8000            ;8ms interval.

1890                              ;*****************************************
1891                              ;       CHECK XMITTED DATA BIT ECHO
1892                              ;*****************************************
1893  0AFC  20 B0 04       .BR.    CHK_ECHO:    JB      P3.0,ECH_IS_ONE
1894  0AFF  20 15 04       .BR.    ECH_IS_ZERO: JB      SAVE1_BIT,ECHOERR       ;Echo error if not the same.
1895  0B02  22                                  RET
1896  0B03  20 15 02       .BR.    ECH_IS_ONE:  JB      SAVE1_BIT,$+5
1897  0B06  C2 06          .B..    ECHOERR:     CLR     COMERR_FLG              ;Indicate communication error.
1898  0B08  22                                  RET
1899  0B09                                      END
M51 assembly errors =     0

                                                END
```

What is claimed is:

1. In combination with rotary printing means for printing indicia on a continuously moving sheet, and microcomputer means including a microprocessor programmed for controlling the angular velocity of the indicia printing means in consideration of the velocity of the sheet and of sampled increments of angular velocity of the indicia printing means to normally cause the indicia to be printed on the sheet a predetermined marginal distance from an edge of the sheet substantially independently of the velocity of the sheet, an improvement for changing the marginal distance, the improvement comprising:

a. operator-controlled means for providing at least one signal representative of at least one increment of distance; and b. the microcomputer means including means for processing the at least one signal to provide a changed marginal distance, wherein the changed marginal distance includes the predetermined marginal distance changed by the at least one increment of distance.

2. The improvement according to claim 1, wherein the operator-controlled means includes at least one key depressible by the operator for providing the at least one signal.

3. The improvement according to claim 2, wherein the at least one key includes two keys, one of said two keys being depressible for providing a signal representative of a positive increment of distance, and the other of said two keys being depressible for providing a signal representative of a negative increment of distance.

4. The improvement according to claim 1, wherein the processing means includes means for counting each said at least one signal.

5. The improvement according to claim 1, wherein the processing means includes means for calculating the changed marginal distance.

6. The improvement according to claim 3, wherein the processing means includes means for counting the signals and providing an amount representative of a summation of the increments of distance.

7. The improvement according to claim 6, wherein the processing means includes means for calculating the changed marginal distance, and wherein the changed marginal distance is a function of said summation.

8. In combination with sheet handling apparatus including means for continuously feeding a sheet rotary printing means for printing postage indicia on the continuously fed sheet, and microcomputer means including a microprocessor programmed for controlling the indicia printing means in consideration of the velocity of the sheet and of sampled increments of angular velocity of the indicia printing means to normally cause the postage indicia to be printed on the sheet a predetermined marginal distance from an edge of the sheet substantially independently of the velocity of the sheet, an improvement for changing the marginal distance, the improvement comprising a. operator-controlled means for providing at least one signal representative of at least one increment of distance; and b. the microcomputer means including means for processing the at least one signal to provide a changed marginal distance, wherein the changed marginal distance includes the predetermined marginal distance changed by at least one increment of distance.

9. The improvement according to claim 8, wherein the operator-controlled means includes at least one key depressible by the operator for providing the at least one signal.

10. The improvement according to claim 9, wherein the at least one key includes two keys, one of said two keys being depressible for providing a signal representative of a positive increment of distance, and the other of said two keys being depressible for providing a signal representative of a negative increment of distance.

11. The improvement according to claim 8, wherein the processing means includes means for counting each said at least one signal.

12. The improvement according to claim 8, wherein the processing means includes means for calculating the changed marginal distance.

13. The improvement according to claim 10, wherein the processing means includes means for counting the signals and providing an amount representative of a summation of the increments of distance.

14. The improvement according to claim 13, wherein the processing means includes means for calculating the changed marginal distance, and wherein the changed marginal distance is a function of said summation.

15. The improvement according to claim 8, wherein the microcomputer means includes means for storing at least one signal for a predetermined time interval.

16. The improvement according to claim 13, wherein the processing means includes means for storing said amount during the operating time interval of said processing means.

* * * * *